US005306603A

United States Patent [19]

Mihayashi et al.

[11] Patent Number: 5,306,603

[45] Date of Patent: Apr. 26, 1994

[54] SILVER HALIDE COLOR PHOTOGRAPHIC LIGHT-SENSITIVE MATERIAL, AND METHOD OF PROCESSING THE SAME

[75] Inventors: Keiji Mihayashi; Atsuhiro Ohkawa, both of Minami-Ashigara, Japan

[73] Assignee: Fuji Photo Film Co., Ltd., Kanagawa, Japan

[21] Appl. No.: 892,963

[22] Filed: Jun. 3, 1992

[30] Foreign Application Priority Data

Jun. 6, 1991 [JP] Japan ..... 3-160814
Jan. 10, 1992 [JP] Japan ..... 4-20789

[51] Int. Cl.[5] ..... G03C 7/32; G03C 7/34; G03C 7/18

[52] U.S. Cl. ..... 430/359; 430/226; 430/544; 430/549; 430/553; 430/955; 430/957

[58] Field of Search ..... 430/226, 359, 544, 957, 430/565, 382, 553, 549, 955

[56] References Cited

U.S. PATENT DOCUMENTS 4,647,527 3/1987 Ikenoue et al. ..... 430/359
4,857,440 8/1989 Begley et al. ..... 430/544
4,861,701 8/1989 Burns et al. ..... 430/544
4,883,746 11/1989 Shimada et al. ..... 430/359
5,075,207 12/1991 Langen et al. ..... 430/359
5,085,971 2/1992 Katoh et al. ..... 430/544
5,112,730 5/1992 Ohkawa et al. ..... 430/359
5,178,993 1/1993 Fujita et al. ..... 430/553

FOREIGN PATENT DOCUMENTS

0435334A2 12/1990 European Pat. Off. .

*Primary Examiner*—Richard L. Schilling
*Attorney, Agent, or Firm*—Sughrue, Mion, Zinn, Macpeak & Seas

[57] ABSTRACT

A light-sensitive material having high light-sensitivity and high contrast and excelling in color reproduction at all light-exposed regions, yellow-image sharpness, magenta-image sharpness, and cyan-image sharpness, and having its sensitivity little deteriorated during storage. The material comprises at least one light-sensitive, silver halide emulsion layer on a support, and contains at least one specified compound which releases a photographically useful group, and a yellow-colored cyan coupler.

20 Claims, No Drawings

SILVER HALIDE COLOR PHOTOGRAPHIC LIGHT-SENSITIVE MATERIAL, AND METHOD OF PROCESSING THE SAME

BACKGROUND OF THE INVENTION

1. Field of the Invention

The present invention relates to a silver halide color photographic light-sensitive material and a method of processing this light-sensitive material. More particularly, the invention relates to a silver halide color photographic light-sensitive material containing a novel timing DIR compound and a yellow-colored cyan coupler, and also to a method of processing this light-sensitive material.

2. Description of the Related Art

There is a demand for a silver halide color photographic light-sensitive material which has high light-sensitivity and excels in sharpness, color reproduction and graininess, which has photographic properties little changing after it has been exposed to light until it is developed, and which can be manufactured at low cost.

As the means to improve the sharpness and color reproduction of such a light-sensitive material, a timing DIR coupler which releases a development-inhibiting compound through two timing groups is known. DIR couplers of this type are disclosed in, for example, JP-A-60-218645 ("JP-A" means Published Unexamined Japanese Patent Application), JP-A-61-156127, JP-A-63-37346, JP-A-1-219747, JP-A-1-280755, JP-A-2-230139, Laid-open European Patent Application 348139, Laid-open European Patent Application 354532, and Laid-open European Patent Application 403019. The use of a timing DIR coupler indeed enhances inter-layer effect or edge effect, and improves sharpness and color reproducibility to some extent. However, unless the coupler releases the development-inhibiting compound in an amount sufficient to inhibit development, neither the inter-layer effect nor the edge effect can be sufficient. Further, there are some problems that desirable inter-layer effect cannot be attained if a light-sensitive layer to be inhibited is not developed to same extent or is difficult to develop. Consequently, no sufficient inter-layer effect can be achieved at various layers forming the light-sensitive material, or on all light-exposed portions of the light-sensitive material. In some cases, although inter-layer effect is attained, the coupler-added layers and the adjacent layers have their light-sensitivities decreased, leading to soft gradiation. Further, it has also found that the fog of the light-sensitive material is increased during storage.

The light-sensitive material disclosed in, for example, JP-A-1-319744, and JP-A-61-221748, which contains couplers similar to the yellow-colored cyan coupler of the present invention, is known to have good color reproduction due to the effect which is similar to the above-mentioned inter-layer effect. However, the use of those couplers alone cannot serve to achieve their effect sufficiently on all light-exposed portions of the light-sensitive material. Further, the yellow-colored cyan coupler, hitherto known, is disadvantageous in that the molar extinction coefficient of its yellow dye is small and the coupling activity, thereof is also low.

SUMMARY OF THE INVENTION

A first object of the present invention is to provide a light-sensitive material which has high light-sensitivity and high contrast and excels in color reproducibility at all light-exposed regions, and also to provide a method of processing this light-sensitive material.

A second object of the invention is to provide a light-sensitive material which excels in yellow-image sharpness, magenta-image sharpness, and cyan-image sharpness.

A third object of this invention is to provide a light-sensitive material the photographic properties of which, particularly its sensitivity, little deteriorate during the storage of the material.

A fourth object of the invention is to provide a light-sensitive material which can be manufactured at low cost.

A fifth object of the present invention is to provide a light-sensitive material which has small process-dependency.

These objects of the invention have been achieved by a light-sensitive material and a method of processing the same, both to be specified below.

According to the invention, there is provided a silver halide color photographic light-sensitive material which comprises at least one light-sensitive, silver halide emulsion layer on a support and which contains at least one compound represented by the following formula (I) and a yellow-colored cyan coupler: formula (I)

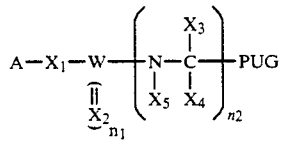

where A is a coupler residual group or a redox group; $X_1$ is oxygen or sulfur; $X_2$ is oxygen, sulfur or $=NX_6$ group; W is carbon or sulfur; $X_3$, $X_4$, $X_5$ and $X_6$ are each hydrogen or an organic group, and any two of $X_3$, $X_4$ and $X_5$ can be divalent groups which form a ring; PUG is a photographically useful group bonding at a heteroatom; $n_1$ is 1 if W is carbon, and either 1 or 2 if W is sulfur; and if $n_1$ is 2, two $X_2$ can either be the same or different; and $n_2$ is either 1 or 2, and if $n_2$ is 2, two $X_3$, two $X_4$, and two $X_5$ can be either the same or different.

Also, according to the invention, there is provided a method of processing the silver halide color photographic light-sensitive material defined above, said method comprising the steps of: subjecting the material to imagewise light-exposure, and treating the light-exposed material with a color-developing solution containing 4-amino-3-methyl-N-ethyl-N-(3-hydroxypropyl) aniline, 4-amino-3-methyl-N-ethyl-N-(4-hydroxybutyl) aniline, 4-amino-3-methyl-N-propyl-N-(2-hydroxyethyl) aniline, or 4-amino-3-methyl-N-propyl-N-(3-hydroxypropyl) aniline.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

DETAILED DESCRIPTION OF THE PREFERRED EMBODIMENTS

When the compound represented by the formula (I) reacts with an oxidized form of a developing agent (Dox), the bond between A and $X_1$ is cleaved, then the bond between W and N is cleaved, with the bond between N and C being further cleaved if $n_2$ is 2, and finally the bond between PUG and C is cleaved, whereby PUG is released from the compound, according to the scheme A.

Scheme (A)

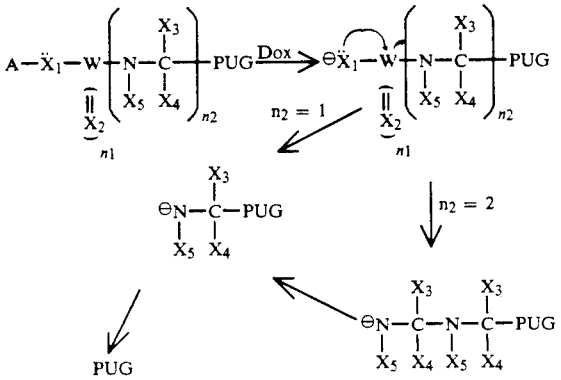

As has been pointed out, A in the formula (I) is a coupler residue or redox group.

Examples of the coupler residue are: a yellow coupler residue (e.g., a closed chain ketomethylene-type coupler residue such as acylacetonailide or malondianilide), a magenta coupler residue (e.g., a coupler residue such as a 5-pyrazolone-type one, a pyrazoloazole-type one, or an imidapyrazole-type one), a cyan coupler residue (e.g., a coupler residue such as a phenol-type one, a naphthol-type one, an imidazole-type one disclosed in Laid-Open European Patent Application 249,453, or a pyrazolopyrimidine-type one disclosed in Laid-open European Patent Application 304,001), and a non-dye-forming coupler residue (e.g., a coupler residue such as an indanone-type one or an acetophenone-type one). Other examples of the coupler residue are the heterocyclic coupler residue which are disclosed in U.S. Pat. Nos. 4,315,070, 4,183,752, 4,174,969, 3,961,959 and 4,171,223, and JP-A-52-82423.

If A in the formula (I) is a redox group, this is a group that can be cross-oxidized by an oxidized form of a developing agent. Examples of the redox group are: hydroquinones, catechols, pyrogallols, 1,4-naphthohydroquinones, 1,2-naphthohydroquinones, sulfonamidephenols, hydrazines and sulfonamidenaphthols. These groups can be those disclosed in JP-A-61-230135, JP-A-62-251746, JP-A-61-278852, U.S. Pat. Nos. 3,364,022, 3,379,529, 3,639,417, 4,684,604, and J. Org. Chem., 29, 588 (1964).

The preferable examples of A are the coupler residues represented by the following formulas (Cp-1), (Cp-2), (Cp-3), (Cp-4), (Cp-5), (Cp-6), (Cp-7), (Cp-8), (Cp-8), (Cp-10), and (Cp-11). These couplers are preferable because their coupling rates are high.

formula (Cp-1)

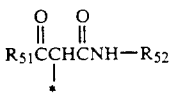

formula (Cp-2)

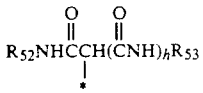

-continued formula (Cp-3)

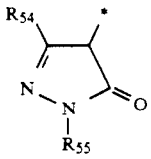

formula (Cp-4)

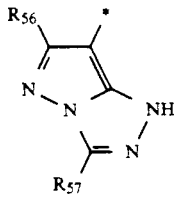

formula (Cp-5)

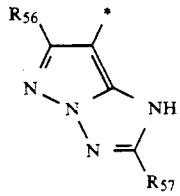

formula (Cp-6)

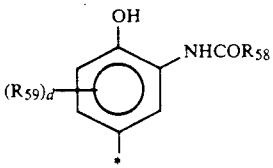

formula (Cp-7)

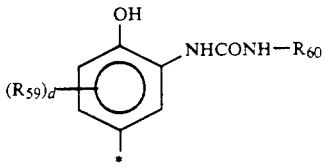

formula (Cp-8)

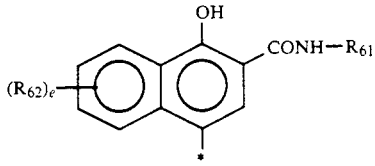

formula (Cp-9)

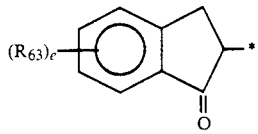

formula (Cp-10)

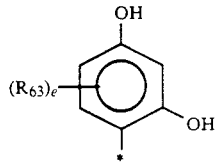

formula (Cp-11)

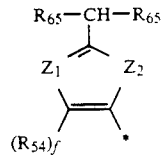

In the formulas (Cp-1) to (Cp-11), the mark * extending from the coupling position represents the position where bonding to $X_1$ takes place.

When, in the formulas (Cp-1) to (Cp-11), $R_{51}$, $R_{52}$, $R_{53}$, $R_{54}$, $R_{55}$, $R_{56}$, $R_{57}$, $R_{58}$, $R_{59}$, $R_{60}$, $R_{61}$, $R_{62}$, $R_{63}$, $R_{64}$, or $R_{65}$ comprises a nondiffusing group, the total carbon number thereof is 8 to 40, preferably 10 to 30 Otherwise, these groups should preferably have a total of 15 carbon atoms or less.

$R_{51}$ to $R_{65}$, h, d, e, and f, shown in the formulas (Cp-1) to (Cp-11), will be explained in detail. In the following explanation, $R_{41}$, $R_{42}$, $R_{43}$, $R_{44}$ and $R_{45}$ will be referred to. $R_{41}$ is an aliphatic group, an aromatic group or a heterocyclic group, and $R_{42}$ is an aromatic group or a heterocyclic group. $R_{43}$, $R_{44}$, and $R_{45}$ are hydrogen atoms, aliphatic groups, aromatic groups, or heterocyclic groups.

$R_{51}$ is equal to $R_{41}$, $R_{52}$ and $R_{53}$ are equal to $R_{42}$. The notation of "h" is 0 or 1. $R_{54}$ is equal to $R_{41}$ or is $R_{41}CON(R_{43})$— group, $R_{41}R_{43}N$— group, $R_{41}SO_2N(R_{43})$— group, $R_{41}S$— group, $R_{43}O$— group, $R_{45}N(R_{43})CON(R_{44})$— group, or NC— group. $R_{55}$ is equal to $R_{41}$. $R_{56}$ and $R_{57}$ are equal to $R_{43}$, or are $R_{41}S$— groups, $R_{43}O$— groups, $R_{41}CON(R_{43})$— groups, or $R_{41}SO_2N(R_{43})$— groups. $R_{58}$ is equal to $R_{41}$. $R_{59}$ is equal to $R_{41}$, or is $R_{41}CON(R_{43})$— group, $R_{41}O$-$CON(R_{43})$— group, $R_{41}SO_2N(R_{43})$— group, $R_{43}R_{44}NCON(R_{45})$— group, $R_{41}O$— group, $R_{41}S$— group, a halogen atom, or $R_{41}R_{43}N$— group. The notation of 'd" is an integer ranging from 0 to 3. If d is plural, the plural $R_{59}$ groups are substituents which are either the same or different, or can be divalent groups combining together, forming a ring such as pyridine ring or a pyrrole ring. $R_{60}$ and $R_{61}$ are equal to $R_{41}$ $R_{62}$ is equal to $R_{41}$, or is $R_{41}OCONH$— group, $R_{41}SO_2NH$— group, $R_{43}R_{44}NCON(R_{45})$— group, $R_{43}R_{44}NSO_2N(R_{45})$— group, $R_{43}O$— group, $R_{41}S$— group, a halogen atom, or $R_{41}R_{43}N$— group. $R_{63}$ is equal to $R_{41}$, or is $R_{43}CON(R_{45})$— group, $R_{43}R_{44}NCO$— group, $R_{41}SO_2N(R_{44})$— group, $R_{43}R_{44}NSO_2$— group, $R_{41}SO_2$— group, $R_{43}OCO$— group, $R_{43}O$—$SO_2$— group, a halogen atom, nitro, cyano, or $R_{43}CO$— group. The notation of "e" is an integer ranging from 0 to 4. When plural $R_{62}$ groups or plural $R_{63}$ groups are present, these plural groups are either the same or different. $R_{64}$ and $R_{65}$ are $R_{43}R_{44}NCO$— groups, $R_{41}CO$— groups, $R_{43}R_{44}NSO_2$— groups, $R_{410}CO$— groups, $R_4ISO_2$— groups, nitro, or cyano. $Z_1$ is nitrogen or $=C(R_{66})$— group, where $R_{66}$ is hydrogen or a group equal to $R_{63}$. $Z_2$ is sulfur or oxygen. The notation of "f" is either 0 or 1.

The aliphatic groups, mentioned above, are aliphatic hydrocarbon group which has 1 to 32 carbon atoms, preferably 1 to 22 carbon atoms, and are saturated or unsaturated, chain or cyclic, straight-chain or branched, and substituted or unsubstituted. Typical examples of the aliphatic groups are: methyl, ethyl, propyl, isopropyl, butyl, (t)-butyl, (i)-butyl, (t)-amino, hexyl, cyclohexyl, 2-ethylhexyl, octyl, 1,1,3,3-tetramethylbutyl, decyl, dodecyl, hexadecyl, or octadecyl.

The aromatic groups, also mentioned above, are those having 6 to 20 carbon atoms, preferably substituted or unsubstituted phenyl groups or substituted or unsubstituted naphthyl groups.

The heterocyclic groups, mentioned above, are preferably substituted or unsubstituted 3- to 8-membered heterocyclic groups, which have 1 to 20, more preferably 1 to 7 carbon atoms and at least one hetero-atom selected from nitrogen, oxygen or sulfur. Typical examples of the heterocyclic groups are: 2-pyridyl, 2-furyl, 2-imidazolyl, 1-indolyl, 2,4-dioxo-1,3-imidazolidine-5-il, 2-benzooxazolyl, 1,2,4-triazol-3-il or 4-pyrazolyl.

When the aliphatic hydrocarbon groups, the aromatic groups and the heterocyclic groups have a substituent or substituents, typical examples of the substituent are: a halogen atom, $R_{47}O$— group, $R_{46}S$— group, $R_{47}CON(R_{48})$-group, $R_{47}N(R_{48})CO$— group, $R_{460}CON(47)$-group, $R_{46}SO_2N(R_{47})$— group, $R_{47}R_{48}NSO_2$— group, $R_{46}SO_2$— group, $R_{47}OCO$— group, $R_{47}R_{48}NCON(R_{49})$— group, group of the same meaning a $R_{46}$, $R_{46}COO$— groups, $R_{47}OSO_2$— group, cyano, or nitro. $R_{46}$ is aliphatic group, aromatic group, or heterocyclic group. $R_{47}$, $R_{48}$, and $R_{49}$ are aliphatic group, aromatic group, heterocyclic group, or hydrogen. The aliphatic group, the aromatic group, and the heterocyclic group have the same meanings as defined above.

Preferable ranges for $R_{51}$ to $R_{65}$, h, d, e and f will be described.

Preferably, $R_{51}$ is an aliphatic group or an aromatic group, $R_{52}$ and $R_{55}$ are preferably aromatic groups, and $R_{53}$ is an aromatic group or a heterocyclic group.

In the formula (Cp-3), $R_{54}$ is preferably $R_{41}CONH$— group or $R_{41}R_{43}N$— group, $R_{56}$ and $R_{57}$ are desirably aliphatic groups, aromatic groups, $R_{41}O$— groups, or $R_{41}S$— groups, and $R_{58}$ is preferably an aliphatic group or an aromatic group. In the formula (Cp-6), $R_{59}$ is desirably chlorine, an aliphatic group, or $R_{41}CONH$-group, d is preferably 1 or 2, and $R_{60}$ is preferably an aromatic group. In the formula (Cp-7), $R_{59}$ is desirably $R_{41}CONH$-group, and d is preferably 1. In the formula (Cp-8), $R_{61}$ is desirably an aliphatic group or an aromatic group, e is preferably 0 or 1, $R_{62}$ is desirably $R_{41}OCONH$— group, $R_{41}CONH$— group or $R_{41}SO_2NH$-group, the location of which is preferably position 5 of the naphthol ring. In the formula (Cp-9), $R_{63}$ is preferably $R_{41}CONH$— group, $R_{41}SO_2NH$— group, $R_{41}R_{43}NSO_2$— group, $R_{41}SO_2$— group, $R_{41}R_{43}NCO$— group, nitro, or cyano, and e is preferably 1 or 2. In the formula (Cp-10), $R_{63}$ is desirably $(R_{43})2NCO$— group, $R_{43}OCO$— group or $R_{43}CO$— group, and e is preferably 1 or 2. In the formula (Cp-11), $R_{54}$ is better aliphatic group, aromatic group, or $R_{41}CONH$— group, and f is preferably 1.

In the formula (I), if $X_2$ is oxygen or sulfur, the group represented by $—X_1—W(=X_2)n_1$— can be: —OC(=O)—, —OC(=S)—, —SC(=O)—, —SC(=S)—, —OS(=O)—, —OS(=O)$_2$—, and —SS(=O )$_2$—. If $X_2$ is the group $=NX_6$, $X_6$ is hydrogen or a monovalent organic group. Desirable examples of this monovalent organic group are: an alkyl group (e.g., methyl, isopropyl, butyl, isobutyl, tert-butyl, sec-butyl, neopentyl, hexyl), an aryl group (e.g., phenyl), an acyl group (e.g., acetyl or benzoyl), a sulfonyl group (e.g., methanesulfonyl or benzenesulfonyl), a carbamoyl group (e.g., ethylcarbamoyl or phenylcarbamoyl), a sulfamoyl group (e.g., ethylsulfamoyl or phenylsulfamoyl), an alkoxycarbonyl group (e.g., ethoxycarbonyl or butoxycarbonyl), an aryloxycarbonyl group (e.g., phenoxycarbonyl or 4-methylphenoxycarbonyl), an alkoxysulonyl group (e.g., butoxysulfonyl or ethoxysulfonyl), an aryloxysulfonyl group (e.g., phenoxysulfonyl or 4-methoxypheonoxysulfonyl), cyano, nitro, nitroso, a thioacyl group (e.g., thioacetyl or thiobenzoyl), a thiocarbamoyl group (e.g., ethylthio carbamoyl), an imidoyl group (e.g., N-ethylimidoyl), an amino group (e.g., amino, dimethylamino, or methylamino), an acylamino group (e.g., formylamino, acetylamino, or N-methylacetylamino), an alkoxy group (e.g., methoxy or isopropyloxy), or an aryloxy group (e.g., phenoxy).

Any of the groups specified in the preceding paragraph can have a substituent, which is, for example, a group identified as $X_6$, a halogen atom (e.g., flouro, chloro, or bromo), carboxyl, or sulfo.

Preferably, $X_2$ in the formula (I) is oxygen or sulfur, and more preferably oxygen.

Desirable as the $-X_1-W(=X_2)n_1-$ group is $-CO(=O)-$, $-OS(=O)-$, or $-OC(=S)-$. Of these groups, $-OC(=O)-$ group is particularly preferred.

The case in which groups $X_3$, $X_4$, and $X_5$ are each hydrogen or a monovalent organic group will be explained. In the case where $X_3$ and $X_4$ are both monovalent organic groups, the organic group is desirably an alkyl group (e.g., methyl or ethyl) or an aryl group (e.g., phenyl). It is desirable that at least one of $X_3$ and $X_4$ be hydrogen. It is more preferable that both $X_3$ and $X_4$ be hydrogen.

$X_5$ is an organic group. Preferable examples of this organic group are: an alkyl group (e.g., methyl, isopropyl, butyl, isobutyl, tert-butyl, sec-butyl, neopentyl, or hexyl), an aryl group (e.g., phenyl), acyl group (e.g., acetyl or benzoyl), a sulfonyl group (e.g., methanesulfonyl or benzenesulfonyl), a carbamoyl group (e.g., ethylcarbamoyl or phenylcarbamoyl), a sulfamoyl group (e.g., ethylsulfamoyl or phenylsulfamoyl), an alkoxycarbonyl group (e.g., ethoxycarbonyl or butoxycarbonyl), an aryloxycarbonyl group (e.g., phenoxycarbonyl or 4-methylphenoxycarbonyl), an alkoxysulfonyl group (e.g., butoxysulfonyl or ethoxysulfonyl), an aryloxysul fonyl group (e.g., phenoxysulfonyl or 4-methoxyphenoxysulfonyl), cyano, nitro, nitroso, a thioacyl group (e.g., thioacetyl or thiobenzoyl), a thiocarbamoyl group (e.g., ethylthiocarbamoyl), an imidoyl group (e.g., N-ethylimidoyl), an amino group (e.g., amino, dimethylamino, or methylamino), an acylamino group (e.g., formylamino, acetylamino, or N-methylacetylamino), an alkoxy group (e.g., methoxy or isopropyloxy), or an aryloxy group (e.g., phenoxy).

Any of the groups specified in the preceding paragraph can have a substituent, which is, for example, a group identified as $X_5$, a halogen atom (e.g., fluoro, chloro, or bromo), carboxyl, or sulfo.

Preferably, $X_5$ in the formula (I) has 15 atoms or less, excluding the hydrogen atoms it has. It is more preferable that $X_5$ be a substituted or unsubstituted alkyl or aryl group. Particularly preferably, it is substituted or unsubstituted alkyl group.

The case wherein two of groups $X_3$, $X_4$ and $X_5$ are divalent groups and bond together, forming a ring, will be explained. The ring, thus formed, is preferably a 4- to 8-membered ring. More preferably, it is 4- to 6-membered ring. Desirable examples of the divalent groups are: $-C(=O)-N(X_7)-$, $-SO_2-N(X_7)-$, $-(CH_2)_3-$, $-(CH_2)_4-$, $-(CH_2)_5-$, $-C(=O)-(CH_2)_2-$, $-C(C=)-N(X_7)-C(=O)-$, $-SO_2-N(X_7)-C(=O)-$, $-C(=O)-C(X_7)(X_8)-$, and $-(CH_2)_2-O-CH_2-$.

Here, $X_7$ and $X_8$ are hydrogen or of the same meaning as $X_5$ representing a monovalent organic group. $X_7$ and $X_8$ can be either the same or different.

Of $X_3$, $X_4$, and $X_5$, that one which is not the bivalent group forming a ring mentioned above is hydrogen or a monovalent organic group. Specific examples of the monovalent organic group are equal to the above-mentioned examples of $X_3$, $X_4$, and $X_5$ which do not form a ring.

In the case where two of $X_3$, $X_4$, $X_5$ bond together, forming a ring, it is desirable that one of $X_3$ and $X_4$ is hydrogen and the other ($X_3$ or $X_4$) bonds with $X_5$, forming the ring. More preferably, the divalent groups have their left ends bonded to the nitrogen atom of the formula (I), and their right ends bonded to the carbon atom of the formula (I).

Preferably, groups $X_3$, $X_4$ and $X_5$ form no rings at all, and are each hydrogen or the monovalent organic group.

In the formula (I), $n_2$ is 1 or 2, preferably 1.

Also in the formula (I), the formula weight of the divalent group, $-X_1-W(=X_2)n_1-N(X_5)-C(X_3)(X_4)]-$, formed by removing two groups represented by A and PUG from the formula (I), is preferably 240 or less, more preferably 200 or less, still more preferably 180 or less.

The photographically useful group, represented by PUG in the formula (I), is for example a development inhibitor, a dye, a fogging agent, a developing agent, a coupler, a breaching accelerator, or a fixing accelerator. Preferable examples of the photographically useful group are the group disclosed in U.S. Pat. No. 4,248,962 (i.e., the group represented by general formula PUG in the patent specification), the dye disclosed in JP-A-62-49353 (i.e., the leaving group released from couplers), the development inhibitor described in U.S. Pat. No. 4,477,563, and the breaching accelerators disclosed in JP-A-61-201247 and JP-A-2-55 (i.e., the leaving group released from couplers). In the present invention, particularly preferable as photographically useful group is a development inhibitor.

Preferable examples of the development inhibitor are the groups represented by the following formulas (INH-1) to (INH-13):

(INH-1)

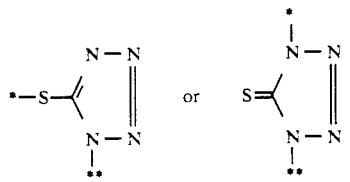

(INH-2)

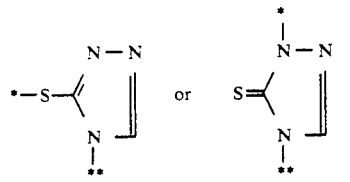

(INH-3)

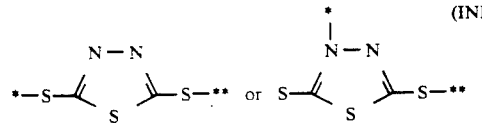

(INH-4)

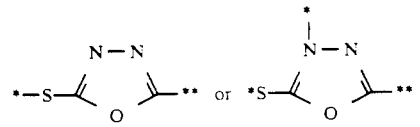

-continued (INH-5)

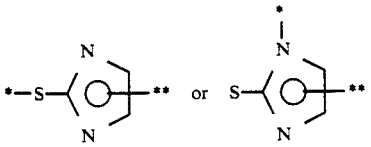

(INH-6)

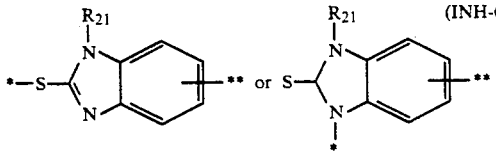

(where $R_{21}$ is hydrogen, or substituted or unsubstituted hydrocarbon group (e.g., methyl, ethyl, propyl or phenyl)).

(INH-7)

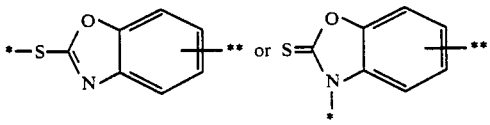

(INH-8)

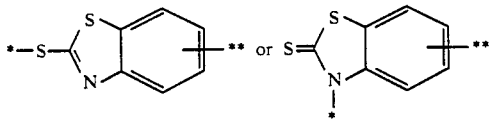

(INH-9)

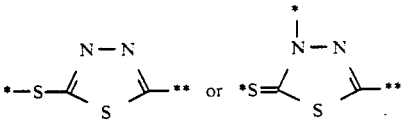

(INH-10)

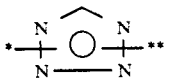

(INH-11)

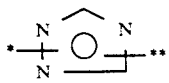

(INH-12)

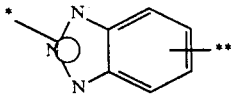

(INH-13)

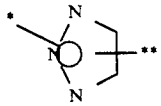

In the formulas (INH-1) to (INH-13), the mark * indicates the position where the development inhibitor bonds to the residue formed by removing PUG from the formula (I), and the mark ** indicates the position where the development inhibitor bonds to a substituent. Examples of the substituent can be, for example, an aliphatic group, an aryl group, or a heterocyclic group.

More specifically, examples of the aliphatic group are: an alkoxycarbonyl group (e.g., ethoxycarbonyl, 1,4-dioxo-2,5-dioxadecyl, 1,4-dioxo-2,5-dioxa-8-methylnonyl), an aryloxycarbonyl group (e.g., phenoxy carbonyl), an alkylthio group (e.g., methylthio or propylthio), an alkoxy group (e.g., methoxy or propyloxy), a sulfonyl group (e.g., methanesulfonyl), a carbamoyl group (e.g., ethylcarbamoyl), a sulfamoyl group (e.g., ethylsulfamoyl), cyano, nitro, an acylamino group (e.g., acetylamino), an alkyl group (e.g., methyl, ethyl, propyl, butyl, hexyl, decyl, isobutyl, t-butyl, 2-ethylhexyl, benzyl, 4-methoxybenzyl, phenethyl, propyloxycarbonylmethyl, 2-(propyloxycarbonyl) ethyl, butyloxycarbonylmethyl, pentyloxycarbonylmethyl, 2-cyanoethyloxycarbonylmethyl, 2,2-dichloroethyloxycarbonylmethyl, 3-nitropropyloxycarbonylmethyl, 4-nitrobenzyloxycarbonylmethyl, or 2,5-dioxo-3,6-dioxadecyl).

Specific examples of the aryl group are: phenyl, naphthyl, 4-methoxycarbonylphenyl, 4-ethoxycarbonylphenyl, 3-methoxycaronylphenyl, and 4-(2-cyanoethyloxycarbonyl)-phenyl.

Specific examples of the heterocyclic group are: 4-pyridyl, 3-pyridyl, 2-pyridyl, 2-furyl, and 2-tetrahydropyranyl.

Of these substituents, preferred are: the substituted or unsubstituted alkoxycarbonyl group, the substituted or unsubstituted aryloxycarbonyl group, the substituted or unsubstituted alkyl group, the substituted or unsubstituted aryl group. More preferably are an alkoxycarbonyl group having a substituent, an unsubstituted alkyl group having 2 to 7 carbon atoms, a substituted alkyl group having 2 to 10 carbon atoms, and a substituted or unsubstituted phenyl group.

Of the development inhibitors INH exemplified above as PUG, preferable are (INH-1), (INH-2), (INH-3), (INH-4), (INH-9) and (INH-12). Of these six inhibitors, (INH-1), (INH-2), (INH-3) are desirable in particular.

Specific examples (1) to (36) of the compounds used in the present invention and represented by the formula (I) are shown below. Nonetheless, the invention is not limited to the use of these specific examples.

(1)

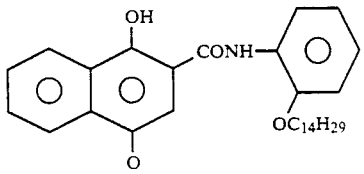

-continued
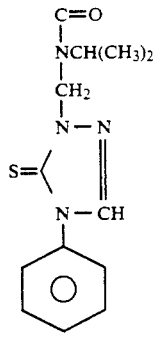
(2)
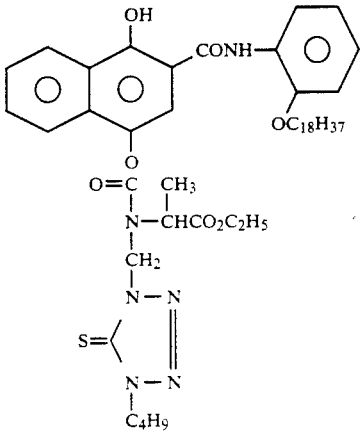
(3)
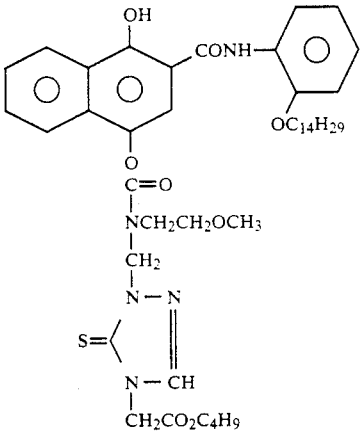
(4)
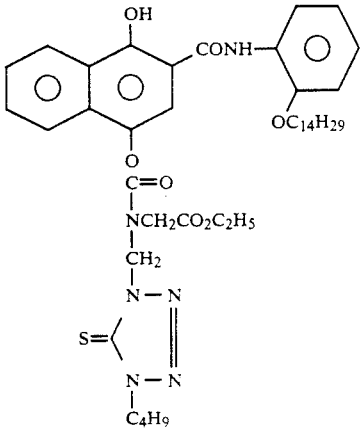

-continued
(5)
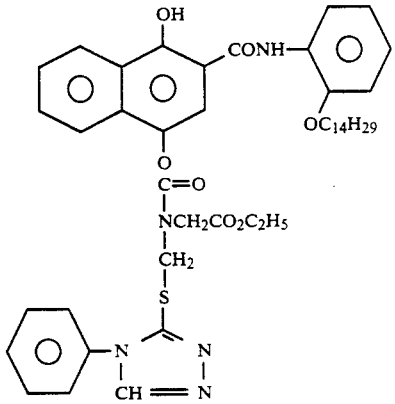
(6)
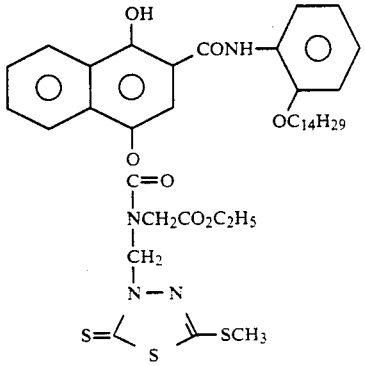
(7)
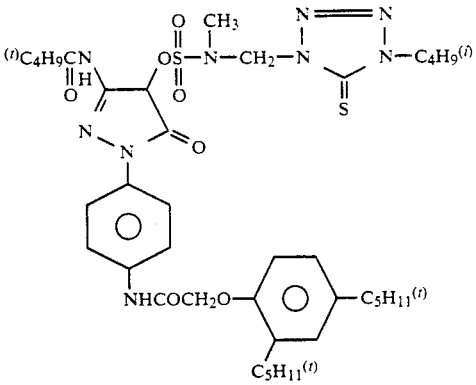
(8)
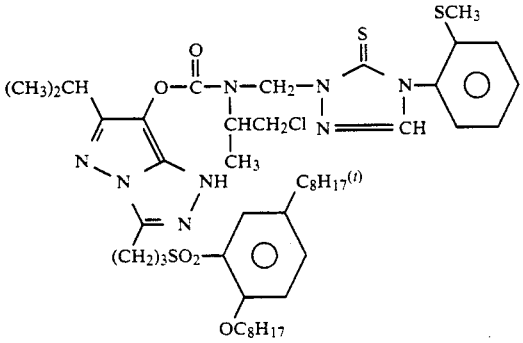

-continued
(9)
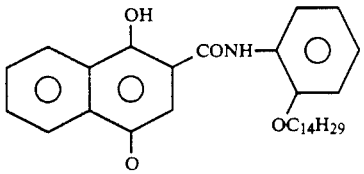
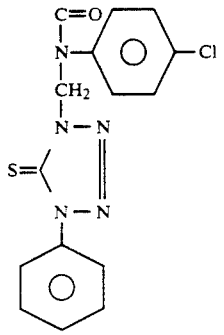
(10)
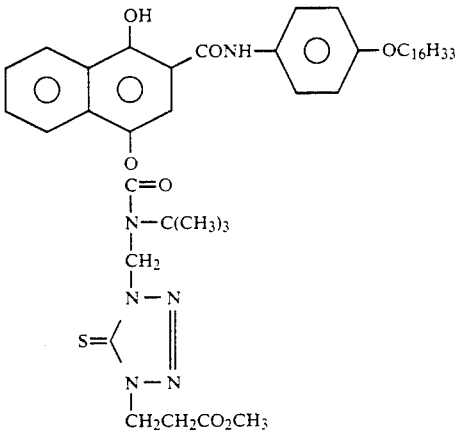
(11)
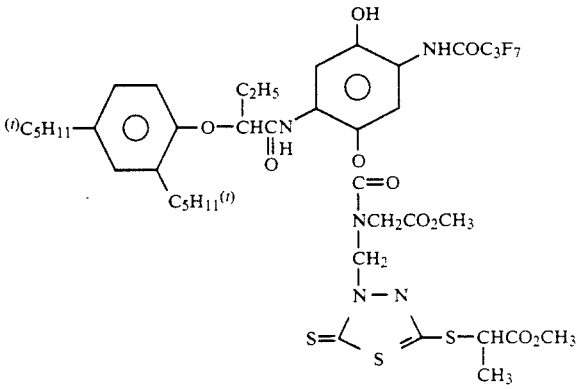

-continued
(12)
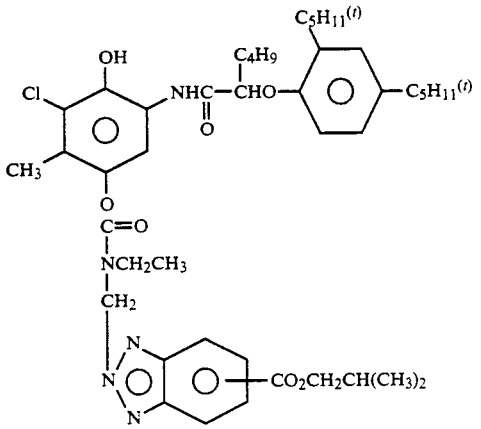
(13)
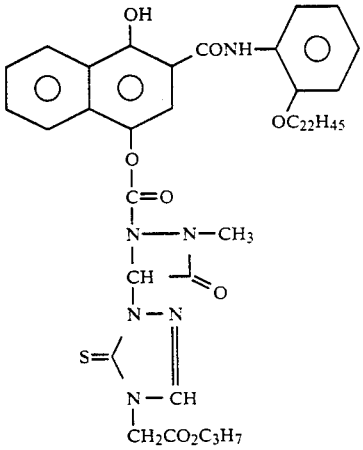
(14)
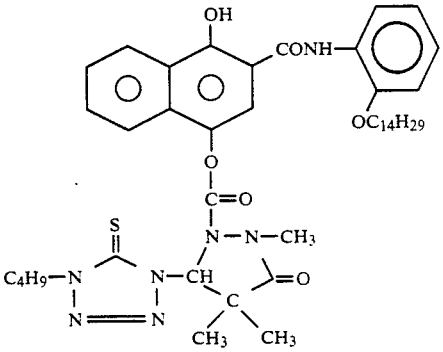

-continued
(15)
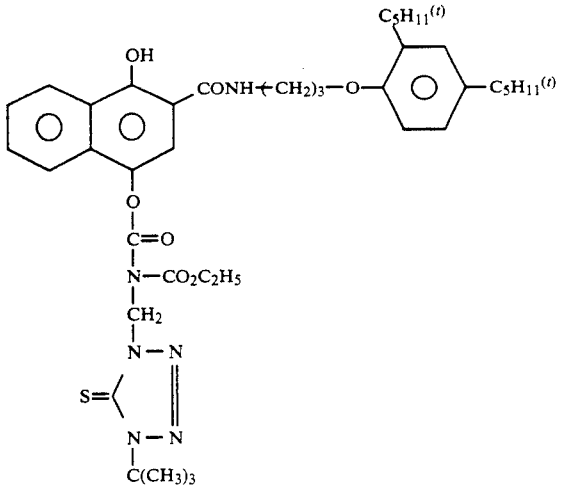
(16)
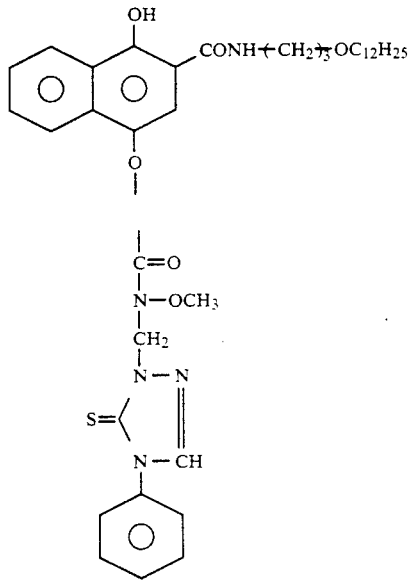
(17)
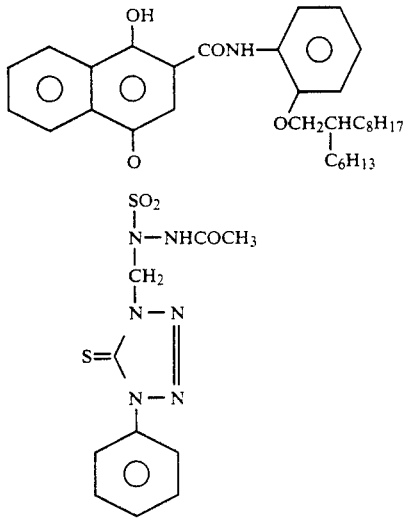

-continued
(18)
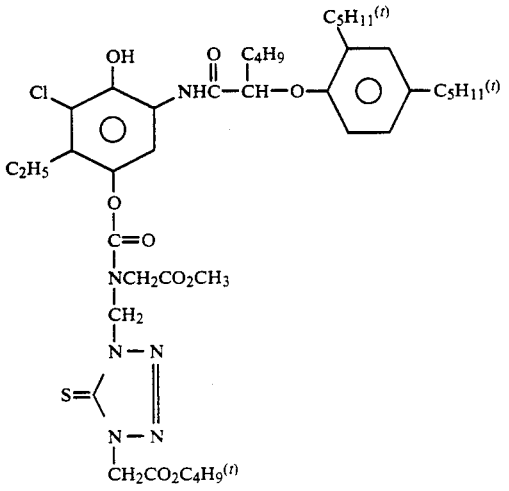
(19)
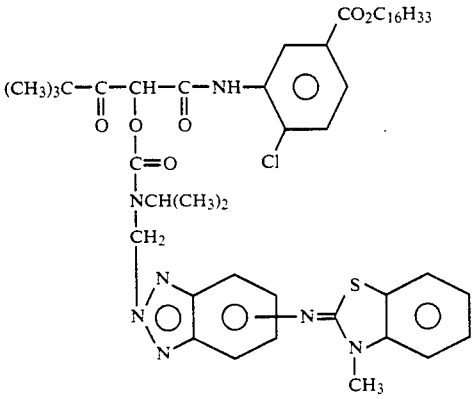
(20)
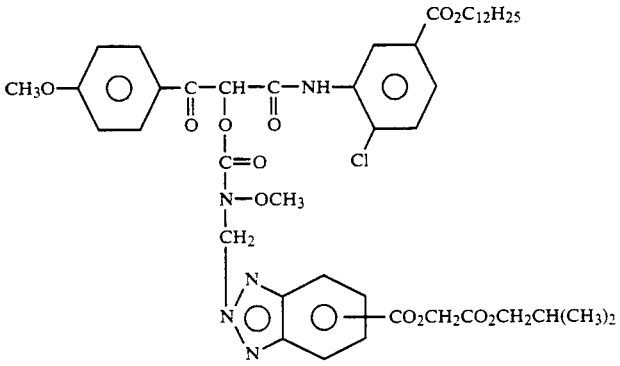

-continued
(21)
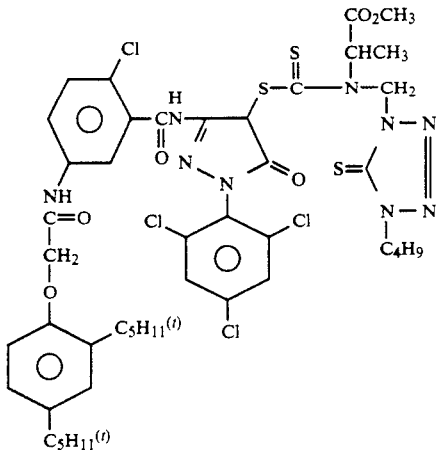
(22)
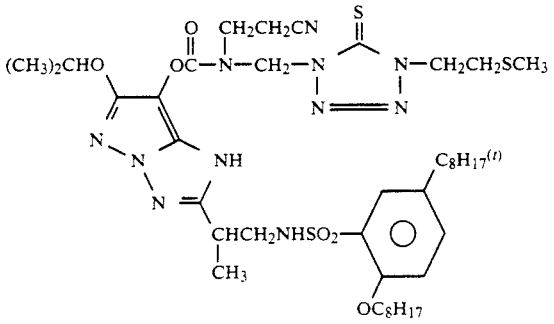
(23)
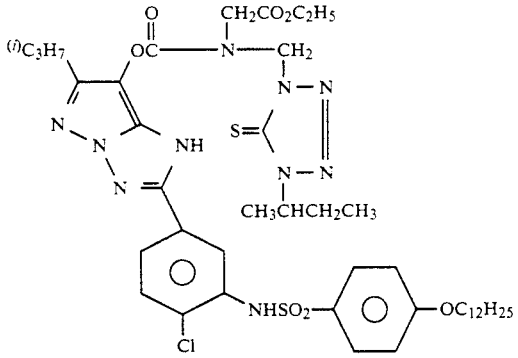
(24)
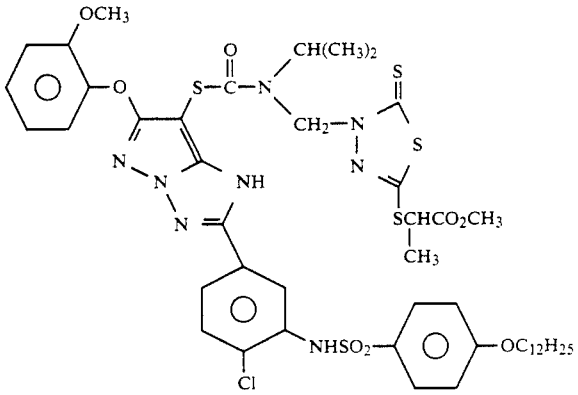

-continued
(25)
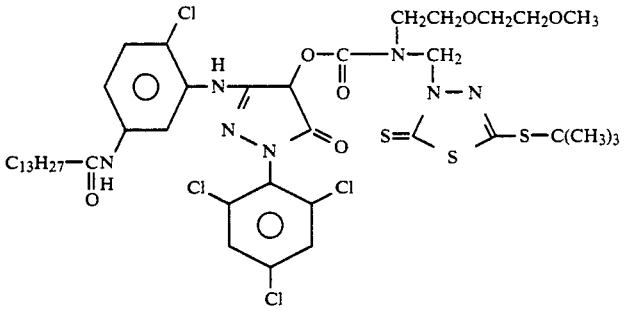
(26)
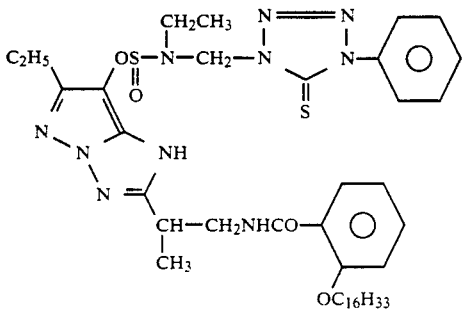
(27)
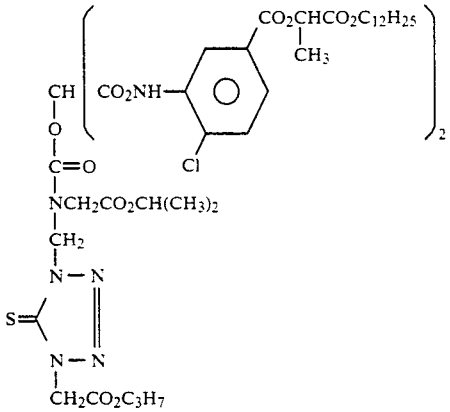
(28)
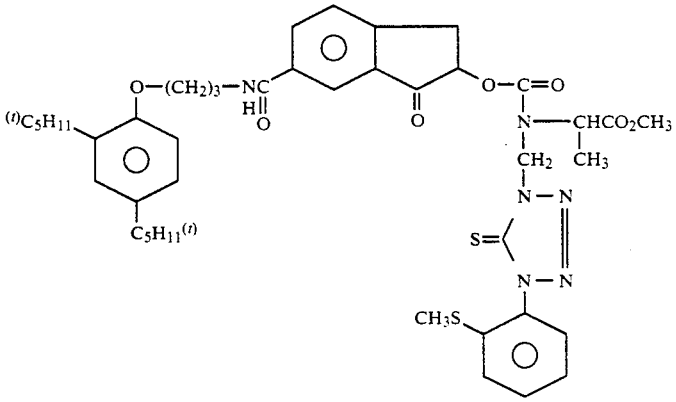

-continued
(29)
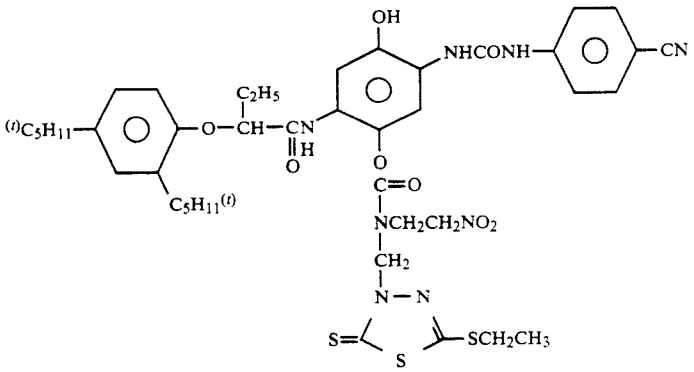
(30)
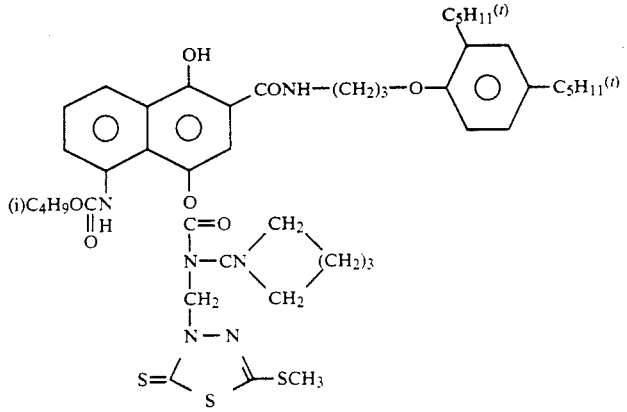
(31)
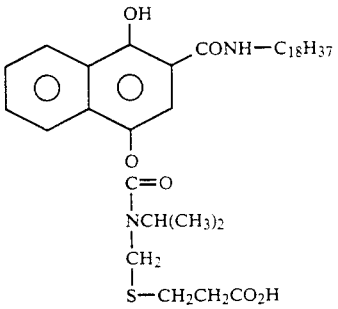
(32)
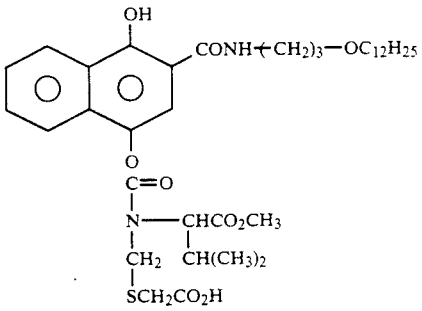
(33)
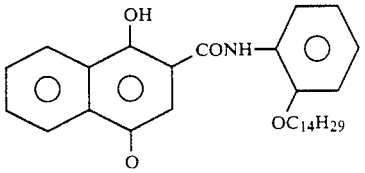

-continued
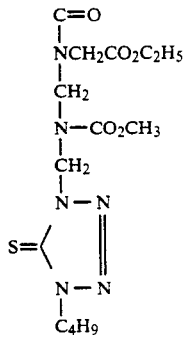
(34)
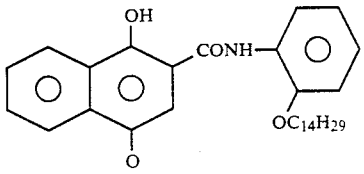
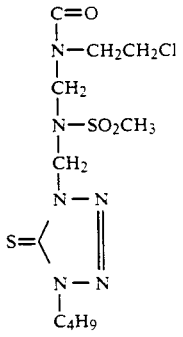
(35)
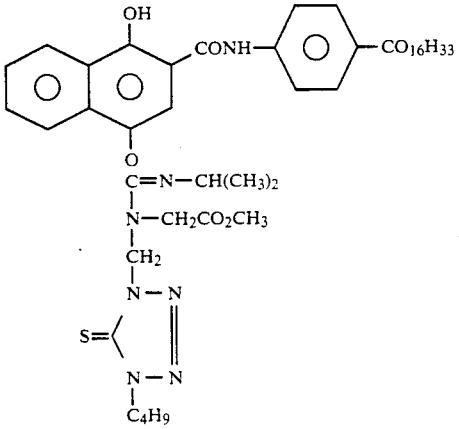

-continued (36)

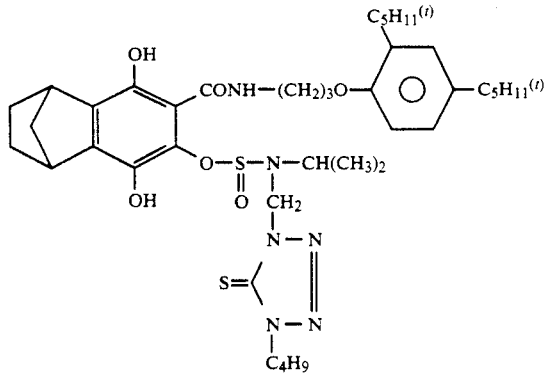

The compounds of the invention can be synthesized by various methods, including the method disclosed in JP-A-60-218645. The typical synthesis routes are shown in Scheme 1 and Scheme 2. In Scheme 1, the intermediate (I-5) is treated with thionyl chloride and then reacted with PUG in the presence of a base, thereby preparing a final product (Ia). Alternatively, the intermediate (I-5) is treated with thionyl chloride and then reacted with PUG in the presence of $ZnI_2$, thereby preparing a final product (Ia). The products (Ia) in these alternative processes may be in some cases not identical but may be isomers. For instance, when PUG is a development inhibitor, the intermediate can bond to sulfur or nitrogen, as may be understood from the formula of the inhibitor (INH-1), etc. Whichever isomer (Ia) can be prepared merely by selecting the desired alternative process of Scheme 1.

Scheme 1

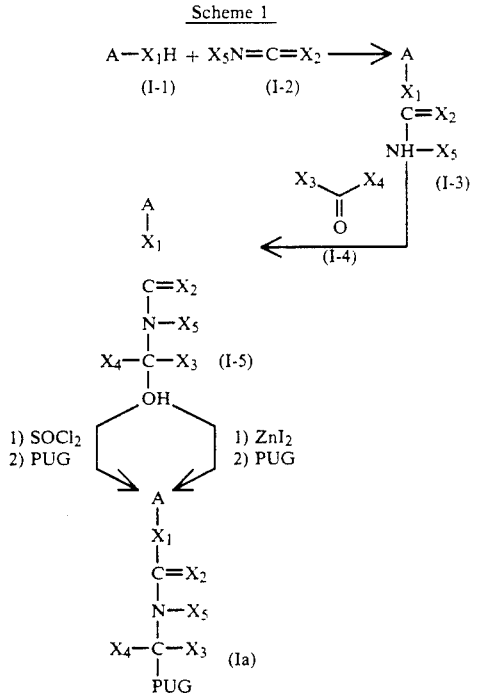

(A, $X_1$ to $X_5$, and PUG are of the same meaning as those in the formula (I)).

Scheme 2

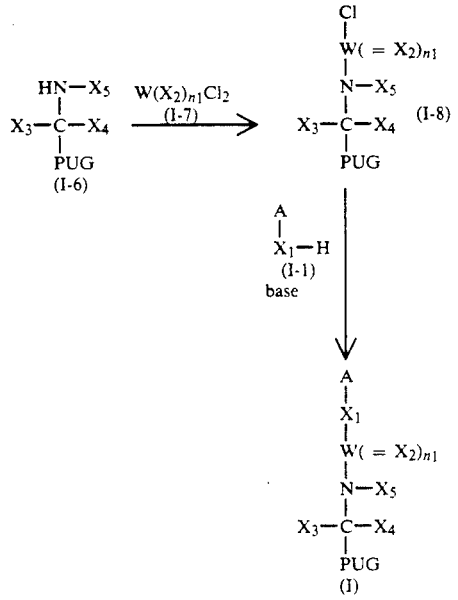

(A, $X_1$ to $X_5$, W, $n_1$ and PUG are of the same meaning as those in the formula (I)).

Various methods actually carried out for synthesizing the compounds according to the invention will now be described in detail.

Synthesis 1

Synthesis of Exemplified Compound (1)

The compound (1) was prepared in Synthesis Rout 1 illustrated as follows:

Synthesis route 1

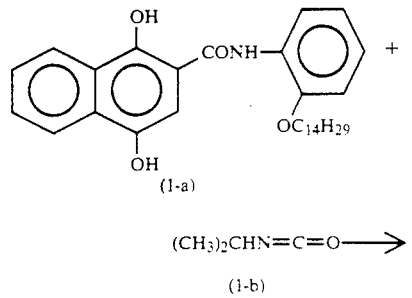

-continued

Synthesis route 1

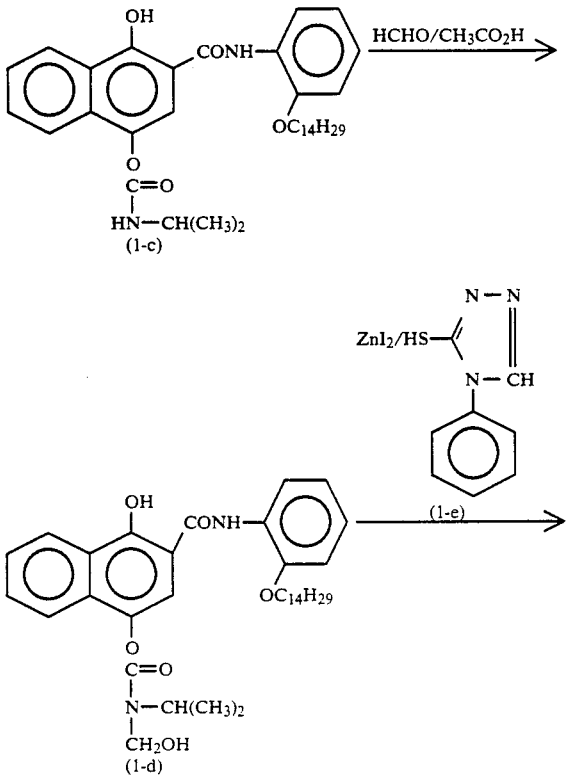

exemplified compound (1)

First, 200 g of (1-a) and 34.7 g of (1-b) were dissolved in 500 ml of ethyl acetate, thus forming a solution. Then, 142 ml of diisopropylethylamine was added to the solution, and the resultant mixture was stirred for 4 hours. The mixture was left to stand, whereby crystals were precipitated. The crystals were filtered out and washed with ethyl acetate. As a result, 176 g of (1-c) was obtained (yield: 75%).

Next, 53.6 g of (1-c) was reacted with paraformaldehyde (27.9 g) for 4 hours, in a mixture of 1,2-dichloroethane (500 ml) and acetic acid (54 ml) under refluxing, thus forming a reaction solution. This solution was cooled to room temperature, washed with water, dried over anhydrous sodium sulfate and condensed. The resultant residue was refined by means of silica gel column chromatography using chloroform as eluate. As a result, 23.2 g of (1-d) was obtained (yield: 41.2%).

Thereafter, 23.2 g of (1-d) and 6.78 g of (1-e) were dissolved in chloroform (250 ml), thus preparing a solution. Then, 26.88 g of zinc iodide was added to the solution, and the resultant mixture was stirred for 3 hours. 1N acetic acid was added to the mixture and then the reaction liquid was washed with water. The organic layer was dried and condensed with anhydrous sodium sulfate. The resultant residue was refined by means of silica gel column chromatography (the ethyl acetate-hexane ratio being 1:4). As a result, the exemplified compound (1) was obtained in the amount of 7.0 g (yield: 23.9%). This compound exhibited a melting point of 117.0° to 118.5° C.

Synthesis 2

Synthesis of Exemplified Compound (4)

The compound (4) was synthesized in the same way as in Synthesis 1. The compound (4), thus prepared, exhibited a melting point of 61.5° to 63.0° C.

Synthesis 3

Synthesis Exemplified of Compound (5)

The compound (5) was synthesized in the same way as in Synthesis 1. The compound (5), thus prepared, had a melting point of 95.5° to 96.5° C.

Synthesis 4

Synthesis of Exemplified Compound (6)

The compound (6) was synthesized in the same way as in Synthesis 1. The compound (6) had a melting point of 63.5° to 66.0° C.

Synthesis 5

Synthesis of Exemplified Compound (9)

The compound (9) was synthesized in the same way as in Synthesis 1. The compound (9), thus prepared, exhibited a melting point of 146.0° to 148.0° C.

The compound represented by the formula (I) can be added to any one of the layers forming the light-sensitive material. Nonetheless, it is desirable that the compound be added to a light-sensitive silver halide emulsion layer and/or a layer adjacent to the silver halide emulsion layer, more preferably to a red-sensitive emulsion layer. The compound is added to the light sensitive material in an amount of $1\times10^{-7}$ to $6\times10^{-4}$ mol/m$^2$, preferably $1\times10^{-6}$ to $3\times10^{-4}$ mol/m$^2$, and more preferably $5\times10^{-6}$ to $1\times10^{-4}$ mol/m$^2$.

The yellow-colored cyan coupler used in this invention will now be described.

The term "yellow-colored cyan coupler," used here, means a cyan coupler which has the absorption maximum in the visible absorption region in the range of 400 nm to 500 nm, and which is coupled to the oxidized form of an aromatic primary amine developing agent, thereby forming a cyan dye which has the absorption maximum in the visible absorption region in the range of 630 nm to 750 nm.

Various yellow-colored cyan couplers can be used in the present invention. Of these couplers, preferable are those which can release a compound residue containing water-soluble 6-hydroxy-2-pyridon-5-ylaoo group, water-soluble 5-pyrazolon-4-ylazo group, water-soluble 5-amino-pyrazol-4-ylazo group, water-soluble 2-acylaminophenylazo group, or water-soluble 2-sulfoneamidephenylazo group, by the coupling reaction with the oxidized form of an aromatic primary amine developing agent.

Yellow-colored cyan couplers, which can be preferably used in the invention, are represented by formulas (CI) to (CIV) shown below:

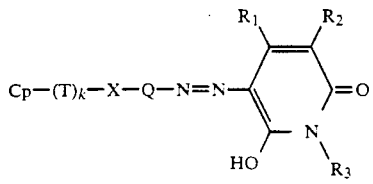

formula (CI)

-continued

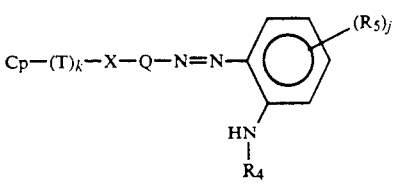

formula (CII)

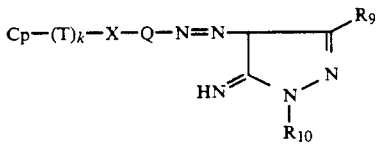

formula (CIII)

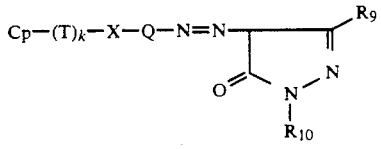

formula (CIV)

In the formulas (CI) to (CIV), Cp is a cyan coupler residue (with T bonded to the coupling position of the residue), T is a timing group, k is 0 or 1, X is a divalent linking group containing N, 0 or S through which it is bonded to $(T)_k$, and bonding to Q, and Q is an arylene group or a divalent heterocyclic group.

In the formula (CI), $R_1$ and $R_2$ are independently hydrogen, carboxyl, sulfo, cyano, an alkyl group, a cycloalkyl group, an aryl group, a heterocyclic group, carbamoyl, sulfamoyl, carbonamide, sulfonamide, or an alkylsulfonyl group, $R_3$ is hydrogen, an alkyl group, a cycloalkyl group, an aryl group or a heterocyclic group. At least one of T, X, Q, $R_1$, $R_2$, and $R_3$ is a water-soluble group (e.g., hydroxyl, carboxyl, sulfo, amino, ammoniumyl, phosphno, phosphino, or hydroxylsulfonyloxy).

As is generally known in the art, the group shown in the formula (CI) and represented by the following formula

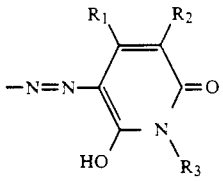

can be the tautomers (R-1) to (R-7).

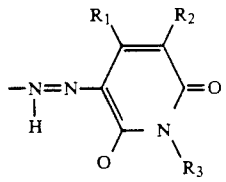

(R-1)

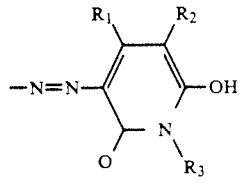

(R-2)

-continued

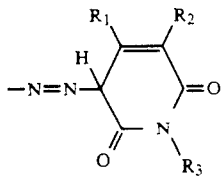

(R-3)

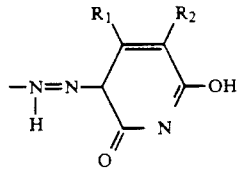

(R-4)

($R_3$ is hydrogen)

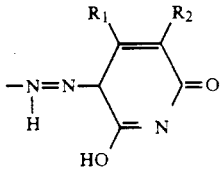

(R-5)

($R_3$ is hydrogen)

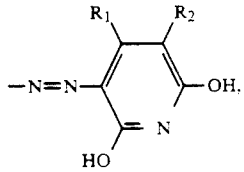

(R-6)

($R_3$ is hydrogen)

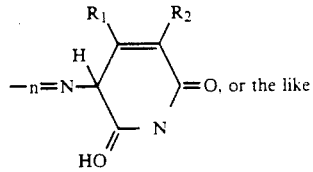

(R-7)

The structures of these tautomers are each contained in the structure defined by the formula (CI).

In the formula (CII), $R_4$ is an acyl group or sulfonyl, $R_5$ is a substitutable group, and j is an integer ranging from 0 to 4. If j is 2 or more, $R_4$'s can be either the same or different. However, at least one of T, X, Q, $R_4$ and $R_5$ is a water-soluble group (e.g., hydroxyl, carboxyl, sulfo, phosphono, phosphino, hydroxysufonyloxy, amino, or ammoniumyl).

In the formulas (CIII) and (CIV), $R_9$ is hydrogen, carboxyl, sulfo, cyano, an alkyl group, a cycloalkyl group, an aryl group, an alkoxy group, a cycloalkyloxy group, an aryloxy group, a heterocyclic group, carbamoyl, sulfamoyl, carbonamide, sulfonamide or an alkylsulfonyl, $R_{10}$ is hydrogen, an alkyl group, a cycloalkyl group, an aryl group or a heterocyclic group. However, at least one of T, X, Q, $R_9$ and $R_{10}$ is a water-soluble group (e.g., hydroxyl, carboxyl, sulfo, phosphono, phosphino, hydroxysulfonyloxy, amino, or ammoniumyl). The two groups, identified by the following formulas, are tautomers to each other.

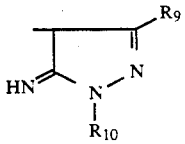

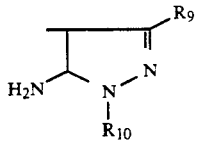

The compounds represented by the formulas (CI) to (CIV) will be described in greater detail.

Examples of the coupler residue Cp are known cyan couplers (e.g., a phenol-type one and a naphthol-type one). Preferable examples of Cp are coupler residues which are identified by the formulas (Cp-6), (Cp-7) and (Cp-8).

In the description which follows, $R_{41}$ is an aliphatic group, an aromatic group or a heterocyclic group, and $R_{42}$ is an aromatic group or a heterocyclic group, $R_{43}$, $R_{44}$, and $R_4S$ are hydrogen, aliphatic groups, aromatic groups, or heterocyclic groups, as has been stated earlier.

The timing group, represented by T, is a group which is cleaved from X after it has cleaved from the coupler residue Cp by the coupling reaction of the coupler and the oxidized form of an aromatic primary amine developing agent. The timing group is, for example, used to control the coupling reaction, to stabilize the coupler, and to adjust the timing of releasing X et seq. Examples of the timing group are those represented by the following formulas (T-1) to (T-7)—all known in the art.

In each of the formulas (T-1) to (T-7), mark * is the position where the timing group bonds to the coupler residue Cp, and ** is the position where the timing group bonds to X or Q.

(T-1)

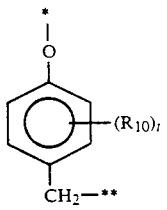

(T-2)

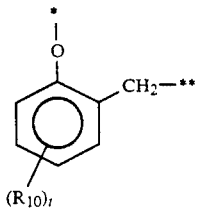

(T-3)

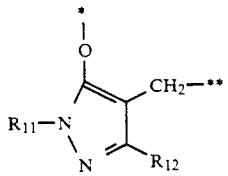

-continued (T-4)

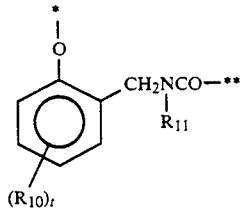

(T-5)

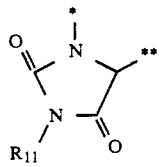

*—$OCH_2$—* (T-6)

(T-7)

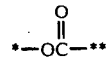

In the formulas (T-1) to (T-7), $R_{10}$ is a group which can be substituted for benzene ring, $R_{11}$ is equal to $R_{41}$, $R_{12}$ is hydrogen or a substituent, and t is an integer ranging from 0 to 4. A substituent for $R_{10}$ and $R_{12}$ is $R_{41}$, a halogen atom, $R_{43}O$—, $R_{43}S$—, $R_{43}(R_{44})NCO$—, $R_{43}OOC$—, $R_{43}SO_2$—, $R_{43}(R_{44})NSO_2$—, $R_{43}CON(R_{43})$—, $R_{41}SO_2N(R_{43})$—, —$R_{43}CO$—, $R_{41}COO$—, $R_{41}SO$—, nitro, $R_{43}(R_{44})NCON(R_{45})$—, cyano, $R_{41}OCON(R_{43})$—, $R_{43}OSO_2$—$R_{43}(R_{44})N$—, $R_{43}(R_{44})NSO_2N(R_{45})$—, or a group represented by the following formula.

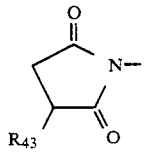

In the formulas (CI) to (CIV), k is 0 or 1. Preferably, k is 0, whereby Cp and X are bonded together directly.

Also in the formulas (CI) to (CIV), X is a divalent linking group which bonds to, Cp-(T)k at N, O or S. Preferable examples of X are: —O—; —S—; —OCO—; —OCOO—; —OCOS—; —OCONH—; —$OSO_2$—; —$OSO_2NH$—; a heterocyclic group which can bond to Cp-(T)k at N (e.g., a group derived from pyrrolidine, piperidine, morpholine, piperazine, pyrrole, pyrazole, imidazole, 1,2,4-triazole, benzotriazole, succinimide, phthalimide, oxazolidine-2,4-dion, imdzolidine-2,4-dion, 1,2,4-triazolidine-3,5-dion); and a linking group formed by combining one or more of these groups with, for example, an alkylene group (e.g., methylene, ethylene or propylene), a cycloalkylene group (e.g., 1,4-cyclohexylene), an arylene group (e.g., o-phenylene or p-phenylene), a divalent heterocylclic group (e.g., a group derived from piridine or thiophene), —CO—, —$SO_2$—, —COO—, —CONH—, $SO_2NH$—, —$SO_2O$—, —NHCO—, —$NHSO_2$—, —NHCONH—, —$NHSO_2NH$— or —NHCOO—. Prefereably, X is a linking group which is identified by the following formula (II):

*—$X_1$—(L—$X_2$)$_m$—** wherein * is the position where the linking group bonds to Cp—$(T)_k$—, ** is the position where the linking group bonds to Q, and $X_1$ is —O— or —S—, L is an alkylene group, $X_2$ is a single bond, —O—, —S—, —CO—, —$SO_2$, —OCO—, —COO—, —NHCO—, —CONH—, $SO_2NH$—, $NHSO_2$—, —$SO_2O$—, —$OSO_2$—, —OCOO—, —OCONH—, —NHCOO—, —NHCONH—, —$NHSO_2NH$—, —OCOS—, —SCOO—, —$OSO_2NH$— or —$NHSO_2O$—, and m is an integer of 0 to 3. Total number of carbon atoms of X (hereinafter referred to as "C number") is preferably 0 to 12, more preferably 0 to 8. The most desirable as X is —$OCH_2CH_2O$—.

Q is an arylene group or a divalent heterocyclic group. If Q is an arylene group, it can be condensed ring or can have a substituent (e.g., halogen atom, hydroxyl, carboxyl, sulfo, nitro, cyano, amino, ammonium, phosphono, phosphino, alkyl, cycloalkyl, aryl, carbonamide, sulfonamino, alkoxy, aryloxy, acyl, sulfonyl, carboxyl, carbamoyl, or sulfamoyl), and C number is preferably 6 to 15, more preferably 6 to 10. If Q is a divalent heterocyclic group, it can be a 3- to 8-membered, preferably 5- to 7-membered, monocyclic or condensed ring heterocyclic group containing at least one hetero atom selected from the group consisting of N, O, S, P, Se and Te (e.g., a group derived from pyridine, thiophene, furan, pyrrole, pyrazole, imidazole, thiazole, oxazole, benzothiazole, benzooxazole, benzofuran, benzothiophene, 1,3,4-thiazole, indole, quinoline), it can have a substituent as described with reference to Q representing the arylene group, and its C number is preferably 2 to 15, more preferably 2 to 10. The most desirable as Q is 1,4-phenylene.

Hence, the most preferable as —$(T)_k$—X—Q— in the present invention is —$OCH_2CH_2$—O—(1,4-phenylene)—.

If $R_1$, $R_2$ or $R_3$ is an alkyl group, it can be either a straight chain or a branched chain, can contain an unsaturated bond, and can have a substituent (e.g., halogen atom, hydroxyl, carboxyl, sulfo, phosphono, phosphino, cyano, alkoxy, aryl, alkoxycarbonyl, amino, ammoniumyl, acyl, carbonamide, sulfonamide, carbamoyl, sulfamoyl, or sulfonyl).

If $R_1$, $R_2$ or $R_3$ is a cycloalkyl group, it can be a 3- to 8-membered one which may have a crosslinking group, an unsaturated bond, or a substituent identical to any substituent which $R_1$, $R_2$ or $R_3$ can have if it is an alkyl group.

If $R_1$, $R_2$ or $R_3$ is an aryl group, it can be a condensed ring or can have a substituent (e.g., alkyl, cycloalkyl, or any substituent which $R_1$, $R_2$ or $R_3$ can have if it is alkyl group).

If $R_1$, $R_2$ or $R_3$ is a heterocyclic group, it can be a 3- to 8-membered, preferably 5- to 7-membered monocylic or condensed ring heterocyclic group containing at least one hetero atom selected from the group consisting of N, O, S, P, Se and Te (e.g., imidazolyl, thienyl, pyrazolyl, thiazolyl, pyridyl, quinolinyl) and can have a substituent equal to any substituent which $R_1$, $R_2$ or $R_3$ can have if it is an aryl group.

The carboxyl group, the sulfo group, the phosphino group, and phosphono group can contain carboxylato group, sulfonato group, phosphinato group, and phosphonato group, respectively. In this case, the counter ion is, for example $Li^+$, $Na^+$, $K^+$, or ammonium.

Preferably, $R_1$ is hydrogen, carboxyl, an alkyl group having C number of 1 to 10 (e.g., methyl, t-butyl, carbomethyl, 2-sulfomethyl, carboxymethyl, 2-carboxymethyl, 2-hydroxymethyl, benzyl, ethyl, isopropyl), or an aryl group having C number of 6 to 12 (e.g., phenyl, 4-methoxyphenyl, 4-sulfophenyl). Particularly preferable as $R_1$ is hydrogen, methyl, or carboxyl.

Preferably, $R_2$ is cyano, carboxyl, carbamoyl having C number of 1 to 10, sulfamoyl having C number of 0 to 10, sulfo, an alkyl group having C number of 1 to 10 (e.g., methyl or sulfomethyl), sulfonyl having C number of 1 to 10 (e.g., methylsulfonyl or phenylsulfonyl), carbonamide having C number of 1 to 10 (e.g., acetoamide or benzamide), or sulfonamide having C number of 1 to 10 (e.g., methanesulfonamide or toluenesulfonamide). Particularly desirable are cyano, carbamoyl, or carboxyl.

Preferably $R_3$ is hydrogen, an alkyl group having C number of 1 to 12 (e.g., methyl, sulfomethyl, carboxymethyl, 2-sulfomethyl, 2-carboxymethyl, ethyl, n-butyl, benzyl, or 4-sulfonbenzyl), or an aryl group having C number of 6 to 15 (e.g., phenyl, 4-carboxyphenyl, 3-carboxyphenyl, 4-methoxyphenyl, 2,4-dicarboxyphenyl, 2-sulfophenyl, 3-sulfophenyl, 4-sulfophenyl, 2,4-disulfophenyl, or 2,5-disulfophenyl). More preferably, $R_3$ is an alkyl group having C number of 1 to 7 or an aryl group having C number of 6 to 10.

$R_4$ is an acyl group represented by the following formula (III) or sulfonyl represented by the following formula (IV):

$R_{11}CO$—

$R_{11}SO_2$— where $R_{11}$ an alkyl group, a cycloalkyl group, an arylgroup, or a heterocyclic group.

If $R_{11}$is an alkyl group, it can be either a straight chain or a branched chain, can contain an unsaturated bond, and can have a substituent (e.g., halogen atom, hydroxyl, carboxyl, sulfo, phosphono, phosphino, cyano, alkoxy, aryl, alkoxycarbonyl, amino, ammoniumyl, acyl, carbonamide, sulfonamide, carbamoyl, sulfamoyl, or sulfonyl).

If $R_{11}$ is a cycloalkyl group, it can be a 3- to 8-membered one which may have a cross linking group, an unsaturated bond, or a substituent equal to any substituent which $R_{11}$ can have if it is alkyl group.

If $R_{11}$ is an aryl group, it can be a condensed ring or can have a substituent (e.g., alkyl, cycloalkyl, or any substituent which $R_{11}$ can have if it is an alkyl group).

If $R_{11}$ is a heterocyclic group, it can be a 3- to 8-membered, preferably 5- to 7-membered monocylic or condensed ring heterocyclic group containing at least one hetero atom selected from the group consisting of N, O, S, P, Se and Te (e.g., imidazolyl, thienyl, pyrazolyl, thiazolyl, pyridyl, quinolinyl) and can have a substituent equal to any substituent which $R_{11}$ can have if it is aryl group.

Here, the carboxyl group, the sulfo group, the phosphino group, and phosphono group can contain carboxylato group, sulfonato group, phosphinato group, and phosphonato group, respectively. In this case, the counter ion is, for example, $Li^+$, $Na^+$, $K^+$, or ammonium.

Preferably, $R_{11}$ is an alkyl group having C number of 1 to 10 (e.g., methyl, carboxymethyl, sulfoethyl, or cyanoethyl), a cycloalkyl group having C number of 5 to 8 (e.g., cyclohexyl or 2-carboxycyclohexyl), or an aryl group having C number of 6 to 10 (e.g., phenyl, 1-naphthyl, or 4-sulfophenyl). More preferably, $R_{11}$ is an alkyl group having C number of 1 to 3 or an aryl group having C number of 6.

$R_5$ is a group that can be substituted. Preferably, it is an electron-donating group. More preferably, it is $—NR_{12}R_{13}$ or $—OR_{14}$. The position, where $R_5$ is substituted, is preferably 4-position. $R_{12}$, $R_{13}$ and $R_{14}$ are hydrogen, an alkyl group, a cycloalkyl group, an aryl group or a heterocyclic group. $R_{12}$ and $R_{13}$ can form a ring, including a nitrogen-containing hetero cyclic ring which is preferably an aliphatic ring.

The notation j is an integer of 0 to 4, preferably 1 or 2, and more preferably 1.

$R_9$ and $R_{10}$ are alkyl groups, cycloalkyl groups, aryl groups, or heterocyclic groups.

If $R_9$ and $R_{10}$ are alkyl groups, they can be either a straight chain or a branched chain, can contain an unsaturated bond, and can have a substituent (e.g., halogen atom, hydroxyl, carboxyl, sulfo, phosphono, phosphino, cyano, alkoxy, aryl, alkoxycarbonyl, amino, ammoniumuyl, acyl, carbonamide, sulfonamide, carbamoyl, sulfamoyl, or sulfonyl).

If $R_9$ and $R_{10}$ are cycloalkyl groups, they can be a 3- to 8-membered one which may have a crosslinking group, an unsaturated bond, or a substituent equal to any substituent which $R_9$ or $R_{10}$ can have if they are an alkyl group.

If $R_9$ and $R_{10}$ are aryl groups, they can be a condensed ring or can have a substituent (e.g., alkyl, cycloalkyl, or any substituent which $R_9$ or $R_{10}$ can have if they are alkyl group).

If $R_9$ and $R_{10}$ are heterocyclic groups, they can be a 3- to 8-membered, preferably 5- to 7-membered monocyclic or condensed ring heterocyclic group containing at least one hetero atom selected from the group consisting of N, O, S, P, Se and Te (e.g., imidazolyl, thienyl, pyrazolyl, thiazolyl, pyridyl, quinolinyl) and can have a substituent equal to any substituent which $R_9$ or $R_{10}$ can have if they are aryl group.

Here, the carboxyl group, the sulfo group, the phosphino group, and phosphono group can contain carboxylato group, sulfonato group, phosphinato group, and phosphonato group, respectively. In this case, the counter ion is, for example, $Li^+$, $Na^+$, $K^+$, or ammonium.

Preferably, $R_9$ is cyano, carboxyl, a carbamoyl group having C number of 1 to 10, an alkoxycarbonyl group having C number of 2 to 10, an aryloxycarbonyl group having C number of 7 to 11, a sulfamoyl group having C number of 0 to 10, sulfo group, an alkyl group having C number of 1 to 10 (e.g, methyl, carboxymethyl, or sulfomethyl), a sulfonyl group having C number of 1 to 10 (e.g., methylsulfonyl or phenylsulfonyl), an carbonamide group having C number of 1 to 10 (e.g., acetoamide or benzamide), an sulfonamide group having C number of 1 to 10 (e.g., methanesulfonamide or toluenesulfonamide), an alkyloxy group (e.g., methoxy or ethoxy), or an aryloxy group (e.g., phenoxy). Particularly prefer able as $R_9$ is cyano, carbamoyl, an alkoxycarbonyl group, or carboxyl group.

Preferably $R_{10}$ is hydrogen, an alkyl group having C number of 1 to 12 (e.g., methyl, sulfomethyl, carboxymethyl, ethyl, 2-sulfoethyl, 2-carboxyethyl, 3-sulfopropyl, 3-carobxypropyl, 5-sulfopentyl, 5-carboxy pentyl, or 4-sulfobenzyl) or an aryl group having C number of 6 to 15 (e.g., phenyl, 4-carboxyphenyl, 3-carboxyphenyl, 2,4-dicarboxyphenyl, 4-sulfophenyl, 3-sulfophenyl, 2,5-disulfophenyl, or 2,4-disulfophenyl). More preferably, $R_{10}$ is an alkyl group having C number of 1 to 7 or an aryl group having C number of 6 to 10.

Specific examples of the yellow-colored cyan coupler used in the present invention are couplers (YC-1) to (YC-55) which are represented by the following formulas. Nonetheless, the yellow-colored cyan coupler is not limited to these examples.

(YC-1)

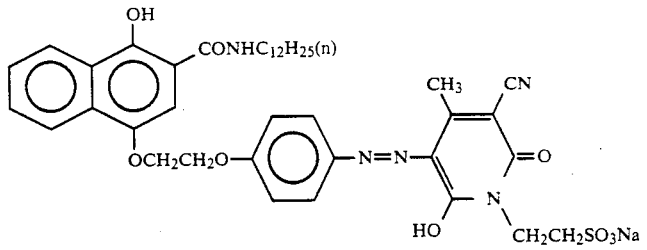

(YC-2)

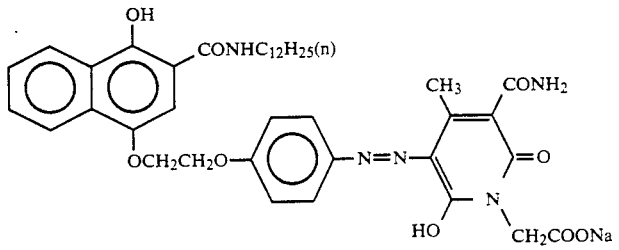

-continued
(YC-3)
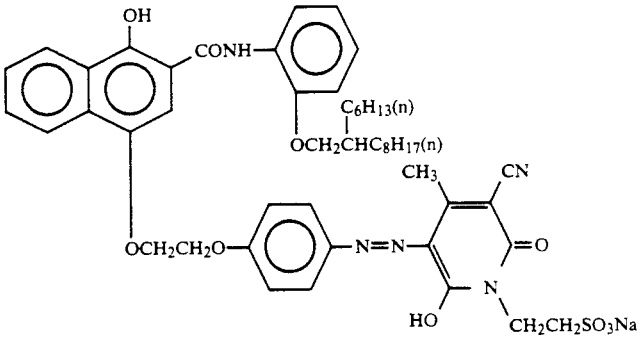
(YC-4)
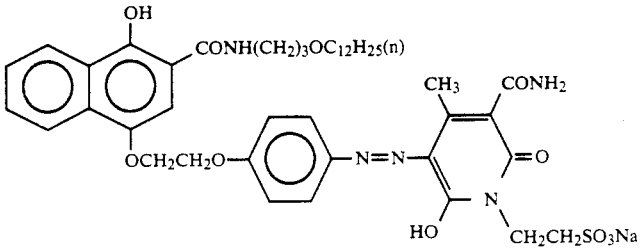
(YC-5)
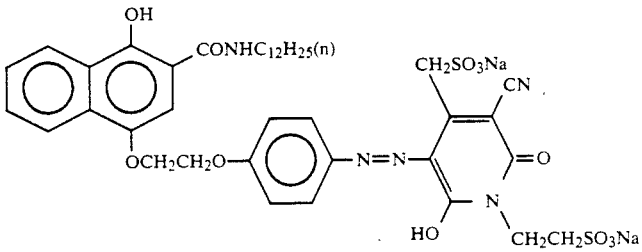
(YC-6)
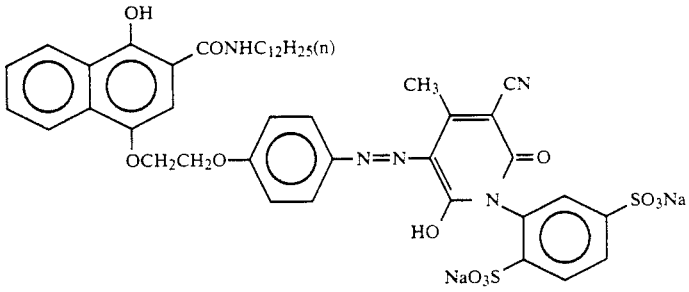
(YC-7)
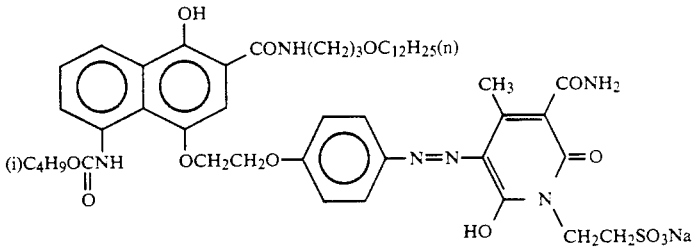
(YC-8)
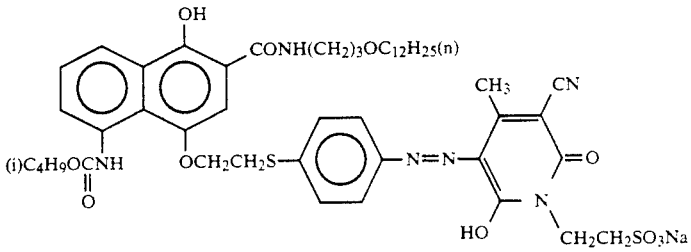

-continued
(YC-9)
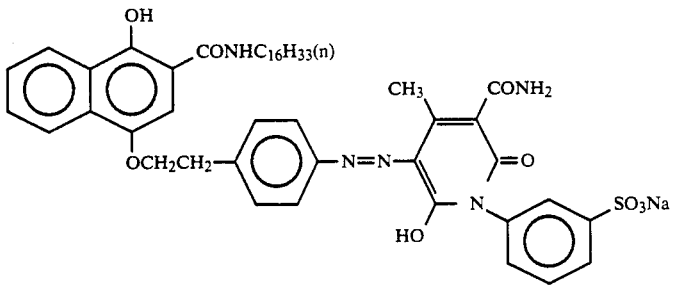
(YC-10)
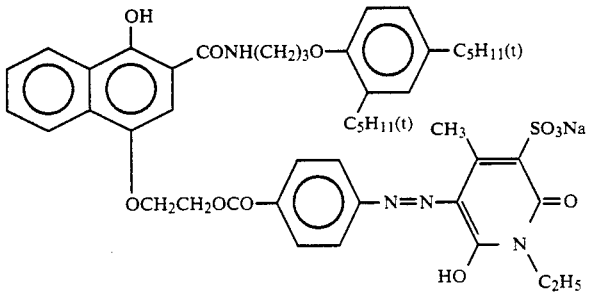
(YC-11)
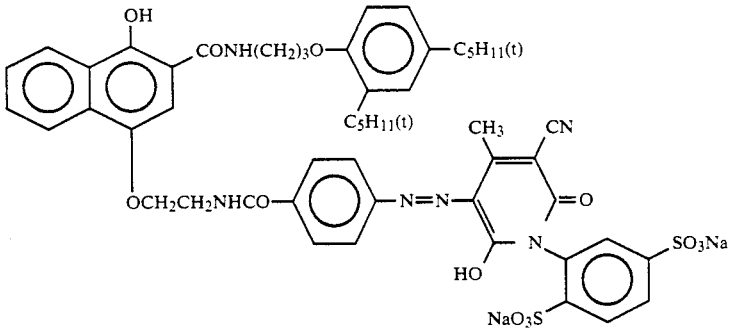
(YC-12)
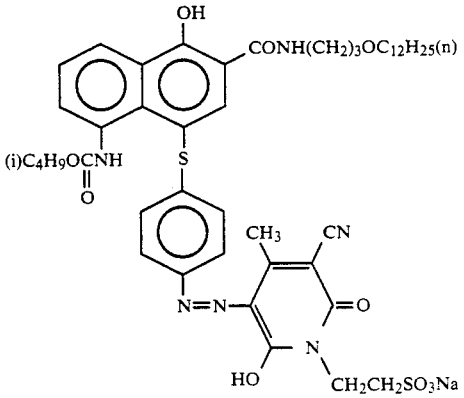

-continued
(YC-13)
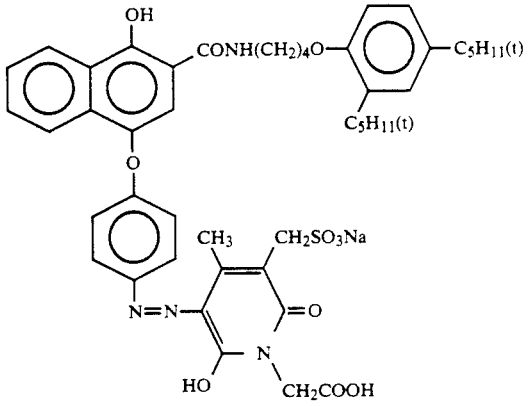
(YC-14)
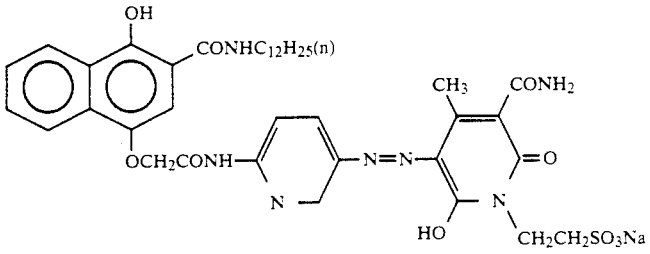
(YC-15)
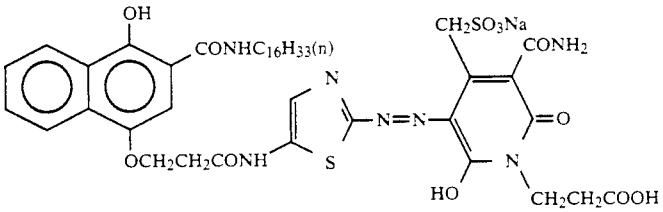
(YC-16)
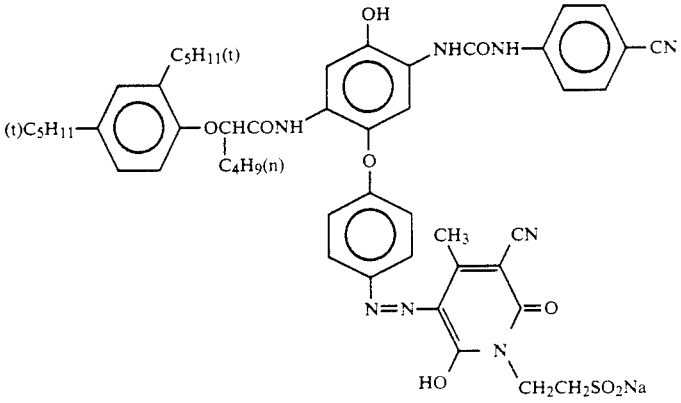

-continued
(YC-17)
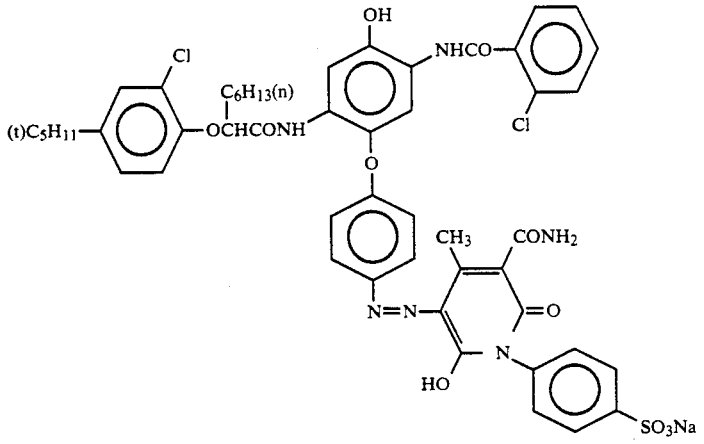
(YC-18)
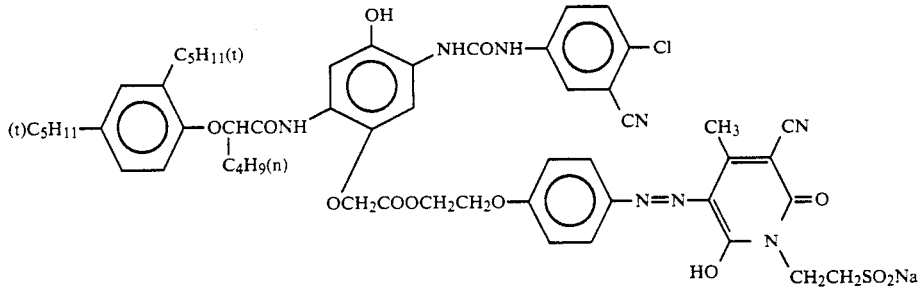
(YC-19)
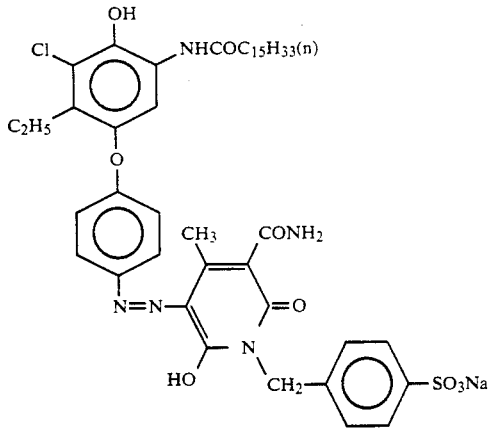
(YC-20)
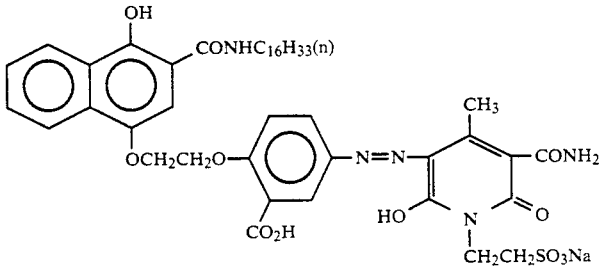

-continued
(YC-21)
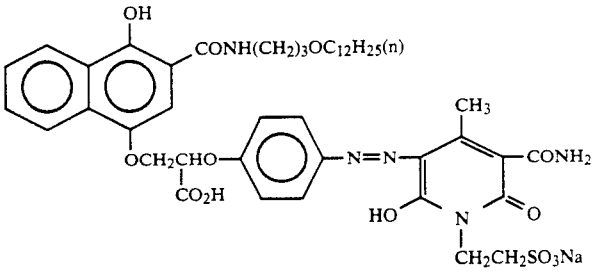
(YC-22)
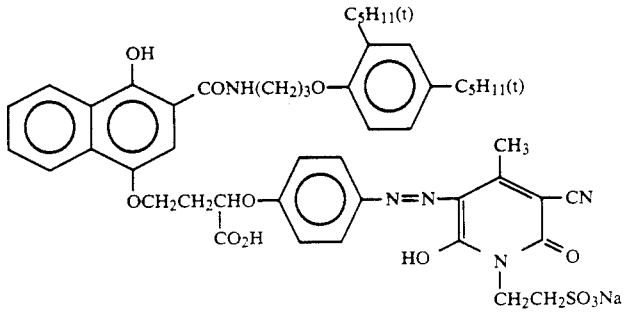
(YC-23)
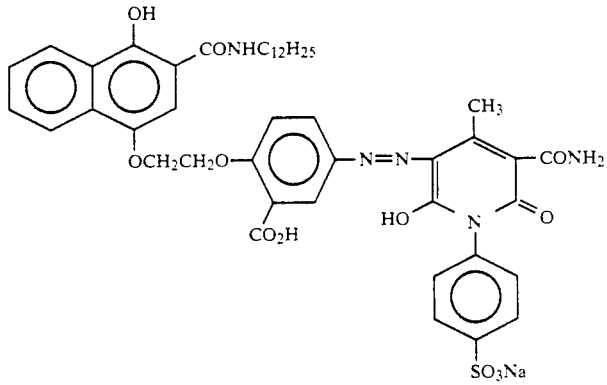
(YC-24)
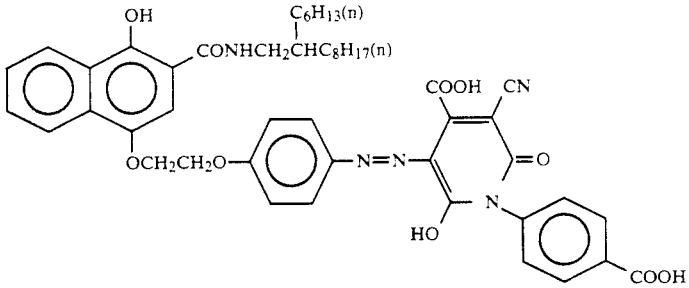
(YC-25)
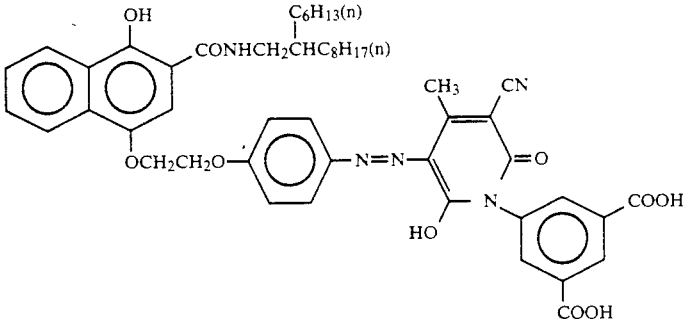

-continued
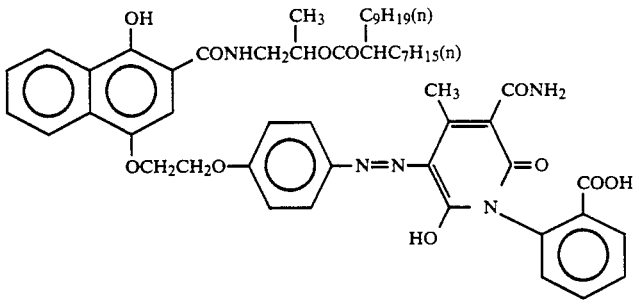
(YC-26)
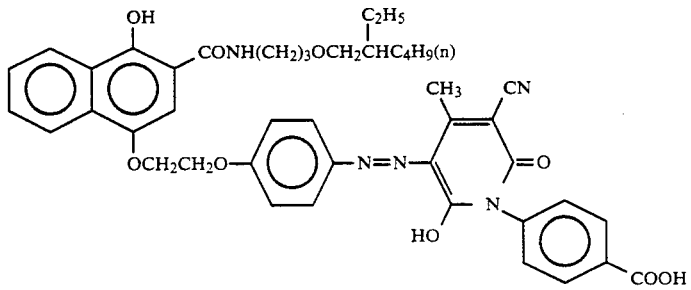
(YC-27)
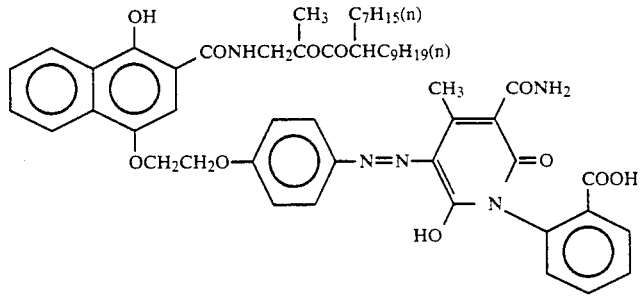
(YC-28)
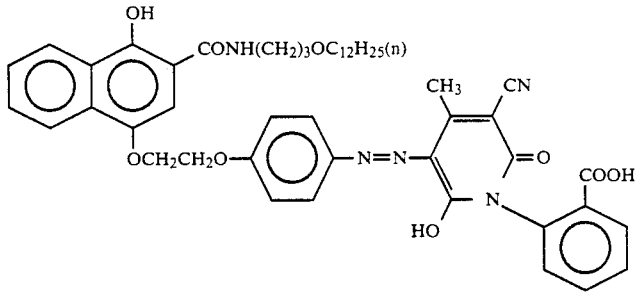
(YC-29)
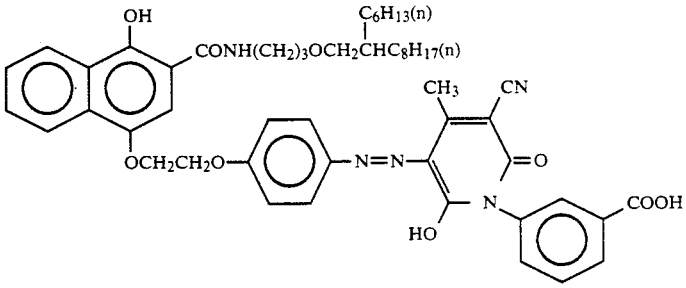
(YC-30)

-continued
(YC-31)
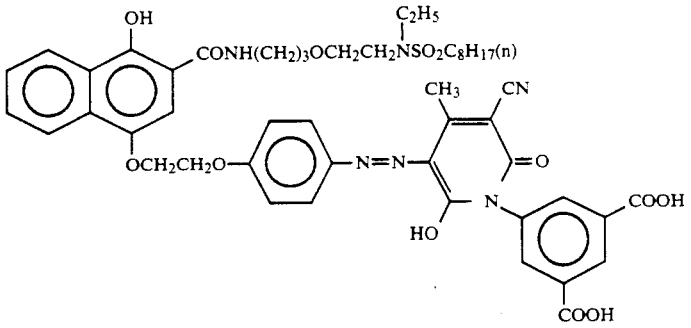
(YC-32)
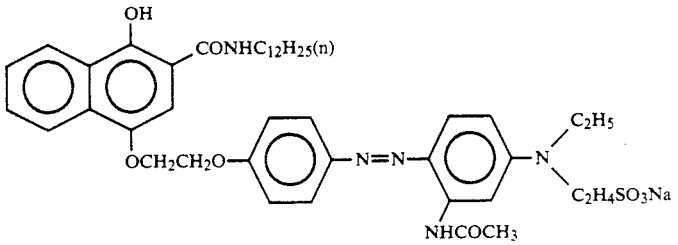
(YC-33)
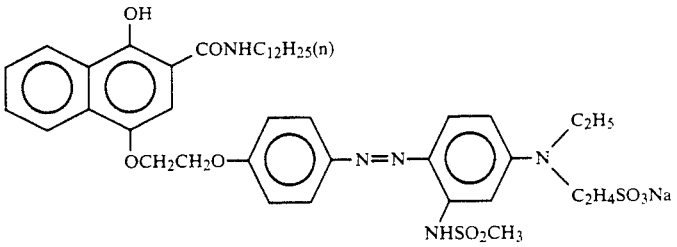
(YC-34)
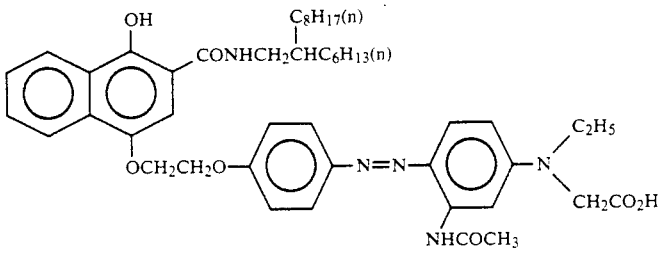
(YC-35)
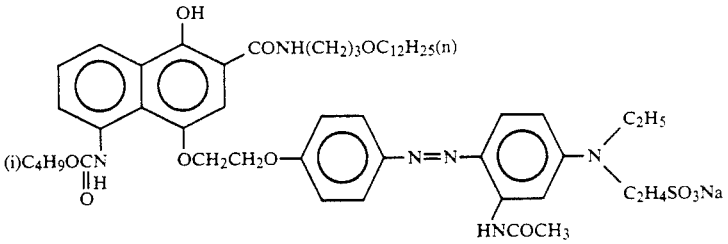
(YC-36)
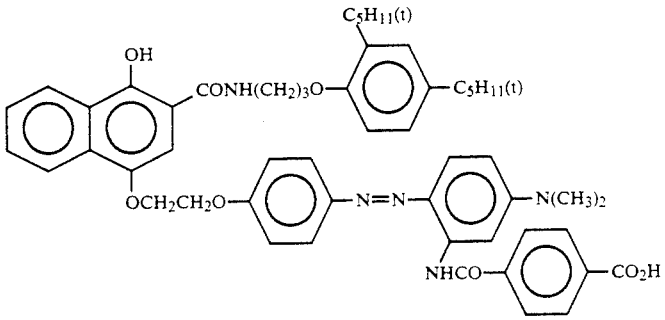

-continued
(YC-37)
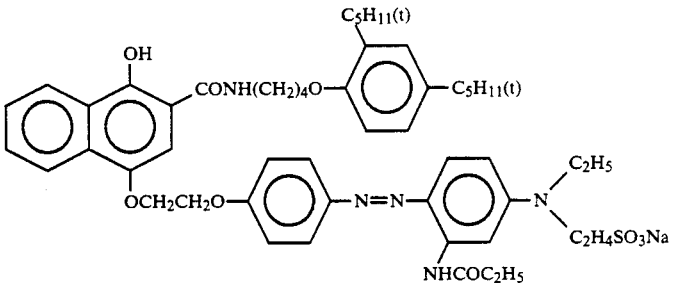
(YC-38)
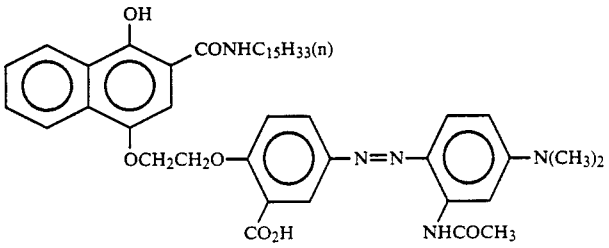
(YC-39)
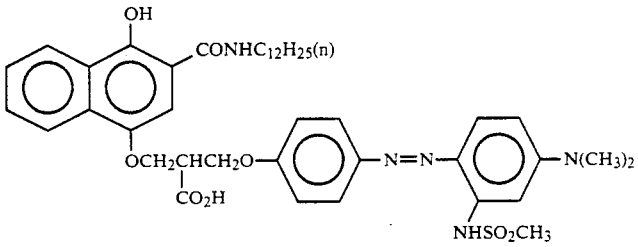
(YC-40)
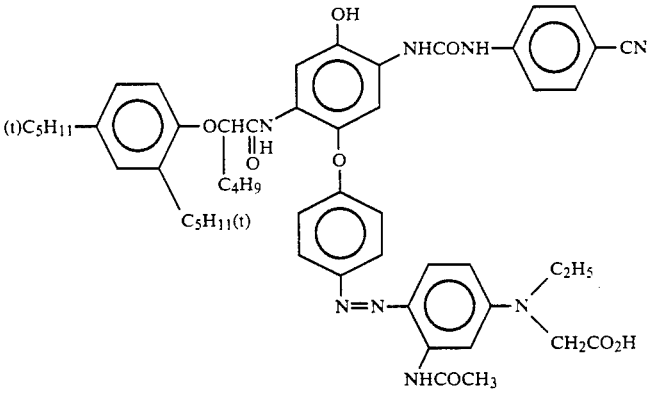
(YC-41)
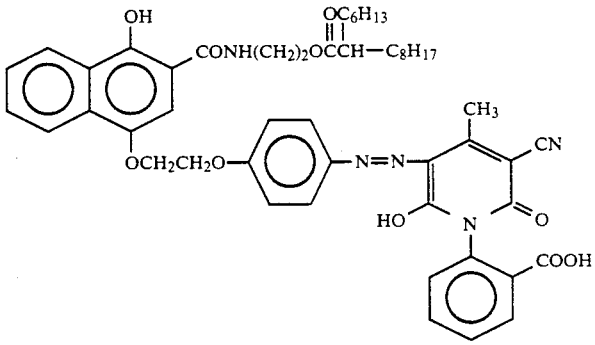

-continued
(YC-42)
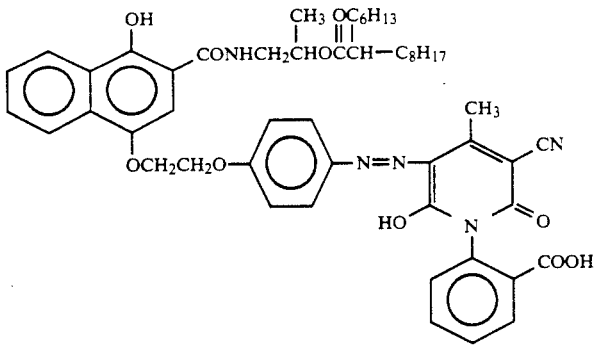
(YC-43)
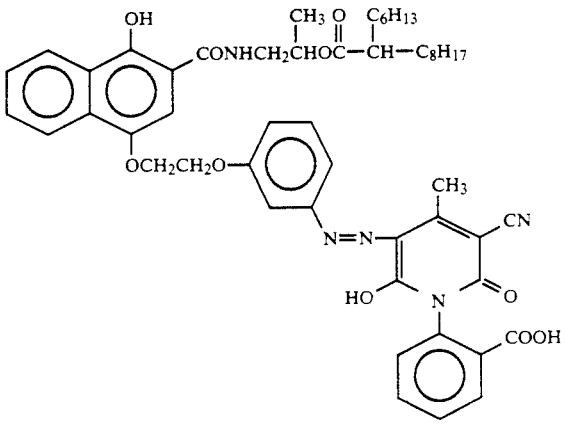
(YC-44)
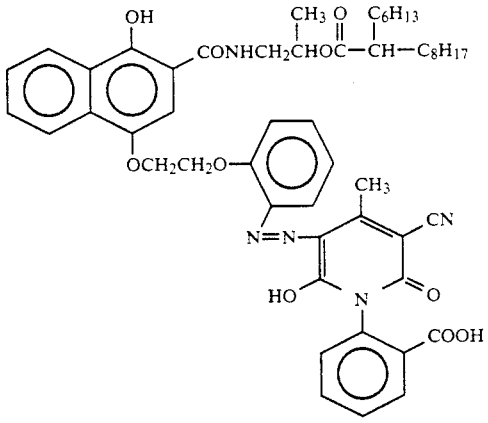
(YC-45)
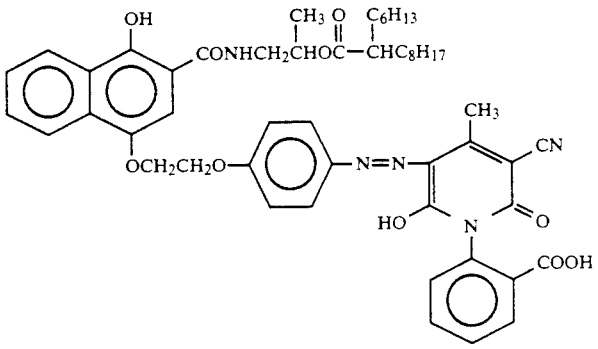

-continued
(YC-46)
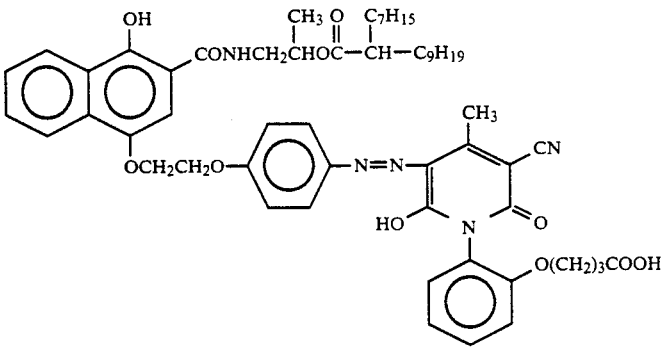
(YC-47)
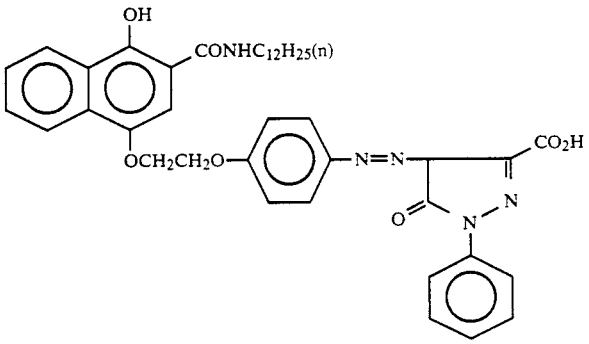
(YC-48)
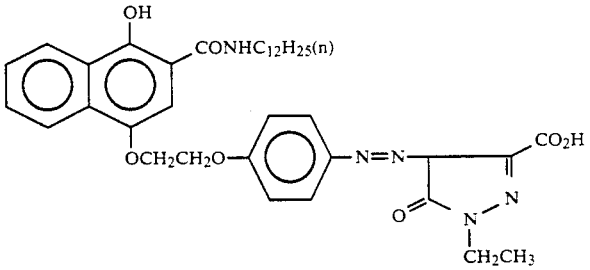
(YC-49)
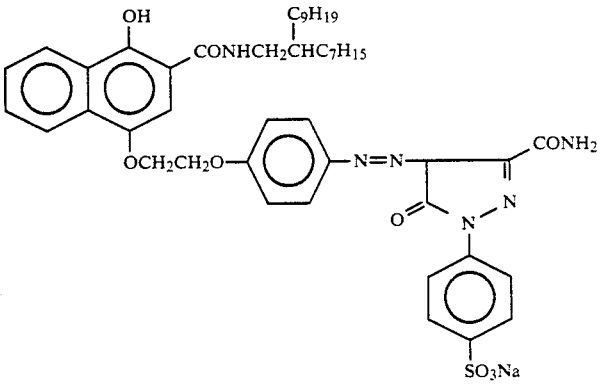

-continued
(YC-50)
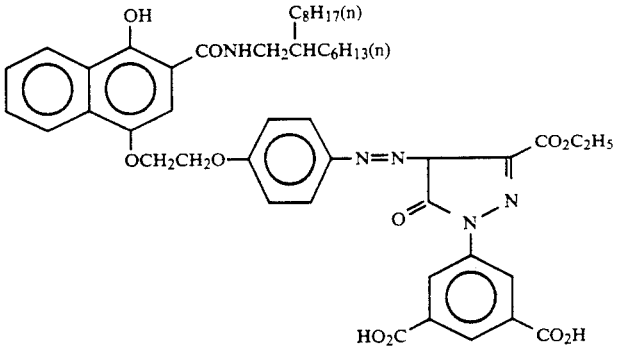
(YC-51)
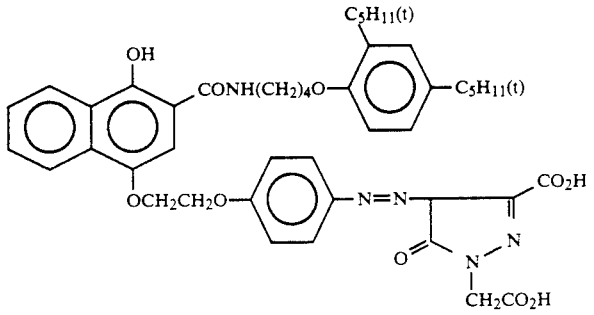
(YC-52)
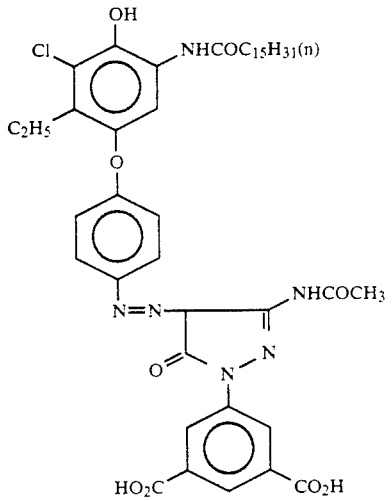
(YC-53)
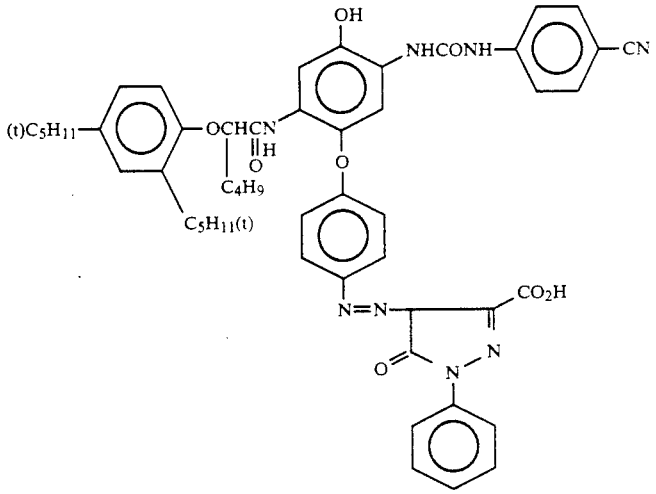

-continued (YC-54)

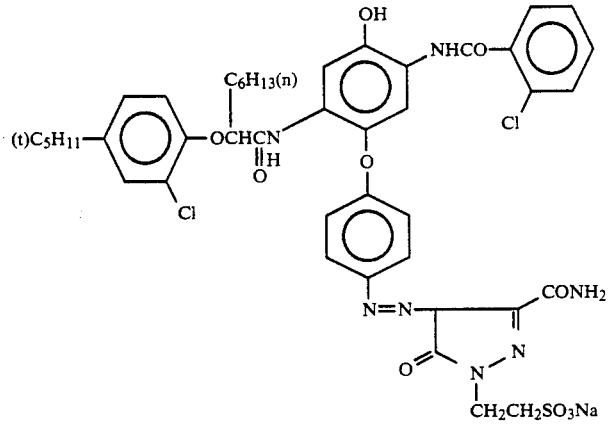

(YC-55)

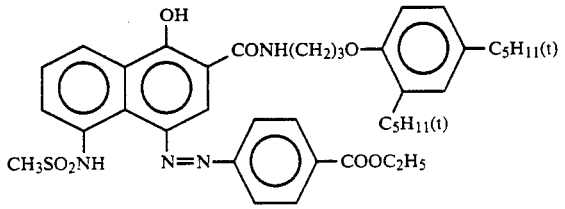

The yellow-colored cyan coupler, represented by the formula (CI), can generally be synthesized by means of diazo coupling reaction between a 6-hydroxy-2-pyridone and a diazonium salt such as aromatic diazonium salt or heterocyclic diazonium salt, which contains a coupler structure.

The 6-hydroxy-2-pyridone can be synthesized by the methods disclosed in, for example, ed. Klingsberg "Heterocyclic Compounds - Pyridine and Its Derivatives, Part 3," Interscience, 1962, Journal of the American Chemical Society, 1943, Vol. 65, p. 449, Journal of the Chemical Technology and Biotechnology, 1986, Vol. 36, p. 410, Tetrahedron Letters, 1966, Vol. 22, p. 445, JP-B-61-52827, West German Patents 2,162,612, 2,349,709 and 2,902,486, and U.S. Pat. No. 3,763,170.

The diazonium salt can be synthesized by the methods disclosed in, for example, U.S. Pat. Nos. 4,004,929 and 4,138,258, JP-A-61-72244, and JP-A-61-273543. Diazo coupling reaction between the 6-hydroxy-2-pyridone and the diazonium salt can be performed in a solvent such as methanol, ethanol, methyl cellosolve, acetic acid, N,N-dimethylformamide, N,N-dimethylacetoamide, tetrahydrofuran, dioxyane or water, or a mixture of these solvents. In this reaction, use can be made of a base such as sodium acetate, potassium acetate, sodium carbonate, potassium carbonate, sodium hydrocarbonate, sodium hydroxide, potassium hydroxide, pyridine, triethyl amine, tetramethyl urea, or tetramethyl guanidine. The reaction temperature is −78° C. to 60° C., preferably −20° C. to 30° C.

Some examples of synthesises of the yellow-colored cyan coupler for use in the present invention will now be described.

Synthesis 1

Synthesis of Coupler (YC-1)

Synthesis route 2 applied to this case is shown below:

Synthesis Route 2

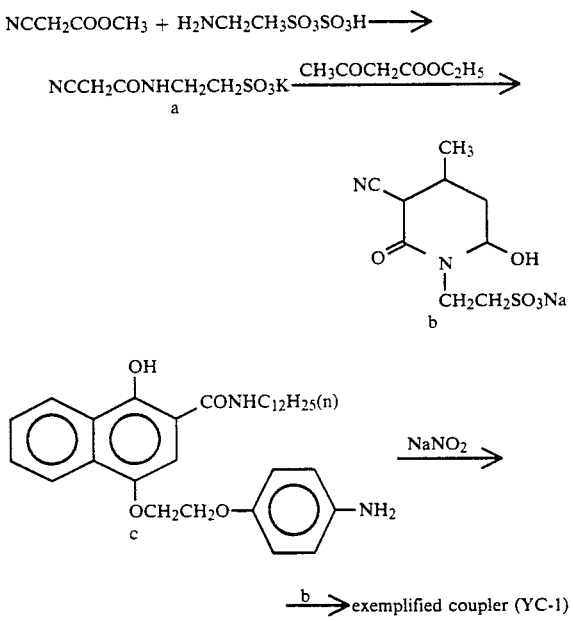

(1) Synthesis of Compound a

First, 500 ml of methanol was added to 125.2 g of taurine and 66 g of potassium hydroxide, thus forming a solution. The solution was stirred while being heated. Then 110 g of methyl cyanoacetate was dropped into the solution over about 1 hour. The solution was heated and refluxed for 5 hours, and was left to stand one night, precipitating crystals. The crystals were filtered, washed with ethanol, and dried, thus obtaining 202.6 g of the compound a in the form of crystals.

(2) Synthesis of Compound b

First, 11.5 ml of water was added to 11.5 g of compound a and 3.5 g of potassium carbonate, thus forming a solution. The solution was stirred while being heated. Then 7.8 g of methyl acetoacetate was dropped into the solution. The solution was stirred for 7 hours, and left to be cooled. Thereafter, 9.2 ml of concentrated hydrochloric acid was added to the solution. The solution was then stirred, whereby crystals were precipitated. The crystals were filtered, washed with methanol, and dried, thus obtaining 10.4 g of the compound b in the form of crystals.

(3) Synthesis of Exemplified Coupler (YC-1)

First, 0.1 g of compound cl synthesized by the method disclosed in U.S. Pat. No. 4,138,258 was dissolved in 60 ml of N,N-dimethylformamide and 60 ml of methyl cellosolve. Further, under ice-cooling, 4.3 ml of concentrated hydrochloric acid was added to the solution, and solution of 1.84 g sodium sulfite in 5 ml of water was dropped into the solution, thereby preparing diazonium solution. Meanwhile, 60 ml of methyl cellosolve and 20 ml of water was added to 7.8 g of compound b and 8.2 g of sodium acetate under ice-cooling while being stirred, and the diazonium solution was dropped thereinto. The resultant solution was stirred for an hour and for additional 2 hours at room temperature, whereby crystals were precipitated. The crystals were filtered, washed with water, and dried. The crystals were dispersed in 500 ml of methanol, heated and refluxed for 1 hour, and left to be cooled. The crystals were filtered, washed with methanol, and dried, thereby obtaining 13.6 g of red crystals of the exemplified coupler (YC-1). The compound, thus obtained, had a melting point of 269° to 272° C. (decomposition); its structure was ascertained by $^1$HNMR spectral analysis, mass spectral analysis, and element analysis. The maximum absorption wavelength and molar extinction coefficient which this compound exhibited in methanol was 457.7 nm and 41300, respectively. As an yellow-colored coupler, the coupler (YC-1) had good spectral absorption characteristics.

Synthesis 2

Synthesis of Exemplified Coupler (YC-3)

Synthesis route 3 applied to this case is shown below:

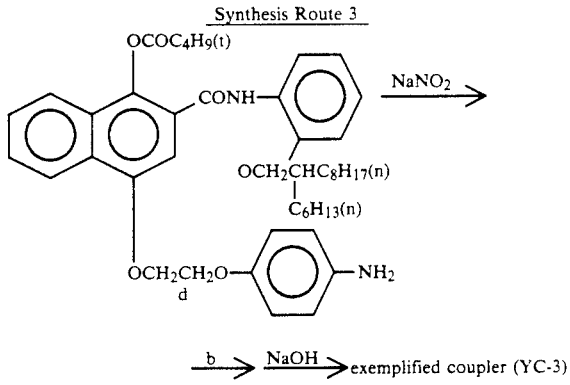

First, 75 ml of N,N-dimethylformamide and 75 ml of methyl cellosolve were added to 19.2 g of the compound d synthesized by the method disclosed in JP-A-62-85242, to dissolve, forming a solution. While the solution was being stirred at a temperature below ice point, 5.6 ml of concentrated chloric acid was added to the solution, and a solution of 2.5 g sodium nitrite in 5 ml of water was dropped into the solution. After the aqueous solution had been dropped, the solution was stirred for 1 hour, and then stirred for 1 hour at room temperature, thereby preparing a diazonium solution.

Next, 75 ml of methyl cellosolve and 26 ml of water were added to 10.1 g of compound b and 10.7 g of sodium acetate, thus forming a solution. While this solution was being stirred under ice-cooling, the diazonium solution was dropped into the solution. The resultant solution was stirred for 1 hour, and then stirred for 2 hours at room temperature, whereby crystals were precipitated. The crystals were filtered. The crystals were dispersed in 200 ml of methanol, and an aqueous solution of 2.2 g sodium hydroxide in 10 ml of water was dropped there into. The resultant solution was stirred for 3 hours and neutralized with concentrated hydrochloric acid, whereby crystals were precipitated. The crystals were washed with water and further with methanol and dried. The crystals, thus obtained, were refined with heated methanol as in Synthesis 1, thereby obtaining 14.8 g of the exemplified coupler (YC-3). The compound, thus obtained, had a melting point of 246° to 251° C. (decomposition); its structure was ascertained by $^1$HNMR spectral analysis, mass spectral analysis, and element analysis. The maximum absorption wavelength and molar extinction coefficient which this compound exhibited in methanol was 457.6 nm and 42700, respectively. As an yellow-colored coupler, the coupler (YC-3) had good spectral absorption characteristics.

Synthesis 3

Synthesis of Exemplified Coupler (YC-30)

Synthesis route 4 applied to this case is shown below:

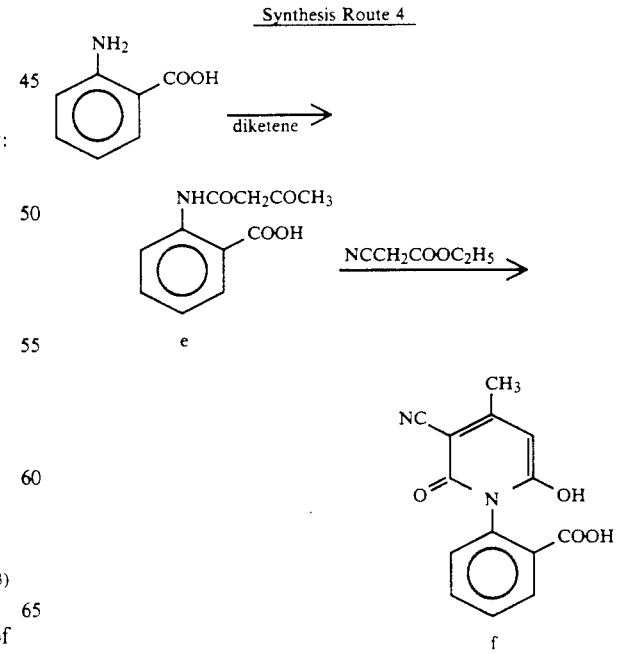

-continued

Synthesis Route 4

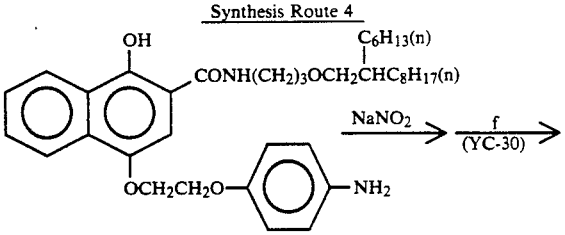

exemplified coupler (YC-30)

(1) Synthesis of Compound e

First, 137.1 g of anthranilic acid was added to 600 ml of acetonitrile, thus forming a solution. The solution was being stirred under heating, 92.5 g of diketene was dropped into the solution over about 1 hour. The solution was then heated and refluxed for 1 hour and was cooled to room temperature. As a result, crystals were precipitated. The crystals were washed with acetonitrile and dried, obtaining 200.5 g of compound e in the form of crystals.

(2) Synthesis of Compound f

Compound e, ethyl cyanoacetate, 28% sodium methoxide, used in an amount of 199.1 g, an amount of 89.2 g and an amount of 344 g, respectively, were added to 0.9 liter of methanol, thus forming a mixture. In an autoclave, the mixture was reacted at 120° C. for 8 hours. The reaction mixture was left to stand one night and concentrated under reduced pressure. Next, 700 ml of water was added to the mixture. The mixture was then treated with 230 ml of concentrated hydrochloric acid and thereby acidified. Crystals were precipitated. The crystals were filtered and washed with a mixed solvent of ethyl acetate and acetonitrile while being heated, thus obtaining 152 g of compound f.

(3) Synthesis of Exemplified Coupler (YC-30)

First, 13.0 g of compound g synthesized by the method disclosed in U.S. Pat. No. 4,138,258 was dissolved in 40 ml of N,N-dimethylformamide, forming a solution Then, 4.5 ml of concentrated hydrochloric acid was added the solution under ice-cooling. Further, an aqueous solution of 1.48 g sodium nitrite in 5 ml of water was dropped into the solution, preparing a diazonium solution. Meanwhile, 20 ml of N,N-dimethylformamide and 15 ml of water were added to 6.0 g of compound f and 8 g of sodium acetate, thus forming a solution The diazonium solution was dropped into this solution, while the solution was being stirred under ice-cooling. The resultant solution was stirred for 30 minutes at room temperature. The solution was treated with hydrochloric acid and thus acidified. After the solution was extracted with ethyl acetate, it was washed with water and concentrated under reduced pressure. The resultant concentrate was recrystallized with an ethyl acetate-methanol mixed solvent, thereby obtaining 13 g of yellow crystals, i.e., the exemplified coupler (YC-30). This coupler, (YC-30), had a melting point of 154° to 156° C.; its structure was ascertained by $^1$HNMR spectral analysis, mass spectral analysis, and element analysis. The maximum absorption wavelength and molar extinction coefficient which this coupler exhibited in methanol was 458.2 nm and 42800, respectively. As an yellow-colored coupler, the coupler (YC-30) had good spectral absorption characteristics.

Synthesis 4

Synthesis of Exemplified Coupler (YC-42)

Synthesis route 5 applied to this case is shown below.

Synthesis Route 5

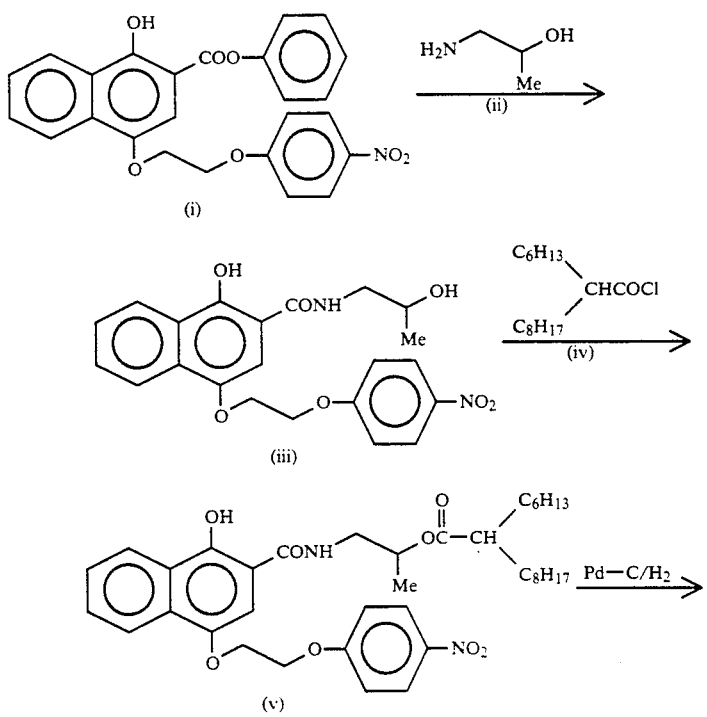

-continued

Synthesis Route 5

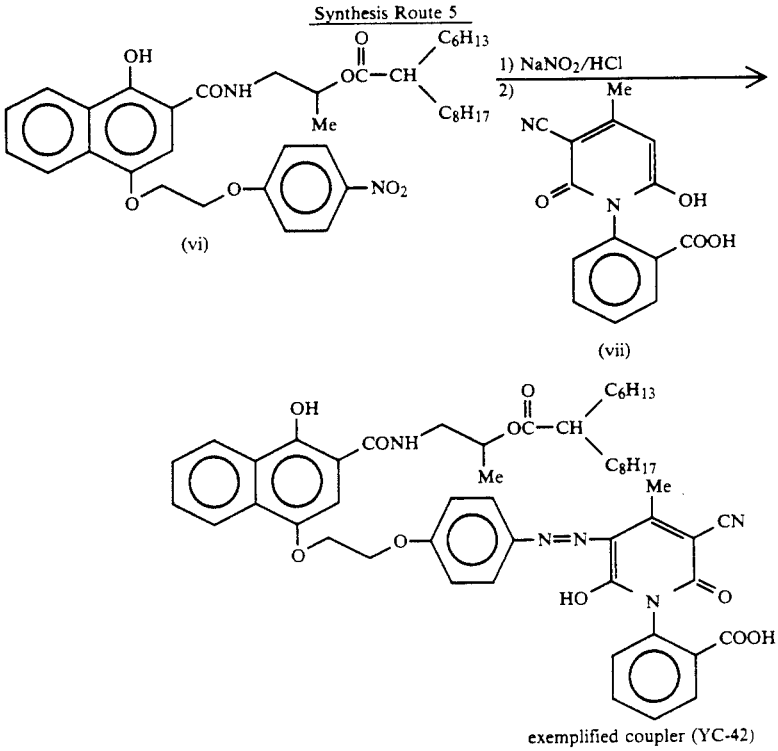

exemplified coupler (YC-42)

(1) Synthesis of Compound (iii)

First, 445.5 g of phenyl ester compound (i) and 90.1 g of isopropanol amine (ii) were added to 600 ml of acetonitrile, forming a solution. The solution was heated and refluxed for 2 hours and then water-cooled. As a result, crystals were precipitated. The crystals were filed and dried, thus obtaining 342 g of the compound (iii), which exhibited a melting point of 162° to 165° C.

(2) Synthesis of Compound (v)

Hydroxyl compound (iii), used in an amount 341 g, and 231 g of 2-hexyldecanoyl chloride were added to 880 ml of acetonitrile, thus forming a solution. This solution was heated and refluxed for 2 hours and cooled with water. As a result, crystals were precipitated. The crystals were filtered and dried, thus obtaining 437 g of the compound (v), which exhibited a melting point of 97° to 100° C.

(3) Synthesis of Compound (vi)

First, 370 g of nitro compound (v), 6 g of 10% Pd-C catalyst, and 1 liter of ethyl acetate were charged into an autoclave, and hydrogenation was carried out for 3 hours at 50° C. Thereafter, the catalyst were filtered out, and the filtrate was condensed under reduced pressure, thus obtaining residue. The residue was crystallized from n-hexane. The crystals were filtered out and dried, thus obtaining 327 g of amine compound (vi), which had a melting point of 95° to 97° C.

(4) Synthesis of Exemplified Coupler (YC-42)

The amine compound (vi), used in an amount of 20.8 g, was dissolved in 60 liters of dimethylformamide, forming a solution. 7.6 ml of concentrated hydrochloric acid was added to the solution under water-cooling. Further, an aqueous solution of 2.7 g sodium nitrite in 10 ml of water was dropped into the solution over 20 minutes. The resultant solution was stirred for 30 minutes, thereby preparing diazo solution.

In the meantime, 9.7 g of pyridone (vii) and 13 g of sodium acetate were added to a mixture of 30 ml of water and 30 ml of dimethylformamide, and heated to dissolve the pyridone and sodium acetate, thus forming a solution. This solution was cooled with water and stirred below 10° C. The diazo solution wa slowly added to the solution, while the solution was being stirred. Thereafter, the solution was stirred for 15 minutes, was extracted with ethyl acetate, and water-washed three times. The organic layers were concentrated under reduced pressure. The resultant residue was treated with methanol-ethyl acetate, whereby crystals were precipitated. The crystals were filtered out and dried, thus obtaining 21.2 g of the exemplified coupler (YC-42), which had a melting point of 117° to 119° C.

The yellow-colored cyan couplers of formulas (CII) to (CIV) can be synthesized by the methods disclosed in JP-B-58-6939 and JP-A-1-197563, and the method disclosed in the literatures listed above with reference to the synthesises of the coupler represented by the formula (CI).

In the present invention, the yellow-colored cyan couplers of formulas (CI) and (CII) are preferably used. Of these couplers, the coupler of the formula (CI) is more preferable.

In the present invention, the yellow-colored cyan coupler is contained in a non-light-sensitive layer close to a red-sensitive emulsion layer. The word "close" means that the non-light-sensitive layer is placed directly adjacent to the red-light-sensitive emulsion layer or placed through another non-light-sensitive layer on the red-light-sensitive layer.

The non-light-sensitive layer can contain a silver halide emulsion not chemical sensitized, fine-grain silver halide emulsion, colloidal silver grains, a coupler, a dye, a color-mixing inhibitor, a ultraviolet absorber, a hydrophilic or lipophilic polymer, and an organic solvent having a high boiling point.

It suffices to place the non-light-sensitive layer containing the yellow-colored cyan coupler, close to the red-sensitive emulsion layer. Nonetheless, it is better to place it close to both a red-sensitive emulsion layer and a green-sensitive emulsion layer or a support, so that the resultant color photographic light-sensitive material may have its sharpness improved. For the purpose of increasing the light-sensitivity and color reproducibility of the material, it is desirable that the non-light-sensitive layer be directly adjacent to a red-sensitive emulsion layer, particularly the highest-speed red-sensitive emulsion layer. Preferably, the yellow-colored cyan color is added to a non-light-sensitive layer which is directly adjacent to both the highest-speed red-sensitive emulsion layer and a low-speed green-sensitive emulsion layer, directly adjacent to both the highest-speed red-sensitive emulsion layer and a low- (or midium-) speed red-sensitive emulsion layer, or directly adjacent to a low-speed red-sensitive emulsion layer and close to the support.

The yellow-colored cyan coupler is used in the light-sensitive material, in an amount of 0.005 to 0.30 g/m$^2$, preferably 0.02 to 0.20 g/m$^2$, more preferably 0.03 to 0.15 g/m$^2$. Of yellow colored cyan couplers, the couplers represented by formulas (CI) to (CIV) are preferably used in an amount of 80 mol % or more, more preferably 100 mol %.

The yellow-colored cyan coupler can be added in the same way as ordinary couplers are used, as will later be described in detail.

It is particularly desirable that the yellow-colored coupler be used along with a colorless cyan coupler represented by the following formula (C), in order to improve the sharpness of the light-sensitive material, to reduce changes in photographic properties due to changes in the composition of the processing solution used, and to enhance the storage stability of the image after the processing of the material.

formula (C)

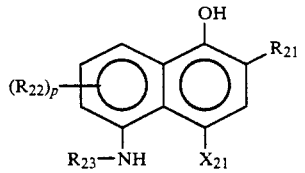

In the formula (C), $R_{21}$ is —$CONR_{24}R_{25}$, —$SO_2NR_{24}R_{25}$, —$NHCOR_{24}$, —$NHCOOR_{26}$, —$NHSO_2R_{26}$, —$NHCONR_{24}R_{25}$ or —$NHSO_2NR_{24}T_{25}$, $R_{22}$ is a group which can be substituted on a naphthalene ring, p is an integer ranging from 0 to 3, $R_{23}$ is a substituent, $X_{21}$ is hydrogen or a group which can be substituted by the coupling reaction with an oxidized form of an aromatic primary amine developing agent. $R_{24}$ and $R_{25}$ can either be identical or different, and are hydrogen, alkyl groups, aryl groups or heterocyclic groups. $R_{26}$ is an alkyl group, an aryl group or a heterocyclic group. If p is plural, groups $R_{22}$ can be either identical or different, can bond together to form a ring. $R_{22}$ and $R_{23}$, or $R_{23}$ and $X_{21}$ can bond together to form a ring.

The cyan coupler of the formula (C) can form a dimer or a polymer (including a polymer in which the coupler is bonded to a polymer main chain), through a divalent or higher valent group, at $R_{21}$, $R_{22}$, $R_{23}$ or $X_{21}$.

The alkyl group is a straight chain, a branched chain or a ring, can contain an unsaturated bond, and can have a substituent (e.g., halogen atom, an aryl group, a heterocyclic group, an alkoxy group, an aryloxy group, an alkyl sulfonyl group, an arylsulfonyl group, an alkoxycarbonyl group, an acyloxy group, or an acyl group).

The aryl group can be a condensed ring (e.g., naphthyl group) and can have a substituent (e.g., an alkyl group, cyano, a carbonamide, a sulfonamide, a carbamoyl group, a sulfamoyl group, an ureido group, an alkoxycarbonylamino group and one equal to the substituent of the alkyl group noted above.

The heterocyclic group is a 3- to 8-membered monocyclic or condensed-ring heterocyclic group which contains at least one hetero atom selected from the group consisting of N, O, S, P, Se and Te, and can have a substituent (e.g., hydroxyl, carboxyl, nitro, amino, an aryloxycarbonyl group, or one equal to the substituent of the aryl group).

Preferably, $R_{21}$ is a carbamoyl group having C number of 1 to 30 or a sulfamoyl group having C number of 0 to 30. Examples of the carbamoyl group are: N-n-butylcarbamoyl, N-n-hexadecylcarbamoyl, N-[3-(2,4-di-t-pentylphenoxy) propyl]carbamoyl, N-(3-n-dodecyloxypropyl) carbamoyl, and N-(3-n-dodecyloxy-2-methylpropyl) carbamoyl, N-[3-(4-t-octylphenoxy) propyl]carbamoyl. Examples of the sulfamoyl group are: N-(3-n-dodecyloxypropyl) sulfamoyl and N-[4-(2,4-di-t-pentylphenoxy) butyl]sulfamoyl. Most preferably, $R_2$ is a carbamoyl group.

In formula (C), p is preferably 0 or 1, more preferably 0. $R_{22}$ is preferably a halogen atom (e.g., F, Cl, Br, or I, hereafter "a halogen atom" represents these atoms), cyano, an alkoxy group having C number of 1 to 12, an alkoxy group, a carbonamide group, or a sulfonamide group.

$R_{23}$ is preferably —$COR_{27}$, —$SO_2R_{28}$, —$CO_2R_{28}$, —$PO(OR_{28})_2$ or —$PO(R_{28})_2$. Here, $R_{27}$ and $R_{28}$ are equal to $R_{24}$ and $R_{26}$, respectively. $R_{23}$ is more preferably —$COR_{27}$ having C number of 1 to 30 (e.g., acetyl, trifluoroacetyl, pivaloyl, or benzoyl), —$SO_2R_{28}$ having C number of 1 to 30 (e.g., methylsulfonyl, n-butylsulfonyl, or p-tolylsulfonyl), or —$CO_2R_{28}$ having C number of 2 to 30 (e.g., methoxy carbonyl, isobutoxycarbonyl, or 2-ethylhexyloxycarbonyl). Of these, —$CO_2R_{28}$ is the most preferable.

$X_{21}$ is hydrogen, an alkoxy group having C number of 1 to 30 (e.g., 2-hydroxyethoxy, 2-(carboxymethylthio) ethoxy, 3-carboxyethoxy, or 2-methoxyethoxy), an aryloxy group having C number of 6 to 30 (e.g., 4-methoxyphenoxy or 4-(3-carboxypropaneamide) phenoxy), an alkylthio group having C number of 2 to 30 (e.g., carboxymethylthio, 2-carboxyethylthio, 2-hydroxyethylthio, or 2,3-dihydroxypropylthio), or an arylthio group having C number of 6 to 30 (e.g., 4-t-butyl phenylthio or 4-(3-carobxypropaneamido) phenylthio. Particularly preferably are hydrogen, chlorine, an alkoxy group, or an alkylthio group.

Examples of the cyan coupler of the formula (C) are couplers (C-1) to (C-16) specified below:

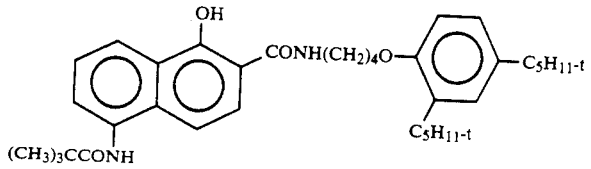
(C-1)
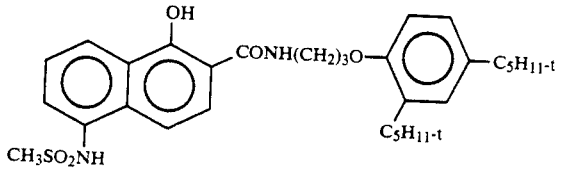
(C-2)
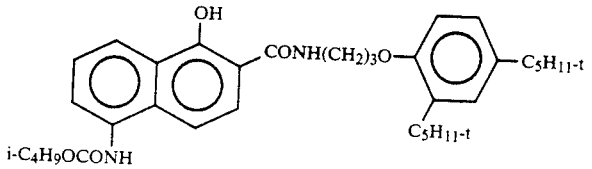
(C-3)
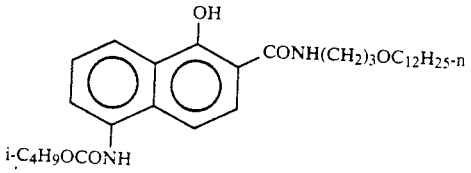
(C-4)
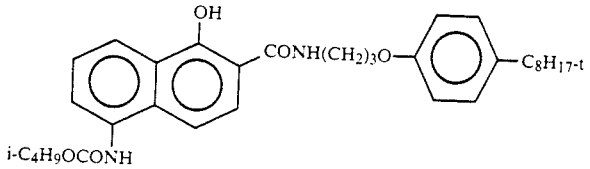
(C-5)
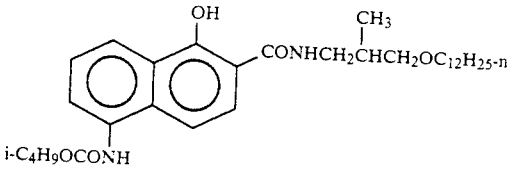
(C-6)
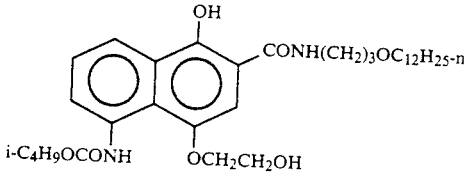
(C-7)
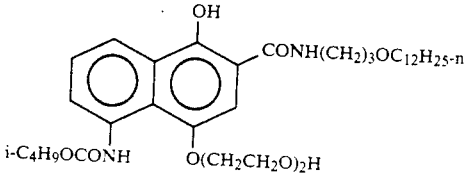
(C-8)

-continued
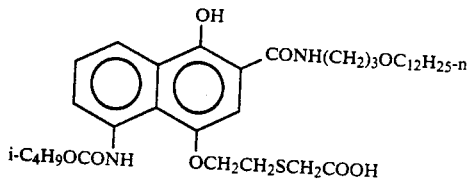
(C-9)
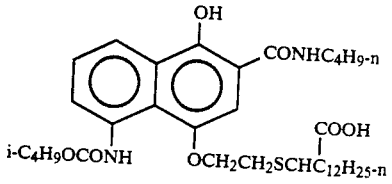
(C-10)
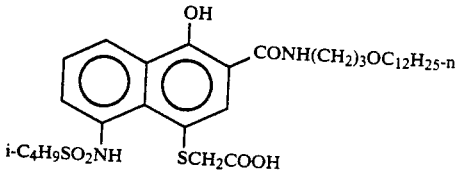
(C-11)
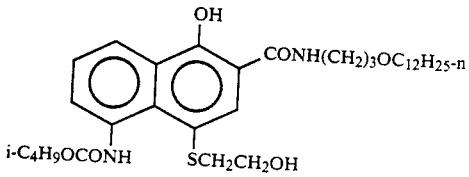
(C-12)
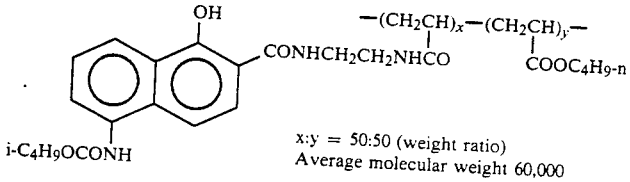
x:y = 50:50 (weight ratio)
Average molecular weight 60,000
(C-13)
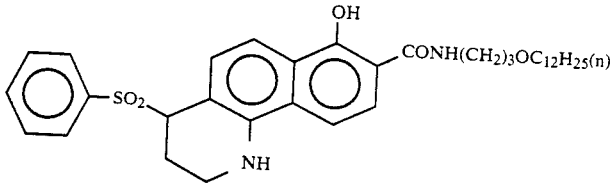
(C-14)
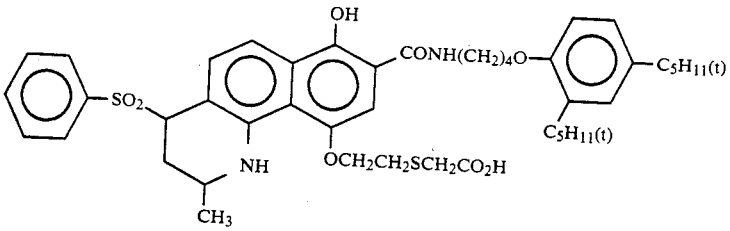
(C-15)
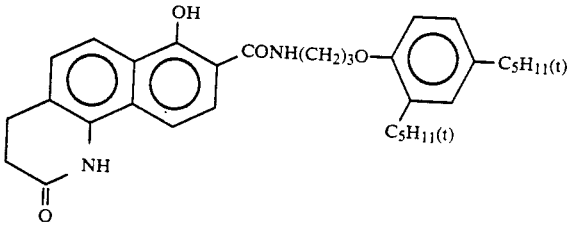
(C-16)
Specific examples of colorless cyan couplers represented by the formula (C), other than those mentioned The cyan coupler represented by the formula (C) is used in the light-sensitive materials, in an amount of 0.10 to 1.0 g/m$^2$, preferably 0.20 to 0.80 g/m$^2$, more preferably 0.25 to 0.60 g/m$^2$.

In the present invention, the colorless cyan couplers represented by the formula (C) can be used in combination of two or more. If the same color-sensitive layer has two or more sub-layers, the sensitivity of which are different, it is desirable that a 2-equivalent cyan coupler is used in the sub-layer of the highest sensitivity, and a 4-equivalent cyan coupler is used in the sub-layer of the lowest sensitivity. In the other case, it is preferred that the 2-equivalent cyan coupler or the 4-equivalent cyan coupler, or both cyan couplers, are used in the same color-sensitive layer.

It is more desirable that the colorless cyan coupler represented by the formula (C) contain a small amount of an organic solvent for dispersion, having a high boiling point, as is disclosed in JP-A-62-269958. Such an organic solvent, if used, will improve the sharpness and storage stability of the image after the processing.

To enhance the storage stability of the light-sensitive material, to further decrease the changes in the photographic properties thereof due to changes in the composition of a processing solution, and to improve the storage stability of the image after the processing, it is desirable that a colorless cyan coupler of the following formula (D) be used, too.

formula (D)

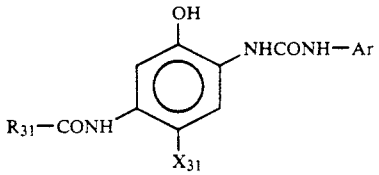

wherein $R_{31}$ is an aliphatic group, an aromatic group or a heterocyclic group, Ar is an aromatic group, $X_{31}$ is hydrogen or a group which can be released by the coupling reaction with the oxidized form of an aromatic primary amine developing agent.

The term "aliphatic group," used here and hereinafter, means an aliphatic hydrocarbon group and includes an alkyl group, an alkenyl group, or alkinyl group, and may be in the form of a straight chain, a branched chain, or a ring. The term "aromatic group" means a substituted or unsubstituted aryl group; it can be a condensed ring. The term "heterocyclic group" means a substituted or unsubstituted, monocyclic or condensed heterocyclic group.

$R_{31}$ is an aliphatic group having 1 to 36 carbon atoms, an aromatic group having 6 to 36 carbon atoms, or a heterocyclic group having 2 to 36 carbon atoms. Preferably, it is a tertiary alkyl group having 4 to 36 carbon atoms or a group having 7 to 36 carbon atoms and represented by the following formula (D'):

formula (D')

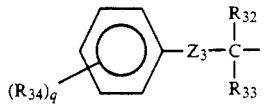

In the formula (D'), $R_{32}$ and $R_{33}$ are either the same or different, and represent hydrogen, an aliphatic group having 1 to 30 carbon atoms, or an aromatic group having 6 to 30 carbon atoms; $R_{34}$ is a monovalent group. $Z_3$ represents —O—, —S—, —SO—, or —$SO_2$—, and q is an integer ranging from 0 to 5. If q is plural, the groups $R_{34}$ can either be the same or different. As a preferable substituent, $R_{32}$ and $R_{33}$ are a straight-chain or branched alkyl group having 1 to 18 carbon atoms, $R_{34}$ is a halogen atom, an aliphatic group, an aliphatic oxy group, a carbonamide, group, a sulfonamide group, carboxy, sulfo, cyano, hydroxyl, a carbamoyl group, a sulfamoyl group, an aliphatic oxycarbonyl group, and an aromatic sulfonyl group, and Z3 is —O—. Here, $R_{34}$ have 0 to 30 carbon atoms, and it is desirable that q ranges 1 to 3.

Ar is a substituted or unsubstituted aryl group, and may be a condensed ring. Typical examples of the substituted group for Ar are: a halogen atom, cyano, nitro, trifluoromethyl group, —$COOR_{35}$, —$COR_{35}$, —$SO_2OR_{35}$, —$NHCOR_{35}$, —$CONR_{35}R_{36}$, —$SO_2N_{35}R_{36}$, —$OR_{35}$, $NR_{35}(OR_{36})$, —$SO_2R_7$, —$SOR_7$, —$OCOR_7$, and —$NR_{35}(SO_2R_{37})$ $R_{35}$ and $R_{36}$ can be the same or different, each being hydrogen, an aliphatic group, an aromatic group, or a heterocyclic group. $R_{37}$ is an aliphatic group, an aromatic group, or a heterocyclic group. Ar has 6 to 30 carbon atoms and is preferably a phenyl group having the substituent specified above.

$X_{31}$ is hydrogen or a coupling split-off group (including a split-off atom). Typical examples of the coupling split-off group are a halogen atom, —$OR_{38}$, —$SR_{38}$, —$OCOR_{38}$, —$NHCOR_{38}$, —$NHCOSR_{38}$, —$OCOOR_{38}$, —$OCONHR_{38}$, an aromatic azo group having 6 to 30 carbon atoms, a heterocyclic group having 1 to 30 carbon atoms and bonding to the coupling active position of the coupler at nitrogen (e.g., succinicimide, phthalimide, hydantoinyl, pyrazoliyl, or 2-benzotriazolyl). Here, $R_{38}$ is an aliphatic group having 1 to 30 carbon atoms, an aromatic group having 6 to 30 carbon atoms, or a heterocyclic group having 2 to 30 carbon atoms.

The aliphatic group described with reference to the formula (D) can be, as mentioned above, a saturated or unsaturated, substituted or unsubstituted group in the form of a straight chain, a branched chain or a ring. Typical examples of the aliphatic group are methyl, ethyl, butyl, cyclohexyl, aryl, propargyl, methoxyethyl, n-decyl, n-dodecyl, n-hexadecyl, trifluoromethyl, heptafluoropropyl, dodecylpropyl, 2,4-di-tert-amyl phenoxypropyl, 2,4-di-tert-amyl phenoxybutyl.

The aromatic group can also be either a substituted or unsubstituted group. Typical examples of the aromatic group are: phenyl, tolyl, 2-tetradecyloxyphenyl, pentafluorophenyl, 2-chloro-5-dodecyl carboxyphenyl, 4-chlorophenyl, 4-cyanophenyl, and 4-hydroxyphenyl.

The heterocyclic group can also be either a substituted or unsubstituted group. Typical examples of the heterocyclic group are: 2-pyridyl, 4-pyridyl, 2-furyl, 4-thienyl, and quinolinyl.

Examples of the substituent in the formula (D) will now be described below.

Preferably as $R_{31}$ are, for example, 1-(2,4-di-tert-amylphenoxy) amyl, 1-(2,4-di-tert-amylphenoxy) heptyl, and t-butyl.

Particularly preferable as Ar are: 4-cyanophenyl, 4-alkylsulfonylphenyl (e.g., 4-methanesulfonamidephenyl, 4-propanesulfonamidephenyl, 4-butanesulfonamide), 4-trifluoromethylphenyl, and halogen-substituted phenyl (e.g., 4-fluorophenyl, 4-chlorophenyl, 4-chloro-3-cyanophenyl, 3,4-dichlorophenyl, 2,4,5-trichlorophenyl).

Preferable as $X_{31}$ is hydrogen, a halogen atom, or $-OR_{38}$. Preferable as $R_{38}$ is carboxyl, sulfo, and alkoxycarbonyl, carbamoyl, sulfamoyl, an alkoxysulfonyl, acyl, an alkylsulfonyl group, an arylsulfonyl group, an alkylsulfinyl group, an arylsulfinyl group, phosphono, or phosphonoyl. More preferable as $R_{38}$ is a group which is represented by the following formula (A):

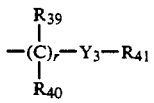

formula (A)

wherein $R_{39}$ and $R_{40}$ are each hydrogen or a monovalent group, $Y_3$ is —CO—, —SO—, —$SO_2$—or $POR_{42}$, $R_{41}$ and $R_{42}$ are each hydroxyl, an alkyl group, an aryl group, an alkoxy group, an alkenyloxy group, an aryloxy group, o substituted or unsubstituted amino group, and r is an integer ranging from 1 to 6.

In the formula (A), if $R_{39}$ and/or $R_{40}$ is a monovalent group, $R_{39}$ and $R_{40}$ are preferably an alkyl group (e.g., methyl, ethyl, n-butyl, ethoxycarbonylmethyl, benzyl, n-decyl, or n-dodecyl), an aryl group (e.g., phenyl, 4-chlorophenyl or 4-methoxyphenyl), an acyl group (e.g., acetyl, decanoyl, bnzoyl or pivaloyl), or a carbamoyl group (e.g., N-ethylcarbamoyl or N-phenylcarbamoyl). More preferably, $R_{39}$ and $R_{40}$ are hydrogen, an alkyl group, or an aryl group. In the formula (A), $Y_3$ is preferably —CO— or —$SO_2$—, more preferably —CO—. Also, in the formula (A), $R_{41}$ is preferably an alkyl group, an alkoxy group, an alkenyl group, an oxy group, an aryloxy group, or a substituted or unsubstituted amino group, more preferably an alkoxy group. In the formula (A), r is preferably an integer of 1 to 3, more preferably 1.

The most preferable as $R_{38}$ is a group which is represented by the following formula (B):

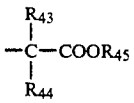

formula (B)

wherein $R_{43}$ and $R_{44}$ are each hydrogen, a substituted or unsubstituted alkyl or aryl group, and $R_{45}$ is a substituted or unsubstituted alkyl, alkenyl or aryl group.

The coupler of the formula (D) can form a dimer, an oligomer, or a polymer, bonded at $R_{31}$, Ar or $X_{31}$ through a divalent or higher-valent group. In this case, each substituent mentioned above can be one having C number which falls outside the range specified above.

Specific examples, (D-1) to (D-25), of the compound presented by the formula (D) are as follows. Nonetheless, the couplers which can be used in the invention are not limited to these.

(D-1)

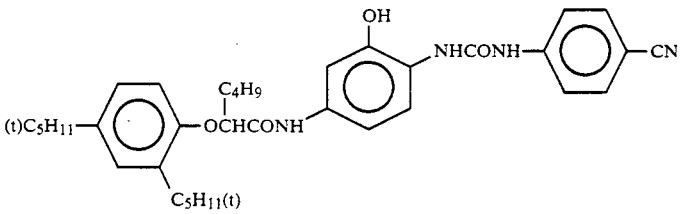

(D-2)

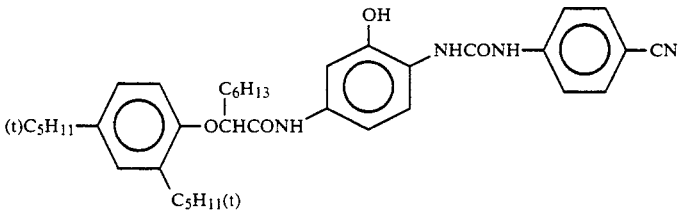

(D-3)

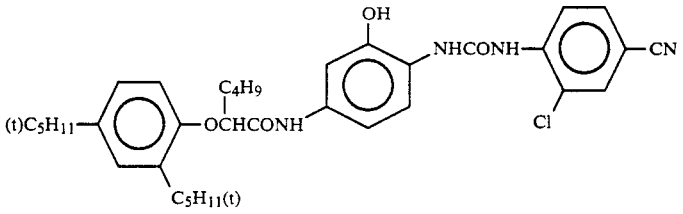

(D-4)

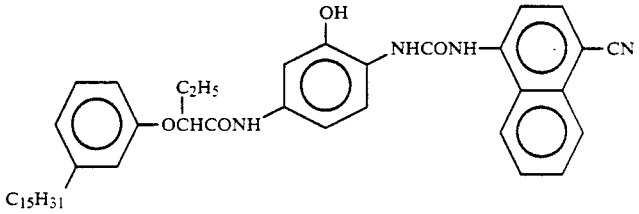

-continued
(D-5)
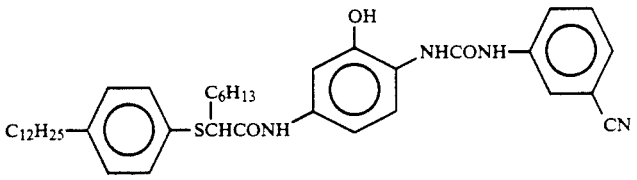
(D-6)
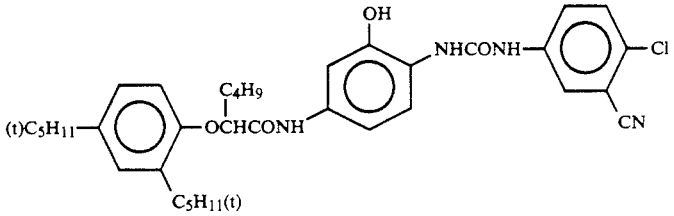
(D-7)
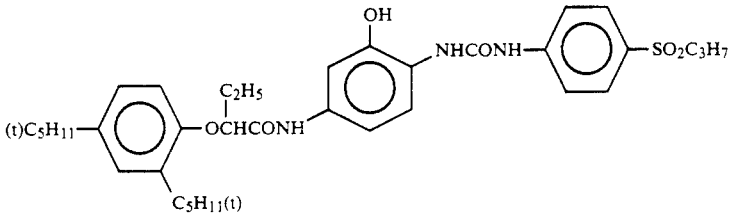
(D-8)
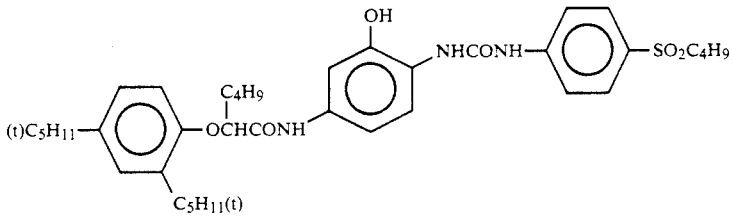
(D-9)
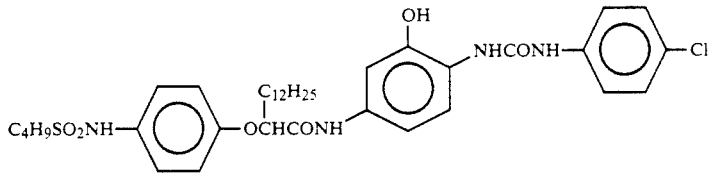
(D-10)
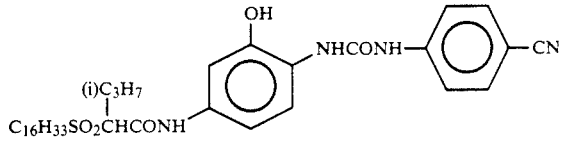
(D-11)
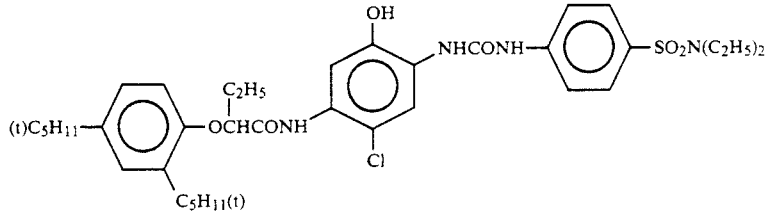

-continued
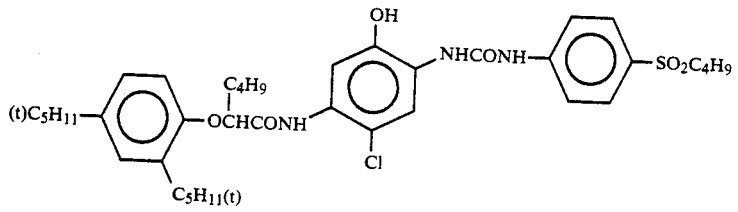
(D-12)
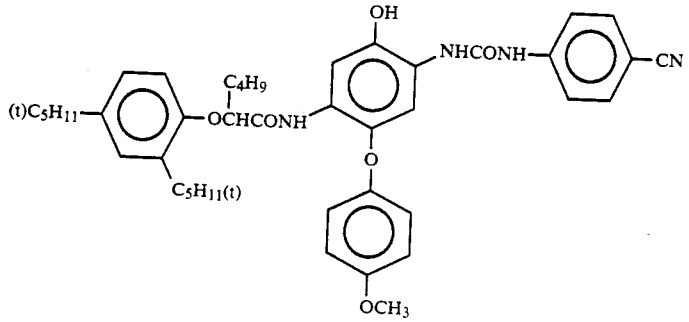
(D-13)
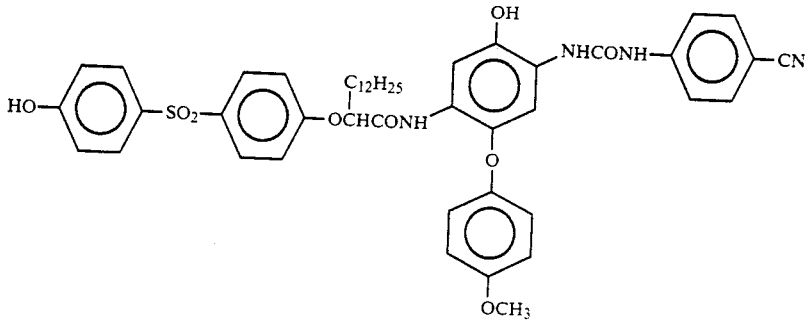
(D-14)
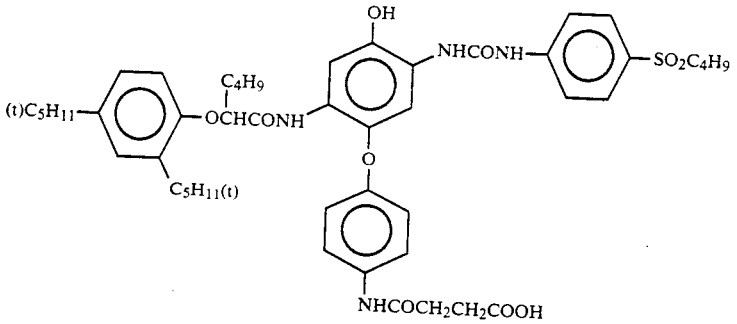
(D-15)
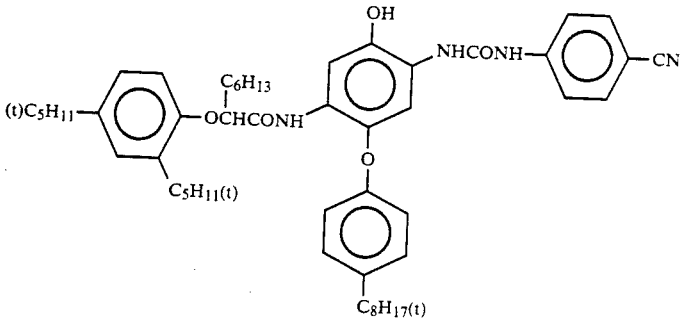
(D-16)

-continued
(D-17)
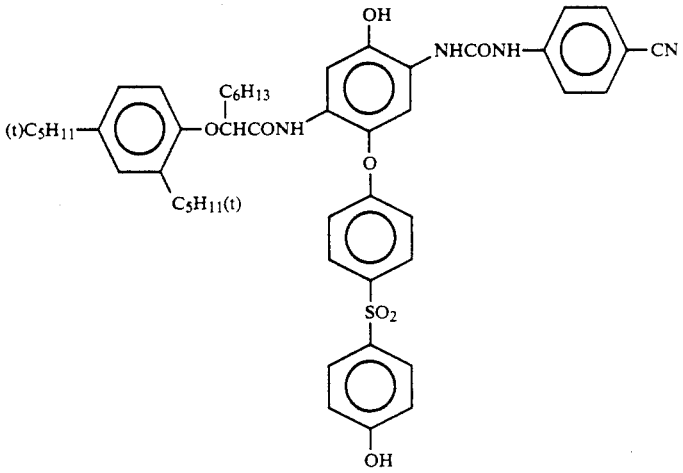
(D-18)
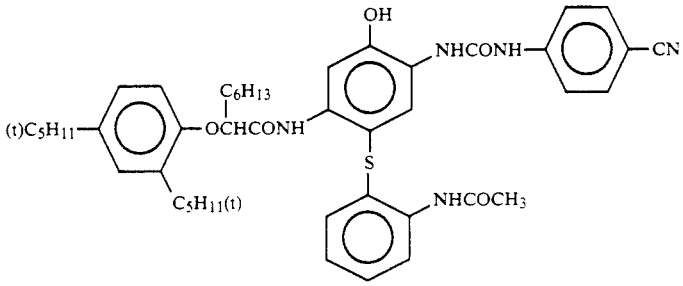
(D-19)
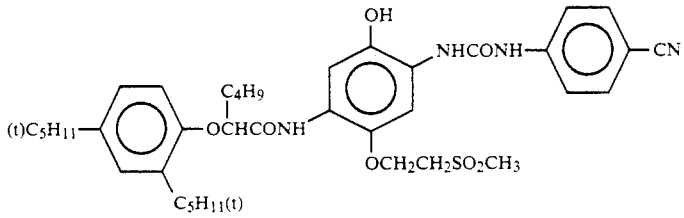
(D-20)
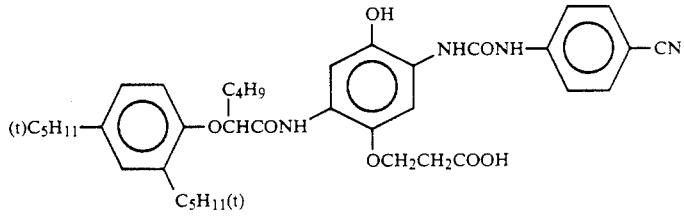
(D-21)
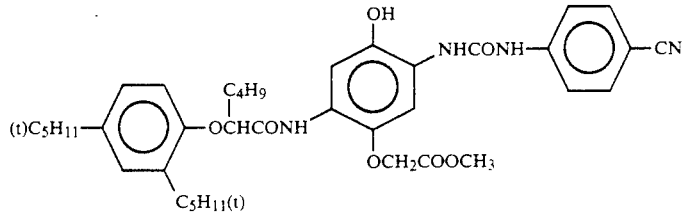

-continued (D-22)

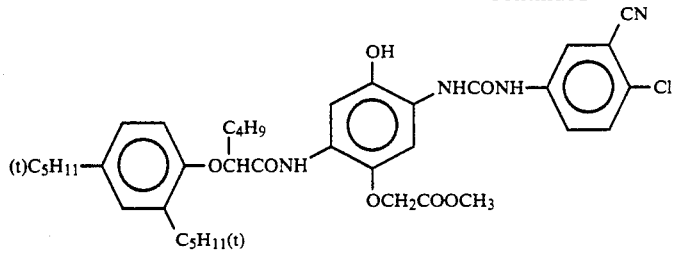

(D-23)

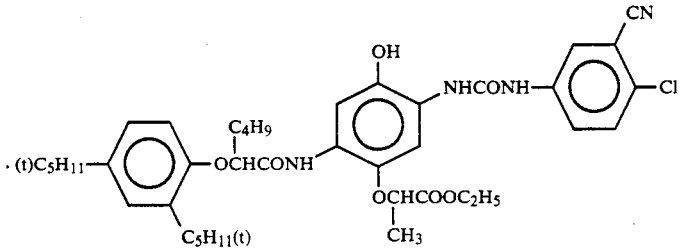

(D-24)

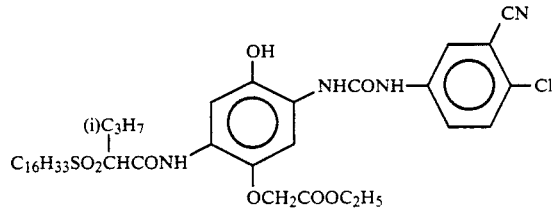

(D-25)

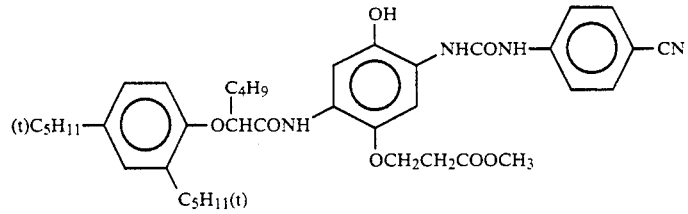

The coupler of the formula (D) can be synthesized by the methods disclosed in, for example, U.S. Pat. Nos. 4,333,999, 4,427,767, JP-A-57-204543, JP-A-57-204544, JP-A-57-204545, JP-A-59-198455, JP-A-60-35731, JP-A-60-37557, JP-A-61-42658, and JP-A-61-75351.

An organic solvent used in the present invention which has a high boiling point is used in an amount of at most 1.0 g per gram of the coupler represented by the formula (D). If the solvent is used in a greater amount, the resultant light-sensitive material will have its sharpness degraded. A preferable amount of the solvent used is 0.50 g or less per gram of the coupler. A more preferable amount is 0.25 g or less per gram of the coupler (that is, no organic solvent can be contained in the coupler).

According to the invention, the cyan coupler of the formula (D) is used in an amount of $1.0\times10^{-5}$ mol/m$^2$ to $3.0\times10^{-3}$ mol/m$^2$ in most cases.

The light-sensitive material of the present invention need only to have at least one of silver halide emulsion layers, i.e., a blue-sensitive layer, a green-sensitive layer, and a red-sensitive layer, formed on a support. The number or order of the silver halide emulsion layers and the non-light-sensitive layers are particularly not limited. A typical example is a silver halide photographic light-sensitive material having, on a support, at least one light-sensitive layers constituted by a plurality of silver halide emulsion layers which are sensitive to essentially the same color sensitivity but has different speed. The layers are unit light-sensitive layer sensitive to blue, green or red. In a multilayered silver halide color photographic light-sensitive material, the unit light-sensitive layers are generally arranged such that red-, green-, and blue-sensitive layers are formed from a support side in the order named. However, this order may be reversed or a layer sensitive to one color may be sandwiched between layers sensitive to another color in accordance with the application.

Non-light-sensitive layers such as various types of interlayers may be formed between the silver halide light-sensitive layers and as the uppermost layer and the lowermost layer.

The interlayer may contain, e.g., couplers and DIR compounds as described in JP-A-61-43748, JP-A-59-113438, JP-A-59-113440, JP-A-61-20037, and JP-A-61-20038 or a color mixing inhibitor which is normally used.

As a plurality of silver halide emulsion layers constituting each unit light-sensitive layer, a two-layered structure of high- and low-speed emulsion layers can be preferably used as described in West German Patent 1,121,470 or British Patent 923,045. In this case, layers are preferably arranged such that the sensitivity is sequentially decreased toward a support, and a non-light-sensitive layer may be formed between the silver halide emulsion layers. In addition, as described in JP-A-57-112751, JP-A-62-200350, JP-A-62-206541, and JP-A-62-

206543, layers may be arranged such that a low-speed emulsion layer is formed remotely from a support and a high-speed layer is formed close to the support.

More specifically, layers may be arranged from the farthest side from a support in an order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), an order of BH/BL/GL/GH/RH/RL, or an order of BH/BL/GH/GL/RL/RH.

In addition, as described in JP-B-55-34932, layers may be arranged from the farthest side from a support in an order of blue-sensitive layer/GH/RH/GL/RL. Furthermore, as described in JP-A-56-25738 and JP-A-62-63936, layers may be arranged from the farthest side from a support in an order of blue-sensitive layer/GL/RL/GH/RH.

As described in JP-B-49-15495, three layers may be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer, i.e., three layers having different sensitivities may be arranged such that the sensitivity is sequentially decreased toward the support. When a layer structure is constituted by three layers having different sensitivities, these layers may be arranged in an order of medium-speed emulsion layer/high-speed emulsion layer/low-speed emulsion layer from the farthest side from a support in a layer sensitive to one color as described in JP-A-59-202464.

In addition, an order of high-speed emulsion layer/-low-speed emulsion layer/medium-speed emulsion layer or low-speed emulsion layer/medium-speed emulsion layer/high-speed emulsion layer may be adopted.

Furthermore, the arrangement can be changed as described above even when four or more layers are formed.

To improve the color reproducibility, a donor layer (CL) of interlayer effect can be arranged near to, or arranged adjacent to, a main light-sensitive layer BL, GL or RL. The donor layer should have a spectral sensitivity distribution which is different from that of the main light-sensitive layer. Donor layers of this type are disclosed in U.S. Pat. Nos. 4,663,271, 4,705,744, 4,707,436, JP-A-62-160448, and JP-A-63-89850.

As described above, various layer configuration and arrangements can be selected in accordance with the application of the light-sensitive material.

A preferable silver halide contained in photographic emulsion layers of the photographic light-sensitive material of the present invention is silver bromoiodide, silver chloroiodide, or silver bromochloroiodide containing about 30 mol % or less of silver iodide. The most preferable silver halide is silver bromoiodide or silver bromochloroiodide containing about 2 mol % to about 10 mol % of silver iodide.

Silver halide grains contained in the photographic emulsion may have regular crystals such as cubic, octahedral, or tetradecahedral crystals, irregular crystals such as spherical or tabular crystals, crystals having crystal defects such as crystal twinning faces, or composite shapes thereof.

The silver halide may consist of fine grains having a grain size of about 0.2 μm or less or large grains having a diameter of a projected surface area of up to about 10 μm, and the emulsion may be either a polydisperse or monodisperse emulsion.

The silver halide photographic emulsion which can be used in the present invention can be prepared by methods described in, for example, Research Disclosure (RD) No. 17,643 (December, 1978), pp. 22 to 23, "I. Emulsion preparation and types", RD No. 18,716 (November, 1979), page 648, and RD No. 307,105 (November, 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

Monodisperse emulsions described in, for example, U.S. Pat. Nos. 3,574,628 and 3,655,394 and British Patent 1,413,748 are also preferred.

Also, tabular grains having an aspect ratio of about 3 or more can be used in the present invention. The tabular grains can be easily prepared by methods described in, e.g., Gutoff, "Photographic Science and Engineering", Vol. 14, PP. 248 to 257 (1970); U.S. Pat. Nos. 4,434,226, 4,414,310, 4,433,048, and 4,439,520, and British Patent 2,112,157.

The crystal structure may be uniform, may have different halogen compositions in the interior and the surface thereof, or may be a layered structure. Alternatively, a silver halide having a different composition may be joined by an epitaxial junction or a compound except for a silver halide such as silver rhodanide or zinc oxide may be joined. A mixture of grains having various types of crystal shapes may be used.

The above emulsion may be of any of a surface latent image type in which a latent image is mainly formed on the surface of each grain, an internal latent image type in which a latent image is formed in the interior of each grain, and a type in which a latent image is formed on the surface and in the interior of each grain. However, the emulsion must be of a negative type. When the emulsion is of an internal latent image type, it may be a core/shell internal latent image type emulsion described in JP-A-63-264740. A method of preparing this core/-shell internal latent image type emulsion is described in JP-A-59-133542. Although the thickness of a shell of this emulsion changes in accordance with development or the like, it is preferably 3 to 40 nm, and most preferably, 5 to 20 nm.

A silver halide emulsion layer is normally subjected to physical ripening, chemical ripening, and spectral sensitization steps before it is used. Additives for use in these steps are described in Research Disclosure Nos. 17,643, 18,716, and 307,105 and they are summarized in the following table A.

In the light-sensitive material of the present invention, two or more types of emulsions different in at least one characteristic of a grain size, a grain size distribution, a halogen composition, a grain shape, and sensitivity can be mixed in one layer.

A surface-fogged silver halide grain described in U.S. Pat. No. 4,082,553, an internally fogged silver halide grain described in U.S. Pat. No. 4,626,498 or JP-A-59-214852, and colloidal silver can be preferably used in a light-sensitive silver halide emulsion layer and/or a substantially non-light-sensitive hydrophilic colloid layer. The internally fogged or surface-fogged silver halide grains are silver halide grains which can be uniformly (non-imagewise) developed in either a non-exposed portion or an exposed portion of the light-sensitive material. A method of preparing the internally fogged or surface-fogged silver halide grain is described in U.S. Pat. No. 4,626,498 or JP-A-59-214852.

A silver halide which forms the core of a internally fogged core/shell type silver halide grain may have the same halogen composition as or a different halogen composition from that of the other portion. Examples of the internally-fogged or surface-fogged silver halide are silver chloride, silver chlorobromide, silver bromoiodide, and silver bromochloroiodide. Although the grain size of these fogged silver halide grains is not particularly limited, an average grain size is 0.01 to 0.75 μm, and most prefer ably, 0.05 to 0.6 μm. The grain shape is also not particularly limited but may be a regular grain shape. Although the emulsion may be a polydisperse emulsion, it is preferably a monodisperse emulsion (in which at least 95% in weight or number of silver halide grains have a grain size falling within the range of 40% of an average grain size).

In the present invention, a non-light-sensitive fine grain silver halide is preferably used. The non-light-sensitive fine grain silver halide means silver halide fine grains not sensitive upon imagewise exposure for obtaining a dye image and essentially not developed in development. The non-light-sensitive fine grain silver halide is preferably not fogged beforehand.

The fine grain silver halide contains 0 to 100 mol % of silver bromide and may contain silver chloride and/or silver iodide as needed. Preferably, the fine grain silver halide contains 0.5 to 10 mol % of silver iodide.

An average grain size (an average value of equivalent-circle diameters of projected surface areas) of the film grain silver halide is preferably 0.01 to 0.5 μm, and more preferably, 0.02 to 2 μm.

The fine grain silver halide can be prepared by a method similar to a method of preparing normal light-sensitive material silver halide. In this preparation, the surface of a silver halide grain need not be subjected to either optical sensitization or spectral sensitization. However, before the silver halide grains are added to a coating solution, a known stabilizer such as a triazole compound, an azaindene compound, a benzothiazolium compound, a mercapto compound, or a zinc compound is preferably added. This fine grain silver halide grain containing layer preferably contains a colloidal silver.

A coating silver amount of the light-sensitive material of the present invention is preferably 6.0 g/m$^2$ or less, and most preferably, 4.5 g/m$^2$ or less.

Known photographic additives usable in the present invention are also described in the above three RDs, and they are summarized in the following Table A:

TABLE A

| Additives | RD17643 Dec., 1978 | RD18716 Nov., 1979 | RD307105 Nov., 1989 |
|---|---|---|---|
| 1. Chemical sensitizers | page 23 | page 648, right column | page 866 |
| 2. Sensitivity increasing agents | | page 648, right column | |
| 3. Spectral sensitizers, super sensitizers | pp. 23–24 | page 648, right column to page 649, right column | pp. 866–868 |
| 4. Brighteners | page 24 | page 647, right column | page 868 |
| 5. Antifoggants and stabilizers | pp. 24–25 | page 649, right column | pp. 868–870 |
| 6. Light absorbent, filter dye, ultraviolet absorbents | pp. 25–26 | page 649, right column to page 650, left column | page 873 |

TABLE A-continued

| Additives | RD17643 Dec., 1978 | RD18716 Nov., 1979 | RD307105 Nov., 1989 |
|---|---|---|---|
| 7. Stain preventing agents | page 25, right column | page 650, left to right columns | page 872 |
| 8. Dye image stabilizer | page 25 | page 650, left column | page 872 |
| 9. Hardening agents | page 26 | page 651, left column | pp. 874–875 |
| 10. Binder | page 26 | page 651, left column | pp. 875–874 |
| 11. Plasticizers, lubricants | page 27 | page 650, right column | page 876 |
| 12. Coating aids, surface active agents | pp. 26–27 | page 650, right column | pp. 875–876 |
| 13. Antistatic agents | page 27 | page 650, right column | pp. 876–877 |
| 14. Matting agent | | | pp. 878–879 |

In order to prevent degradation in photographic properties caused by formaldehyde gas, a compound which can react with formaldehyde and fix described in U.S. Pat. Nos. 4,411,987 or 4,435,503 is preferably added to the light-sensitive material.

The light-sensitive material of the present invention preferably contains mercapto compounds described in U.S. Pat. Nos. 4,740,454 and 4,788,132, JP-A-62-18539, and JP-A-1-283551.

The light-sensitive material of the present invention preferably contains compounds for releasing a fogging agent, a development accelerator, a silver halide solvent, or precursors thereof described in JP-A-1-106052 regardless of a developed silver amount produced by the development.

The light-sensitive material of the present invention preferably contains dyes dispersed by methods described in WO 88/04794 and JP-A-1-502912 or dyes described in EP 317,308A, U.S. Pat. No. 4,420,555, and JP-A-1-259358.

Various color couplers can be used in the present invention, and specific examples of these couplers are described in patents described in above-mentioned Research Disclosure (RD) No. 17643, VII—C to VII-G and RD No. 307105, VII—C to VII-G.

Preferable examples of a yellow coupler are described in, e.g., U.S. Pat. Nos. 3,933,501, 4,022,620, 4,326,024, 4,401,752, and 4,248,961, JP-B-58-10739, British Patents 1,425,020 and 1,476,760, U.S. Pat. Nos. 3,973,968, 4,314,023, and 4,511,649, and EP 249,473A.

Examples of a magenta coupler are preferably 5-pyrazolone and pyrazoloazole compounds, and more preferably, compounds described in, e.g., U.S. Pat. Nos. 4,3,10,619 and 4,351,897, EP 73,636, U.S. Pat. Nos. 3,061,432 and 3,725,067, Research Disclosure No. 24220 (June 1984), JP-A-60-33552, Research Disclosure No. 24230 (June 1984), JP-A-60-43659, JP-A-61-72238, JP-A-60-35730, JP-A-55-118034, and JP-A-60-185951, U.S. Pat. Nos. 4,500,630, 4,540,654, and 4,556,630, and WO No. 88/04795.

Examples of a cyan coupler are, including couplers represented by formula (C) and (D), and preferably, those described in, e.g., U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West-German Patent Disclosure 3,329,729, EP 121,365A and 249,453A, U.S. Pat. Nos. 3,446,622, 4,333,999, 4,775,616, 4,451,559, 4,427,767, 4,690,889, 4,254,212, and 4,296,199, and JP-A-61-42658.

Also, the pyrazoloazole-series couplers disclosed in JP-A-64-553, JP-A-64-554, JP-A-64-555 and JP-A-64-556, and imidazole-series couplers disclosed in U.S. Pat. No. 4,818,672 can be used as cyan coupler in the present invention.

Typical examples of a polymerized dye-forming coupler are described in U.S. Pat. Nos. 3,451,820, 4,080,221, 4,367,282, 4,409,320, and 4,576,910, British Patent 2,102,173, and EP 341,188A.

Preferable examples of a coupler capable of forming colored dyes having proper diffusibility are those described in U.S. Pat. No. 4,366,237, British Patent 2,125,570, EP 96,570, and West German Patent Application (OLS) No. 3,234,533.

Preferable examples of a colored coupler for correcting additional, undesirable absorption of a colored dye are, in addition to the yellow colored cyan coupler of the present invention, those described in Research Disclosure No. 17643, VII-G and No. 307105, VII-G, U.S. Pat. No. 4,163,670, JP-B-57-39413, U.S. Pat. Nos. 4,004,929 and 4,138,258, and British Patent 1,146,368. A coupler for correcting unnecessary absorption of a colored dye by a fluorescent dye released upon coupling described in U.S. Pat. No. 4,774,181 or a coupler having a dye precursor group which can react with a developing agent to form a dye as a split-off group described in U.S. Pat. No. 4,777,120 may be preferably used.

Compounds releasing a photographically useful residue upon coupling are preferably used in the present invention. DIR couplers, i.e., couplers releasing a development restrainer are, in addition to those represented by the formula (I) described in the patents cited in the above-described RD No. 17643, VII-F, RD No. 307105, VII-F, JP-A-57-151944, JP-A-57-154234, JP-A-60-184248, JP-A-63-37346, JP-A-63-37350, and U.S. Pat. Nos. 4,248,962 and 4,782,012.

Research Disclosures Nos. 11449 and 24241, JP-A-61-201247, and the like disclose couplers which release breaching accelerator. These couplers effectively serve to shorten the time of any process that involves breaching. They are effective, particularly when added to light-sensitive material containing tabular silver halide grains. Preferable examples of a coupler for imagewise releasing a nucleating agent or a development accelerator are described in British Patents 2,097,140 and 2,131,188, JP-A-59-157638, and JP-A-59-170840. In addition, compounds for releasing a fogging agent, a development accelerator, or a silver halide solvent upon redox reaction with an oxidized form of a developing agent, described in JP-A-60-107029, JP-A-60-252340, JP-A-1-44940, and JP-A-1-45687, can also be preferably used.

Examples of a coupler which can be used in the light-sensitive material of the present invention are competing couplers described in, e.g., U.S. Pat. No. 4,130,427; poly-equivalent couplers described in, e.g., U.S. Pat Nos. 4,283,472, 4,338,393, and 4,310,618; a DIR redox compound releasing coupler, a DIR coupler releasing coupler, a DIR coupler releasing redox compound, or a DIR redox releasing redox compound described in, e.g., JP-A-60-185950 and JP-A-62-24252; couplers releasing a dye which turns to a colored form after being released described in EP 173,302A and 313,308A; a ligand releasing coupler described in, e.g., U.S. Pat. No. 4,553,477; a coupler releasing a leuco dye described in JP-A-63-75747; and a coupler releasing a fluorescent dye described in U.S. Pat. No. 4,774,181.

The couplers for use in this invention can be added to the light-sensitive material by various known dispersion methods.

Example of a high-boiling solvent to be used in the oil-in-water dispersion method are described in e.g. U.S. Pat. No. 2,322,027. Examples of a high-boiling organic solvent to be used in the oil-in-water dispersion method and having a boiling point of 175° C. or more at atmospheric pressure are phthalic esters (e.g., dibutylphthalate, dicyclohexylphthalate, di-2-ethylhexylphthalate, decylphthalate, bis(2,4-di-t-amylphenyl) phthalate, bis(2,4-di-t-amylphenyl) isophthalate, bis(1,1-di-ethylpropyl) phthalate), phosphates or phosphonates (e.g., triphenylphosphate, tricresylphosphate, 2-ethylhexyldiphenylphosphate, tricyclohexylphosphate, tri-2-ethylhexylphosphate, tridodecylphosphate, tributoxyethylphosphate, trichloropropylphosphate, and di-2-ethylhexylphenylphosphonate), benzoates (e.g., 2-ethylhexylbenzoate, dodecylbenzoate, and 2-ethylhexyl-p-hydroxybenzoate), amides (e.g., N,N-diethyldodecaneamide, N,N-diethyl laurylamide, and N-tetradecylpyrrolidone), alcohols or phenols (e.g., isostearylalcohol and 2,4-di-tert-amylphenol), aliphatic carboxylates (e.g., bis(2-ethylhexyl) sebacate, dioctylazelate, glyceroltri butylate, isostearyllactate, and trioctylcitrate), an aniline derivative (e.g., N,N-dibutyl-2-butoxy-5-tert-octylaniline), and hydrocarbons (e.g., paraffin, dodecylbenzene, and diisopropylnaphthalene). An organic solvent having a boiling point of about 30° C. or more, and preferably, 50° C. to about 160° C. can be used as a auxiliary-solvent. Typical examples of the auxiliary-solvent are ethyl acetate, butyl acetate, ethyl propionate, methylethylketone, cyclohexanone, 2-ethoxyethylacetate, and dimethylformamide.

Steps and effects of a latex dispersion method and examples of a loadable latex are described in, e.g., U.S. Pat. No. 4,199,363 and German Patent Application (OLS) Nos. 2,541,274 and 2,541,230.

Various types of an antiseptic agent or a mildew-proofing agent are preferably added to the color light-sensitive material of the present invention. Examples of the antiseptics and fungicide are phenethyl alcohol, 1,2-benzisothiazoline-3-one, n-butyl-p-hydroxybenzoate, phenol, 4-chloro-3,5-dimethylphenol, 2-phenoxyethanol, and 2-(4-thiazolyl) benzimidazole described in JP-A-63-257747, JP-A-62-272248, and JP-A-1-80941.

The present invention can be applied to various color light-sensitive materials. Examples of the material are a color negative film for a general purpose or a movie, a color reversal film for a.,slide or a television, color paper, a color positive film, and color reversal paper.

A support which can be suitably used in the present invention is described in, e.g., RD. No. 17643, page 28, RD. No. 18716, from the right column, page 647 to the left column, page 648, and RD. No. 307105, page 879.

In the light-sensitive material of the present invention, the sum total of film thicknesses of all hydrophilic colloidal layers at the side having emulsion layers is preferably 28 μm or less, more preferably, 23 μm or less, much more preferably, 18 μm or less, and most preferably, 16 μm or less. A film swell speed T1/2 is preferably 30 sec. or less, and more preferably, 20 sec. or less. The film thickness means a film thickness measured under moisture conditioning at a temperature of 25° C. and a relative humidity of 55% (two days). The film swell speed T1/2 can be measured in accordance with a known method in the art. For example, the film swell speed T1/2 can be measured by using a swell meter described in Photographic Science & Engineering, A. Green et al., Vol. 19, No. 2, pp. 124 to 129. When 90% of a maximum swell film thickness reached by performing a treatment by using a color developing agent at 30° C. for 3 min. and 15 sec. is defined as a saturated film thickness, T1/2 is defined as a time required for reaching ½ of the saturated film thickness.

The film swell speed T1/2 can be adjusted by adding a film hardening agent to gelatin as a binder or changing aging conditions after coating. A swell ratio is preferably 150% to 400%. The swell ratio is calculated from the maximum swell film thickness measured under the above conditions in accordance with a relation : (maximum swell film thickness - film thickness)/film thickness.

In the light-sensitive material of the present invention, hydrophilic colloid layers (called back layers) having a total dried film thickness of 2 to 20 μm are preferably formed on the side opposite to the side having emulsion layers. The back layers preferably contain, e.g., the light absorbent, the filter dye, the ultraviolet absorbent, the antistatic agent, the film hardener, the binder, the plasticizer, the lubricant, the coating aid, and the surfactant described above. The swell ratio of the back layers is preferably 150% to 500%.

The color photographic light-sensitive material according to the present invention can be developed by conventional methods described in RD. No. 17643, pp. 28 and 29, RD. No. 18716, the left to right columns, page 651, and RD. No. 307105, pp. 880 and 881.

A color developer used in development of the light-sensitive material of the present invention is an aqueous alkaline solution containing as a main component, preferably, an aromatic primary amine-based color developing agent. As the color developing agent, although an aminophenol-based compound is effective, a p-phenylenediamine-based compound is preferably used. Typical examples of the p-phenylenediamine-based compound are: 3-methyl-4-amino-N,N-diethylaniline, 3-methyl-4-amino-N-ethyl-N-β-hydroxyethylaniline, 3-methyl-4-amino-N-ethyl-N-β-methanesulfonamide ethylaniline, 3-methyl-4-amino-N-ethyl-β-methoxyethyl aniline, 4-amino-3-methyl-N-methyl-N-(3-hydroxypropyl) aniline, 4-amino-3-methyl-N-ethyl-N-(3-hydroxypropyl) aniline, 4-amino-3-methyl-N-ethyl-N-(2-hydroxypropyl) aniline, 4-amino-3-ethyl-N-ethyl-N-(3-hydroxypropyl) aniline, 4-amino-3-methyl-N-propyl-N-(3-hydroxypropyl) aniline, 4-amino-3-propyl-N-methyl-N-(3-hydroxypropyl) aniline, 4-amino-3-methyl-N-methyl-N-(4-hydroxybutyl) aniline, 4-amino-3-methyl-N-ethyl-N-(4-hydroxybutyl) aniline, 4-amino-3-methyl-N-propyl-N-(4-hydroxybutyl) aniline, 4-amino-3-methyl-N-ethyl-N-(3-hydroxy-2-methylpropyl) aniline, 4-amino-3-methyl-N,N-bis(4-hydroxybutyl) aniline, 4-amino-3-methyl-N,N-bis(5-hydroxypentyl) aniline, 4-amino-3-methyl-N-(5-hydroxy pentyl)-N-(4-hydroxybutyl) aniline, 4-amino-3-methoxy-N-ethyl-N-(4-hydroxybutyl) aniline, 4-amino-3-ethoxy-N,N-bis(5-hydroxypentyl) aniline, 4-amino-N-propyl-N-(4-hydroxybutyl) aniline, 4-amino-3-methyl-N-propyl-N-(2-hydroxyethyl) aniline and sulfates, hydrochlorides and p-toluenesulfonates thereof. Of these compounds, 4-amino-3-methyl-N-propyl-N-(2-hydroxyethyl) aniline, 4-amino-3-methyl-N-ethyl-N-(3-hydroxypropyl) aniline, 4-amino-3-methyl-N-ethyl-N-(3-hydroxybutyl) aniline, 4-amino-3-methyl-N-propyl-N-(3-hydroxypropyl) aniline and the sulfates, hydrochlorides or p-toluenesulfonates thereof are more preferable. Further, 4-amino-3-methyl-N-ethyl-(3-hydroxybutyl) aniline and its salt are particularly preferred since they impart high coloring property to the light-sensitive material, and make the material thoroughly developed even if the developing time is relatively short. These compounds can be used in a combination of two or more thereof in accordance with the application.

In general, the color developer contains a pH buffering agent such as a carbonate, a borate, or a phosphate of an alkali metal, and a development restrainer or an antifoggant such as a chloride, a bromide, an iodide, a benzimidazole, a benzothiazole, or a mercapto compound. If necessary, the color developer may also contain a preservative such as hydroxylamine, diethylhydroxylamine, a sulfite, a hydrazine such as N,N-biscarboxymethyl hydrazine, a phenylsemicarbazide, triethanolamine, or a catechol sulfonic acid; an organic solvent such as ethyleneglycol or diethyleneglycol; a development accelerator such as benzylalcohol, polyethyleneglycol, a quaternary ammonium salt or an amine; a dye-forming coupler; a competing coupler; an auxiliary developing agent such as 1-phenyl-3- pyrazolidone; a viscosity-imparting agent; and a chelating agent such as aminopolycarboxylic acid, an aminopolyphosphonic acid, an alkylphosphonic acid, or a phosphonocarboxylic acid. Examples of the chelating agent are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediamine-di(o-hydroxyphenylacetic acid), and salts thereof.

In order to perform reversal development, black-and-white development is performed and then color development is performed. As a black-and-white developer, well-known black-and-white developing agents, e.g., a dihydroxybenzene such as hydroquinone, a 3-pyrazolidone such as 1-phenyl-3-pyrazolidone, and an aminophenol such as N-methyl-p-aminophenol can be singly or in a combination of two or more thereof. The pH of the color and black-and-white developers is generally 9 to 12. Although a quantity of replenisher of the developer depends on a color photographic light-sensitive material to be processed, it is generally 3 liters or less per $m^2$ of the light-sensitive material. The quantity of replenishment can be decreased to be 500 ml or less by decreasing a bromide ion concentration in a replenisher. In order to decrease the replenisher, a contact area of a processing tank with air is preferably decreased to prevent evaporation and oxidation of the solution upon contact with air.

The contact area of the solution with air in a processing tank can be represented by an aperture efficiency defined below:

Aperture efficiency = [the value of contact area of processing solution with air represented by $cm^2$ unit]/[the value of volume of processing solution represented by $cm^3$ unit]

The above aperture efficiency is preferably 0.1 or less, and more preferably, 0.001 to 0.05. In order to reduce the aperture efficiency, a shielding member such as a floating cover may be provided on the surface of the photographic processing solution in the processing tank. In addition, a method of using a movable cover described in JP-A-1-82033 or a slit developing method described in JP-A-63-216050 may be used. The aperture efficiency is preferably reduced not only in color and black-and-white development steps but also in all subsequent steps, e.g., bleaching, bleach-fixing, fixing, washing, and stabilizing steps. In addition, a quantity of replenisher can be reduced by using a means of suppressing storage of bromide ions in the developing solution.

A color development time is normally 2 to 5 minutes. The processing time, however, can be shortened by setting a high temperature and a high pH and using the color developing agent at a high concentration.

The photographic emulsion layer is generally subjected to bleaching after color development. The bleaching may be performed either simultaneously with fixing (bleach-fixing) or independently thereof. In addition, in order to increase a processing speed, bleach-fixing may be performed after bleaching. Also, processing may be performed in a bleach-fixing bath having two continuous tanks, fixing may be performed before bleach-fixing, or bleaching may be performed after bleach-fixing, in accordance with the application. Examples of the bleaching agent are a compound of a multivalent metal, e.g., iron(III), peroxides; quinones; and a nitro compound. Typical examples of the bleaching agent are an organic complex salt of iron(III), e.g., a complex salt of an aminopolycarboxylic acid such as ethylenediaminetetraacetic acid, diethylenetriaminepentaacetic acid, cyclohexanediamine-tetraacetic acid, methyliminodiacetic acid, and 1,3-diaminopropanetetraacetic acid, and glycoletherdiaminetetraacetic acid; or a complex salt of citric acid, tartaric acid, or malic acid. Of these compounds, an iron(III) complex salt of aminopolycarboxylic acid such as an iron(III) complex salt of ethylenediaminetetraacetic acid or 1,3-diaminopropanetetraacetic acid is preferred because it can increase a processing speed and prevent an environmental contamination. The iron(III) complex salt of aminopolycarboxylic acid is useful in both the bleaching and bleach-fixing solutions. The pH of the bleaching or bleach-fixing solution using the iron(III) complex salt of aminopolycarboxylic acid is normally 4.0 to 8. In order to increase the processing speed, however, processing can be performed at a lower pH.

A bleaching accelerator can be used in the bleaching solution, the bleach-fixing solution, and their pre-bath, if necessary. Useful examples of the bleaching accelerator are: compounds having a mercapto group or a disulfide group described in, e.g., U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, and JP-A-53-141623, and JP-A-53-28426, and Research Disclosure No. 17,129 (July, 1978); a thiazolidine derivative described in JP-A-50-140129; thiourea derivative described in JP-B-45-8506, JP-A-52-20832, JP-A-53-32735 and U.S. Pat. No. 3,706,561, iodide salts described in West German Patents 1,127,715 and JP-A-58-16235; polyoxyethylene compounds descried in West German Patents 966,410 and 2,748,430; a polyamine compound described in JP-B-45-8836; compounds descried in JP-A-49-40943, JP-A-49-59644, JP-A-53-94927, JP-A-54-35727, JP-A-55-26506, and JP-A-58-163940; and a bromide ion. Of these compounds, a compound having a mercapto group or a disulfide group is preferable since the compound has a large accelerating effect. In particular, compounds described in U.S. Pat. No. 3,893,858, West German Patent 1,290,812, and JP-A-53-95630 are preferred. A compound described in U.S. Pat. No. 4,552,834 is also preferable. These bleaching accelerators may be added in the light-sensitive material. These bleaching accelerators are useful especially in bleach-fixing of a photographic color light-sensitive material.

The bleaching solution or the bleach-fixing solution preferably contains, in addition to the above compounds, an organic acid in order to prevent a bleaching stain. The most preferable organic acid is a compound having an acid dissociation constant (pKa) of 2 to 5, e.g., acetic acid, propionic acid or hydroxy acetic acid.

Examples of the fixing solution or the bleach-fixing solution are thiosulfate, a thiocyanate, a thioether-based compound, a thiourea and a large amount of an iodide. Of these compounds, a thiosulfate, especially, ammonium thiosulfate can be used in the widest range of applications. In addition, a combination of thiosulfate and a thiocyanate, a thioether-based compound, or thiourea is preferably used. As a preservative of the fixing solution and the bleach-fixing solution, a sulfite, a bisulfite, a carbonyl bisulfite adduct, or a sulfinic acid compound described in EP 294,769A is preferred. In addition, in order to stabilize the fixing solution or the bleach-fixing solution, various types of aminopolycarboxylic acids or organic phosphonic acids are preferably added to the solution.

In the present invention, 0.1 to 10 mol/l of a compound having a pKa of 6.0 to 9.0 are preferably added to the fixing solution or the bleach-fixing solution in order to adjust the pH. Preferable examples of the compound are imidazoles such as imidazole, 1-methylimidazole, 1-ethylimidazole, and 2-methylimidazole.

The total time of a desilvering step is preferably as short as possible as long as no desilvering defect occurs. A preferable time is one to three minutes, and more preferably, one to two minutes. A processing temperature is 25° C. to 50° C., and preferably, 35° C. to 45° C. Within the preferable temperature range, a desilvering speed is increased, and generation of a stain after the processing can be effectively prevented.

In the desilvering step, stirring is preferably as strong as possible. Examples of a method of intensifying the stirring are a method of colliding a jet stream of the processing solution against the emulsion surface of the light-sensitive material described in JP-A-62-183460, a method of increasing the stirring effect using rotating means described in JP-A-62-183461, a method of moving the light-sensitive material while the emulsion surface is brought into contact with a wiper blade provided in the solution to cause disturbance on the emulsion surface, thereby improving the stirring effect, and a method of increasing the circulating flow amount in the overall processing solution. Such a stirring improving means is effective in any of the bleaching solution, the bleach-fixing solution, and the fixing solution. It is assumed that the improvement in stirring increases the speed of supply of the bleaching agent and the fixing agent into the emulsion film to lead to an increase in desilvering speed. The above stirring improving means is more effective when the bleaching accelerator is used, i.e., significantly increases the accelerating speed or eliminates fixing interference caused by the bleaching accelerator.

An automatic developing machine for processing the light-sensitive material of the present invention preferably has a light-sensitive material conveyer means described in JP-A-60-191257, JP-A-60-191258, or JP-A-60-191259. As described in JP-A-60-191257, this conveyer means can significantly reduce carry-over of a processing solution from a pre-bath to a post-bath, thereby effectively preventing degradation in performance of the processing solution. This effect significantly shortens especially a processing time in each processing step and reduces a quantity of replenisher of a processing solution.

The photographic light-sensitive material of the present invention is normally subjected to washing and/or stabilizing steps after desilvering. An amount of water used in the washing step can be arbitrarily determined over a broad range in accordance with the properties (e.g., a property determined by used materials such as a coupler) of the light-sensitive material, the application of the material, the temperature of the water, the number of water tanks (the number of stages), a replenishing scheme representing a counter or forward current, and other conditions. The relationship between the amount of water and the number of water tanks in a multi-stage counter-current scheme can be obtained by a method described in "Journal of the Society of Motion Picture and Television Engineering", Vol. 64, PP. 248–253 (May, 1955). In the multi-stage counter-current scheme disclosed in this reference, the amount of water used for washing can be greatly decreased. Since washing water stays in the tanks for a long period of time, however, bacteria multiply and floating substances may be adversely attached to the light-sensitive material. In order to solve this problem in the process of the color photographic light-sensitive material of the present invention, a method of decreasing calcium and magnesium ions can be effectively utilized, as described in JP-A-62-288838. In addition, a germicide such as an isothia zolone compound and cyabendazole described in JP-A-57-8542, a chlorine-based germicide such as chlorinated sodium isocyanurate, and germicides such as benzotriazole described in Hiroshi Horiguchi et al., "Chemistry of Antibacterial and Antifungal Agents", (1986), Sankyo Shuppan, Eiseigijutsu-Kai ed., "Sterilization, Antibacterial, and Antifungal Techniques for Microorganisms", (1982), Kogyogijutsu-Kai, and Nippon Bokin Bokabi Gakkai ed., "Dictionary of Antibacterial and Antifungal Agents", (1986), can be used.

The pH of the water for washing the photographic light-sensitive material of the present invention is 4 to 9, and preferably, 5 to 8. The water temperature and the washing time can vary in accordance with the properties and applications of the light-sensitive material. Normally, the washing time is 20 seconds to 10 minutes at a temperature of 15° C. to 45° C., and preferably, 30 seconds to 5 minutes at 25° C. to 40° C. The light-sensitive material of the present invention can be processed directly by a stabilizing agent in place of washing. All known methods described in JP-A-57-8543, JP-A-58-14834, and JP-A-60-220345 can be used in such stabilizing processing.

In some cases, stabilizing is performed subsequently to washing. An example is a stabilizing bath containing a dye stabilizing agent and a surface-active agent to be used as a final bath of the photographic color light-sensitive material.

An overflow solution produced upon washing and/or replenishment of the stabilizing solution can be reused in another step such as a desilvering step.

In the processing using an automatic developing machine or the like, if each processing solution described above is condensed by evaporation, water is preferably added to correct condensation.

The silver halide color light-sensitive material of the present invention may contain a color developing agent in order to simplify processing and increases a processing speed. For this purpose, various types of precursors of a color developing agent can be preferably used. Examples of the precursor are an indoaniline-based compound described in U.S. Pat. No. 3,342,597, Schiff base compounds described in U.S. Pat. No. 3,342,599 and Research Disclosure (RD) Nos. 14,850 and 15,159, an aldol compound described in RD No. 13,924, a metal salt complex described in U.S. Pat. No. 3,719,492, and an urethane-based compound described in JP-A-53-135628.

The silver halide color light-sensitive material of the present invention may contain various 1-phenyl-3-pyrazolidones in order to accelerate color development, if necessary. Typical examples of the compound are described in JP-A-56-64339, JP-A-57-144547, and JP-A-58-115438.

Each processing solution in the present invention is used at a temperature of 10° C. to 50° C. Although a normal processing temperature is 33° C. to 38° C., processing may be accelerated at a higher temperature to shorten a processing time, or image quality or stability of a processing solution may be improved at a lower temperature.

The silver halide light-sensitive material of the present invention can be applied to thermal development light-sensitive materials described in, for example, U.S. Pat. No. 4,500,626, JP-A-60-133449, JP-A-59-218443, JP-A-61-238056, and EP 210,660A2.

Stabilizing solutions which can be preferably used in the present invention will now be described.

It is desirable that any stabilizing solution used in the invention contain substantially no formaldehyde. The phrase "substantially no formaldehyde" means that the solution can contain free formaldehyde and its hydrate used in the total amount of 0.003 mol or less per liter of the stabilizing solution. A stabilizing solution containing substantially no formaldehyde inhibits the scattering of formaldehyde vapor during the developing process.

For the purpose of stabilizing the magenta dye, it is desirable that the stabilizing solution, the bleaching solution, or the pre-bath contain a formaldehyde-releasing compound. Preferable examples of the formaldehyde-releasing compound are hexamethylene tetramine, a drivative thereof, a formaldehyde bissulfite adducts, and an N-methylol compound. These compounds not only stabilize the magenta dye, but also inhibit the generating of yellow stain according to the passage of time.

The hexamethylene tetramine and its derivative can be the compounds described in "Beilsteins Handbuch der Organischen Chemie," IIth Revised Edition, Vol. 26, p. 212. Hexamethylene tetramine is preferable.

Preferable as formaldehyde bisulfite adduct is sodium bisulite.

Preferred examples of the N-methylol compound are the N-methylol compound of pyrazole and a derivative thereof, the N-methylol compound of triazole and a derivative thereof, and the N-methylol compound of urazole and a derivative thereof.

Of the formaldehyde-releasing compounds specified above, particularly preferable are hexamethylene tetramine, formaldehyde sodium bisulfite, and the preferred examples of N-methylol compound. Further, of these preferable formaldehyde-releasing compounds, preferable are the N-methylol compound of pyrazole and a derivative thereof, the N-methylol compound of triazole and a derivative thereof, and the N-methylol compound of urazole and a derivative thereof.

Specific examples of these N-methylol compounds are:

1-hydroxymethyl pyrazole
1-hydroxymethyl-2-methyl pyrazole
1-hydroxymethyl-2,4-dimethyl pyrazole
1-hydroxymethyl triazole
1-hydroxymethyl urazole.

The most preferable of the N-methylol compounds specified above is 1-hydroxymethyl pyrazole.

The above-mentioned N-methylol compounds can be synthesized with easy, by reacting formaldehyde or paraformaldehyde with an amine compound having no methylol groups.

When any N-methylol compound described above is used, it is desirable that the process solution contain an amine compound having no methylol groups, too. Such an amine compound should be used, preferably in a mol concentration 0.2 to 10 times higher than that of the N-methylol compound.

The formaldehyde-releasing compounds, described above, are used in an amount of preferably 0.003 to 0.2 mol, more preferably 0.005 to 0.5 mol, per liter of the process solution. They can be used in the bath of the process solution, either singly or in combination.

The present invention will be described in more detail below by way of its examples, but the present invention is not limited to these examples.

EXAMPLE 1

A plurality of layers having the following compositions were coated on an undercoated triacetylcellulose film support, forming a multilayered color light-sensitive material (hereinafter referred to as "Sample 1").

Compositions of light-sensitive layers

Numerals corresponding to each component indicates a coating amount represented in units of g/m$^2$. The coating amount of a silver halide is represented by the coating amount of silver. The coating amount of a sensitizing dye is represented in units of moles per mole of a silver halide in the same layer.

Sample 1

| | |
|---|---|
| Layer 1: Antihalation layer | |
| Black colloidal silver | silver 0.18 |
| Gelatin | 0.80 |
| Layer 2: Interlayer | |
| 2,5-di-t-pentadecylhydroquinone | 0.18 |
| EX-1 | 0.05 |
| EX-12 | $2.0 \times 10^{-3}$ |
| U-1 | 0.060 |
| U-2 | 0.080 |
| U-3 | 0.10 |
| HBS-1 | 0.10 |
| HBS-2 | 0.020 |
| Gelatin | 0.60 |
| Layer 3: 1st red-sensitive emulsion layer | |
| Silver bromoiodide emulsion A | silver 0.15 |
| Silver bromoiodide emulsion B | silver 0.45 |
| Sensitizing dye I | $6.9 \times 10^{-5}$ |
| Sensitizing dye II | $1.8 \times 10^{-5}$ |
| Sensitizing dye III | $3.1 \times 10^{-4}$ |
| EX-2 | 0.17 |
| EX-15 | 0.010 |
| Yellow-colored cyan coupler (YC-55) | 0.010 |
| Ex-14 | 0.17 |

-continued

| | |
|---|---|
| U-1 | 0.070 |
| U-2 | 0.050 |
| U-3 | 0.070 |
| HBS-1 | 0.060 |
| Gelatin | 0.87 |
| Layer 4: 2nd red-sensitive emulsion layer | |
| Silver bromoiodide emulsion G | silver 1.20 |
| Sensitizing dye I | $5.1 \times 10^{-5}$ |
| Sensitizing dye II | $1.4 \times 10^{-5}$ |
| Sensitizing dye III | $2.3 \times 10^{-4}$ |
| EX-2 | 0.20 |
| Ex-3 | 0.050 |
| Yellow-colored cyan coupler (YC-55) | 0.045 |
| EX-14 | 0.20 |
| EX-15 | 0.050 |
| U-1 | 0.070 |
| U-2 | 0.050 |
| U-3 | 0.070 |
| Gelatin | 1.30 |
| Layer 5: 3rd red-sensitive emulsion layer | |
| Silver bromoiodide emulsion D | silver 1.60 |
| Sensitizing dye I | $5.4 \times 10^{-5}$ |
| Sensitizing dye II | $1.4 \times 10^{-5}$ |
| Sensitizing dye III | $2.4 \times 10^{-4}$ |
| Yellow-colored cyan coupler (YC-55) | 0.010 |
| EX-16 | 0.040 |
| EX-2 | 0.060 |
| EX-3 | 0.010 |
| EX-4 | 0.080 |
| EX-15 | 0.010 |
| HBS-1 | 0.10 |
| HBS-2 | 0.03 |
| Gelatin | 1.10 |
| Layer 6: Interlayer | |
| EX-5 | 0.010 |
| EX-17 | 0.020 |
| HBS-1 | 0.020 |
| Gelatin | 0.6 |
| Layer 7: 1st green-sensitive emulsion layer | |
| Silver bromoiodide emulsion A | silver 0.10 |
| Silver bromoiodide emulsion B | silver 0.25 |
| Sensitizing dye IV | $3.0 \times 10^{-5}$ |
| Sensitizing dye V | $1.0 \times 10^{-4}$ |
| Sensitizing dye VI | $3.8 \times 10^{-4}$ |
| EX-1 | 0.021 |
| EX-6 | 0.26 |
| Ex-7 | 0.030 |
| Ex-8 | 0.025 |
| HBS-1 | 0.10 |
| HBS-3 | 0.010 |
| Gelatin | 0.63 |
| Layer 8: 2nd green-sensitive emulsion layer | |
| Silver bromoiodide emulsion C | silver 0.45 |
| Sensitizing dye IV | $2.1 \times 10^{-5}$ |
| Sensitizing dye V | $7.0 \times 10^{-5}$ |
| Sensitizing dye VI | $2.6 \times 10^{-4}$ |
| EX-6 | 0.094 |
| Ex-7 | 0.026 |
| Ex-8 | 0.018 |
| HBS-1 | 0.16 |
| HBS-3 | $8.0 \times 10^{-3}$ |
| Gelatin | 0.50 |
| Layer 9: 3rd green-sensitive emulsion layer | |
| Silver bromoiodide emulsion E | silver 1.00 |
| Sensitizing dye IV | $3.5 \times 10^{-5}$ |
| Sensitizing dye V | $8.0 \times 10^{-5}$ |
| Sensitizing dye VI | $3.0 \times 10^{-4}$ |
| EX-1 | 0.013 |
| Ex-11 | 0.065 |
| Ex-13 | 0.019 |
| HBS-1 | 0.10 |
| HBS-2 | 0.05 |
| Gelatin | 0.80 |
| Layer 10: Yellow filter layer | |
| Yellow colloidal silver | silver 0.050 |
| EX-5 | 0.080 |
| HBS-1 | 0.030 |
| Gelatin | 0.50 |
| Layer 11: 1st blue-sensitive emulsion layer | |
| Silver bromoiodide emulsion A | silver 0.080 |

-continued

| | |
|---|---|
| Silver bromoiodide emulsion B | silver 0.070 |
| Silver bromoiodide emulsion F | silver 0.070 |
| Sensitizing dye VII | $3.5 \times 10^{-4}$ |
| EX-8 | 0.042 |
| Ex-9 | 0.72 |
| HBS-1 | 0.28 |
| Gelatin | 1.10 |
| Layer 12: 2nd blue-sensitive emulsion layer | |
| Silver bromoiodide emulsion G | silver 0.45 |
| Sensitizing dye VII | $2.1 \times 10^{-4}$ |
| EX-9 | 0.15 |
| Ex-10 | $7.0 \times 10^{-3}$ |
| HBS-1 | 0.050 |
| Gelatin | 0.78 |
| Layer 13: 3rd blue-sensitive emulsion layer | |
| Silver bromoiodide emulsion H | silver 0.77 |
| Sensitizing dye VII | $2.2 \times 10^{-4}$ |
| EX-9 | 0.20 |
| HBS-1 | 0.070 |
| Gelatin | 0.55 |
| Layer 14: 1st protective layer | |
| Silver bromoiodide emulsion I | silver 0.20 |
| U-4 | 0.11 |
| U-5 | 0.17 |
| HBS-1 | $5.0 \times 10^{-2}$ |
| Gelatin | 1.00 |
| Layer 15: 2nd protective layer | |
| H-1 | 0.40 |
| B-1 (diameter: 1.7 μm) | $5.0 \times 10^{-2}$ |
| B-2 (diameter: 1.7 μm) | 0.10 |
| B-3 | 0.10 |
| S-1 | 0.20 |
| Gelatin | 0.60 |

Further, all layers of Sample 1 contained W-1, W-2, W-3, B-4, B-5, F-1, F-2, F-3, F-4, F-5, F-6, F-7, F-8, F-9, F-10, F-11, F-12, F-13, iron salt, lead salt, gold salt, platinum salt, iridium salt, and rohdium salt, so that they may have improved storage stability, may be more readily processed, may be more resistant to pressure, more antibacterial and more antifungal, may be better protected against electrical charging, and may be more readily coated.

Samples 2 to 5

Samples 2 to 5 were prepared which were equal to Sample 1, except that layers 3, 4 and 5 did not contain yellow cyan coupler (YC-55), but other yellow cyan couplers specified in Table 1 and used in the same mole amount as the coupler (YC-55).

Sample 6

Sample 6 was prepared which was equal to Sample 1, except that the layers 3, 4 and 5 contained no yellow cyan couplers, and contained the compound (1) in an amount of 0.002 g/m$^2$, an amount of 0.020 g/m$^2$, and an amount of 0.030 g/m$^2$, respectively.

Samples 7 to 10

Samples 7 to 10 were prepared which were equal to Sample 6, except that the compound (1) was replaced by the other compounds specified in Table 1. The compounds were used in the same mole amount as the compound (1) in Samples 7 to 10, respectively.

Samples 11 to 15

Samples 11 to 15 were prepared in each of which the layers 3, 4 and 5 contained the yellow-colored cyan couplers specified in Table 1.

Samples 16 to 23

Samples 16 to 23 were prepared which were equal to Sample 15, except that the compound (4) was replaced by the other compounds specified in Table 1. The compounds were used in the same mole amount as the compound (4) in Samples 16 to 23, respectively.

TABLE 1

| | of Layers 3-5 | |
|---|---|---|
| Sample | Yellow-Colored Cyan Coupler | DIR Compound |
| 1 (Comparative) | YC-55 | — |
| 2 (Comparative) | YC-47 | — |
| 3 (Comparative) | YC-42 | — |
| 4 (Comparative) | YC-28 | — |
| 5 (Comparative) | YC-26 | — |
| 6 (Comparative) | — | (1) |
| 7 (Comparative) | — | (5) |
| 8 (Comparative) | — | (6) |
| 9 (Comparative) | — | (9) |
| 10 (Comparative) | — | (4) |
| 11 (Invention) | YC-55 | " |
| 12 (Invention) | YC-47 | " |
| 13 (Invention) | YC-42 | " |
| 14 (Invention) | YC-28 | " |
| 15 (Invention) | YC-26 | " |
| 16 (Invention) | " | (1) |
| 17 (Invention) | " | (5) |
| 18 (Invention) | " | (6) |
| 19 (Invention) | " | (9) |
| 20 (Comparative) | " | EX-18 |
| 21 (Comparative) | " | EX-19 |
| 22 (Comparative) | " | EX-20 |
| 23 (Comparative) | " | EX-21 |

Samples 1 to 23 of a first set, thus prepared were subjected to blue uniform exposure and red-imagewise exposure. Then, the samples were color-developed by the method, the details of which are specified below. Next, color turbidity was measured at several points on each sample thus color-developed. The color turbidity at each point was the values of the yellow density measured at cyan densities 0.5, 1.0 and 2.0 subtracted from the yellow density measured at cyan fogging density.

Also, pattern white exposure for the measurement of MTF values was performed on a second set of Samples 1 to 23. The samples of the second set were then color-developed by the method specified below, thereby measuring MTF values of the samples.

Samples 1 to 23 of a third set were left to stand for 7 days at 25° C. and relative humidity of 65% (Conditions A). Samples 1 to 23 of a fourth set were left to stand for 7 days at 50° C. and relative humidity of 40% (Conditions B). The cyan fogging density of each sample of the third set and the higher cyan fogging density of the identical sample of the fourth set were measured, and the former was subtracted from the latter, thereby determining an increase in the cyan fogging density.

The color turbidities, MTF values and cyan-fogging density increases of Samples 1-23, thus measured and determined, were as is shown in Table 2.

| | Processing Method | | | |
|---|---|---|---|---|
| Process | Time | Temp. | The quantity of replenisher* | Tank volume |
| Color development | 3 min. 15 sec. | 37.8° C. | 20 ml | 10 l |
| Bleaching | 45 sec. | 38° C. | 5 ml | 4 l |
| Bleach-Fixing (1) | 45 sec. | 38° C. | | 4 l |
| Bleach- | 45 sec. | 38° C. | 30 ml | 4 l |

-continued

| Process | Time | Temp. | The quantity of replenisher* | Tank volume |
|---|---|---|---|---|
| Fixing (2) | | | | |
| Washing (1) | 20 sec. | 38° C. | — | 2 l |
| Washing (2) | 20 sec. | 38° C. | 30 ml | 2 l |
| Stabilization | 20 sec. | 38° C. | 20 ml | 2 l |
| Drying | 1 min. | 55° C. | | |

*the quantity of replenisher per meter of a 35-mm wide sample

-continued

| | Mother Solution (g) | Replenisher (g) |
|---|---|---|
| Water to make | 1.0 l | 1.0 l |
| pH | 4.3 | 3.4 |
| (Bleach-Fixing Solution) | | |
| Ammonium ferric ethylenediamine tetra-acetate dihydrate | 50.0 | — |
| Disodium ethylene-diamine tetraacetate | 5.0 | 25.0 |

TABLE 2

| Sample | Color Turbidity 0.5 | 1.0 | 2.0 | MTF value (20 cycle/mm) Yellow | Magenta | Cyan | Fogging Density Increase at Condition B |
|---|---|---|---|---|---|---|---|
| 1 (Comparative) | 0.03 | 0.04 | 0.07 | 0.83 | 0.75 | 0.58 | 0.07 |
| 2 (Comparative) | 0.01 | 0.02 | 0.04 | 0.84 | 0.75 | 0.58 | 0.08 |
| 3 (Comparative) | −0.01 | −0.02 | 0.00 | 0.85 | 0.75 | 0.58 | 0.07 |
| 4 (Comparative) | −0.02 | −0.02 | −0.01 | 0.85 | 0.75 | 0.58 | 0.07 |
| 5 (Comparative) | −0.02 | −0.02 | −0.01 | 0.85 | 0.75 | 0.58 | 0.07 |
| 6 (Comparative) | 0.04 | 0.04 | 0.03 | 0.84 | 0.79 | 0.62 | 0.05 |
| 7 (Comparative) | 0.04 | 0.03 | 0.02 | 0.84 | 0.79 | 0.62 | 0.05 |
| 8 (Comparative) | 0.04 | 0.04 | 0.03 | 0.84 | 0.79 | 0.62 | 0.05 |
| 9 (Comparative) | 0.04 | 0.04 | 0.03 | 0.84 | 0.79 | 0.62 | 0.05 |
| 10 (Comparative) | 0.03 | 0.02 | 0.01 | 0.84 | 0.80 | 0.63 | 0.05 |
| 11 (Invention) | −0.01 | −0.01 | 0.01 | 0.85 | 0.80 | 0.64 | 0.05 |
| 12 (Invention) | −0.03 | −0.03 | −0.02 | 0.86 | 0.80 | 0.64 | 0.05 |
| 13 (Invention) | −0.05 | −0.07 | −0.08 | 0.87 | 0.80 | 0.64 | 0.05 |
| 14 (Invention) | −0.06 | −0.07 | −0.09 | 0.87 | 0.80 | 0.64 | 0.05 |
| 15 (Invention) | −0.06 | −0.07 | −0.09 | 0.87 | 0.80 | 0.64 | 0.05 |
| 16 (Invention) | −0.05 | −0.05 | −0.07 | 0.87 | 0.80 | 0.63 | 0.05 |
| 17 (Invention) | −0.05 | −0.06 | −0.08 | 0.87 | 0.80 | 0.63 | 0.05 |
| 18 (Invention) | −0.05 | −0.05 | −0.07 | 0.87 | 0.80 | 0.63 | 0.05 |
| 19 (Invention) | −0.05 | −0.05 | −0.07 | 0.87 | 0.80 | 0.63 | 0.05 |
| 20 (Comparative) | −0.01 | −0.02 | −0.02 | 0.85 | 0.77 | 0.59 | 0.11 |
| 21 (Comparative) | −0.01 | −0.01 | 0.00 | 0.85 | 0.78 | 0.59 | 0.12 |
| 22 (Comparative) | 0.00 | 0.00 | 0.00 | 0.85 | 0.77 | 0.60 | 0.13 |
| 23 (Comparative) | 0.02 | 0.02 | 0.03 | 0.84 | 0.77 | 0.60 | 0.12 |

In the color-developing process specified above, the bleach-fixing steps and the washing steps were carried out in counter flow. In other words, the step (1) was performed after the step (2). Further, the overflowing part of the bleaching solution was all used in the bleach-fixing (2). This overflowing part of the bleaching solution amounted to 2 ml per meter in the case of the 35-mm wide sample.

The compositions of the solutions used in the color-developing process are so follows:

| | Mother Solution (g) | Replenisher (g) |
|---|---|---|
| (Color Developing Solution) | | |
| Diethylenetriamine-pentaacete | 5.0 | 6.0 |
| Sodium sulfite | 4.0 | 5.0 |
| Potassium carbonate | 30.0 | 37.0 |
| Potassium bromide | 1.3 | 0.5 |
| Potassium iodide | 1.2 mg | — |
| Hydroxylamine sulfate | 2.0 | 3.6 |
| 4-[N-ethyl-N-β-hydroxylethylamino]-2-methylaniline sulfate | 4.7 | 6.2 |
| Water to make | 1.0 l | 1.0 l |
| pH | 10.00 | 10.15 |
| (Bleaching Solution) | | |
| Ammonium ferric 1,3-diaminopropane tetra-acetate monohydrate | 144.0 | 206.0 |
| 1,3-diaminopropane-tetraaceate | 2.8 | 4.0 |
| Ammonium bromide | 84.0 | 120.0 |
| Ammonium nitrate | 17.5 | 25.0 |
| Ammonia water (27%) | 10.0 | 1.8 |
| Acetic acid (98%) | 51.1 | 73.0 |
| Sodium sulfite | 12.0 | 20.0 |
| Ammonium thiosulfate aqueous solution (700 g/l) | 290.0 ml | 320.0 ml |
| Ammonia Water (27%) | 6.0 ml | 15.0 ml |
| Water to make | 1.0 l | 1.0 l |
| pH | 6.8 | 8.0 |

Washing Solution

The same solution was used for washing both the mother solution and the replenisher. The solution was one having been prepared as follows. First, passing tap water was passed through a mixed-bed column filled with H-type strong-acid cation exchange resin (Amberlite IR-120B) and OH-type strong-base anion exchange resin (Amberlite IRA-400), both resins made by manufactured by Rome and Harse, Inc., whereby the calcium and magnesium ion concentration of the water was reduced to 3mg/l or less. Next, 20 mg/l of sodium dichloro isocyanurate and 150 mg/l of sodium sulfate were added to the water thus processed, thereby obtaining the washing solution. The washing solution had pH value ranging from 6.5 to 7.5.

Stabilizing Solution

The same solution, the composition of which is specified below, was used for stabilizing both the mother solution and the replenisher.

| | |
|---|---|
| Formalin (37%) | 1.2 ml |
| Surfactant ($C_{10}H_{21}$—O—$(CH_2CH_2O)_{10}$—H) | 0.4 g |

-continued

| | |
|---|---|
| Ethylene glycol | 1.0 g |
| Water to make | 1.0 l |
| pH | 5.0 to 7.0 |

As is evident from Table 2, Samples 11 to 19, which fall within the scope of the invention, had less color turbidities than the comparative samples at any region having cyan density of 0.5 (i.e., low-exposure region), at any region having cyan density of 1.0 (i.e., medium-exposure region), and at any region having cyan density of 2.0 (i.e., high-exposure region). Also, as can be understood from Table 2, the samples of the present invention excelled in color reproduction, at any part which has been exposed to light.

Further, as is clearly seen from Table 2, all samples of the invention, i.e., Samples 11 to 19, had great MTF values for yellow, magenta and cyan, and excelled in sharpness of an image of any color.

From Table 2 it is also evident that Samples 11 to 19 had their fogging densities increased only a little during their storage, and their photographic properties changed only a little during their storage.

EXAMPLE 2

Samples 24 to 46 were prepared which were equal to Samples 1 to 23, respectively, except that half mole of EX-2 contained in the layers 4 and 5 was replaced by the cyan coupler (D-13). Samples 24 to 46, thus prepared, were put to the experiments that were conducted on samples 1 to 23. The results of the experiments showed that Samples 34 to 42, which fall within the scope of the invention, exhibited good characteristics, like Samples 11 to 19 according to the invention.

EXAMPLE 3

Samples 47 to 50 were prepared by adding the compounds (4), (10), (11) and (15) of the invention, each used in an amount of 0.035 g/m$^2$ to layers 4 of four samples equal to Sample 9 disclosed in JP-A-2-93641. Also, Sample 51 was prepared by adding 0.050 g/m$^2$ of the yellow-colored cyan coupler (YC-26) to the layer 3 of a sample equal to Sample 9 described in JP-A-2-93641. Further, Samples 52 to 55 were prepared which were equal to Samples by adding the compounds (4), (10), (11) and (15) of the invention, each used in an amount of 0.035 g/m$^2$ to layers 4 of four samples equal to Sample 51.

Samples 47 to 55 were put to the experiments that were conducted on samples 1 to 23. The results of the experiments proved that Samples 52 to 55, which fall within the scope of the invention, exhibited excelled Samples 47 to 51 in terms of color reproduction at any exposed region, sharpness of yellow, magenta and cyan images, and storage stability (i.e., decrease in fogging density).

EXAMPLE 4

Samples 11 to 19 of another set were processed in the same way as in Example 1, except that use was made of a stabilizing solution prepared by adding pyrazole, used in an amount of 4 g/l (said solution containing 0.016 mol % of 1-methylol pyrazole, and pyrazole in an amount 3.7 times that of 1-methylol pyrazole).

Samples 11 to 19, thus processed, and the samples of Example 1 were stored for one month at 60° C. and relative humidity of 70%, and an increase in the yellow density of the unexposed regions of each sample had been measured. The yellow-density increase of each sample was about 0.03 less than that of the corresponding sample stabilized with the solution containing no pyrazole.

It was found that the pyrazole-containing stabilizing solution did not have formalin smell as the stabilizing solution containing no pyrazole.

The following are the formulas of the compounds used in Examples 1 to 4. Shown in Table 3 are the emulsion A to I used in Examples 1 to 4.

EX-1

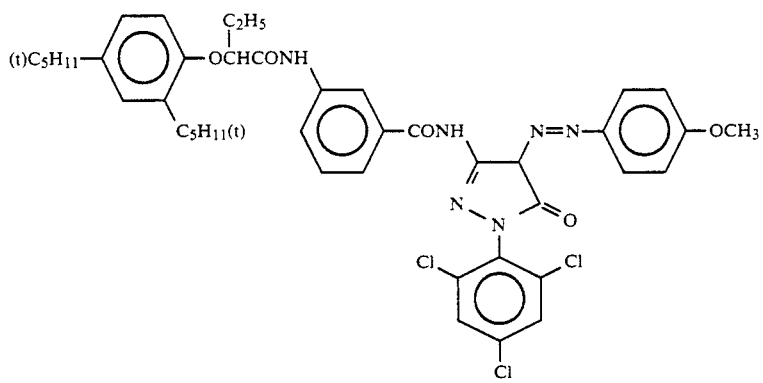

(preferable cyan coupler of this invention, C-4)

EX-2

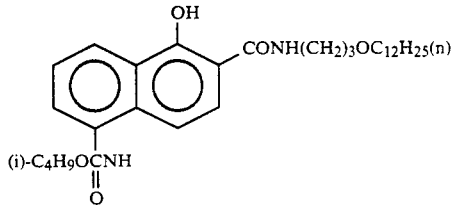

-continued
EX-3
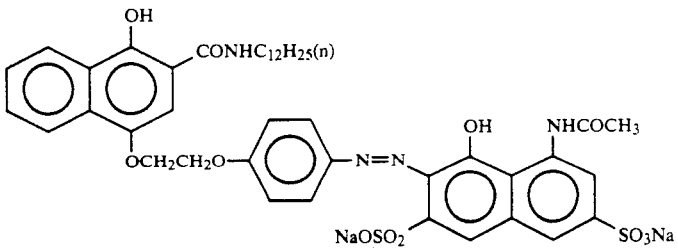
(preferable cyan coupler of this invention, C-9)
EX-4
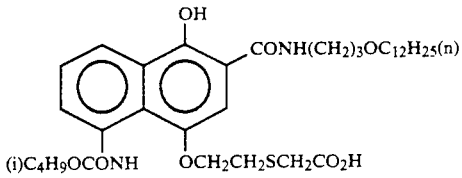
EX-5
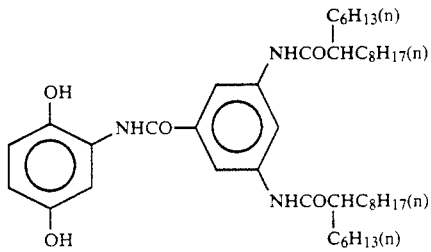
EX-6
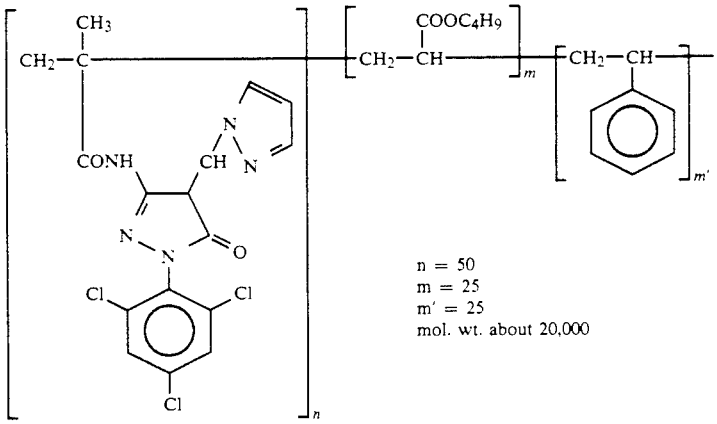
EX-7
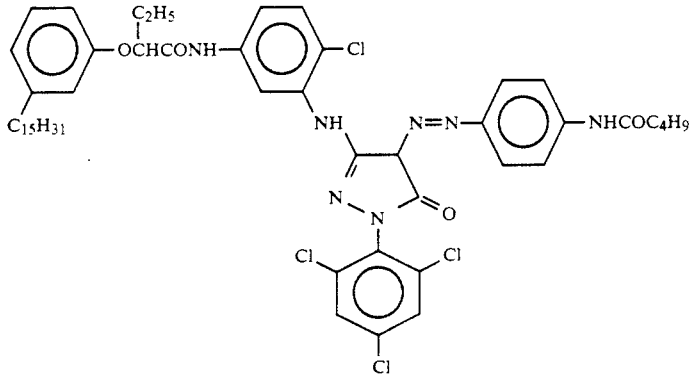

-continued
EX-8
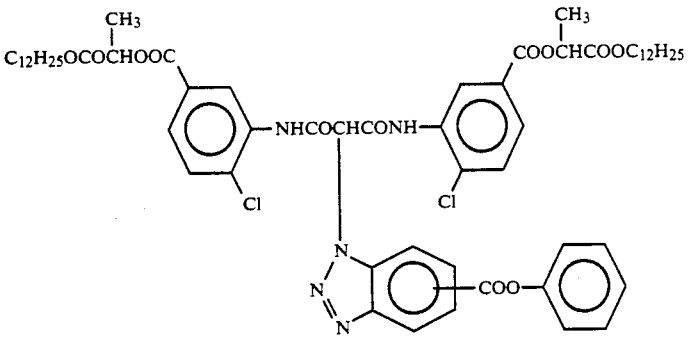
EX-9
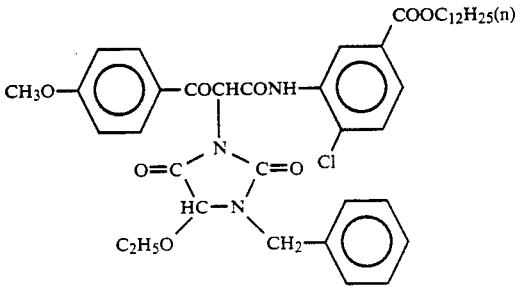
EX-10
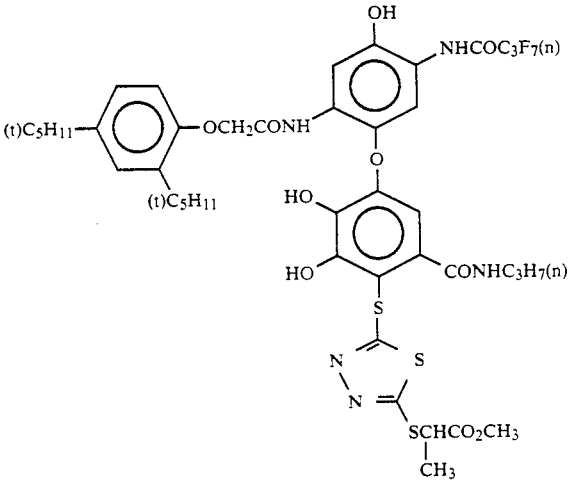
EX-11
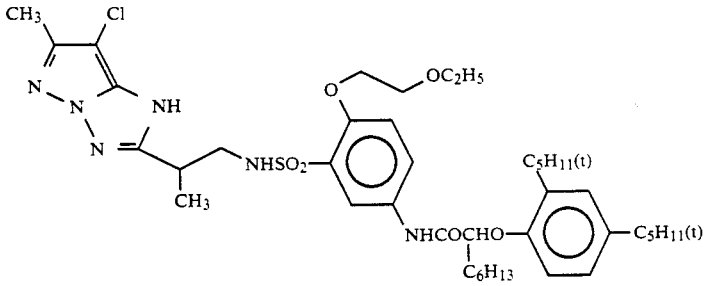
EX-12
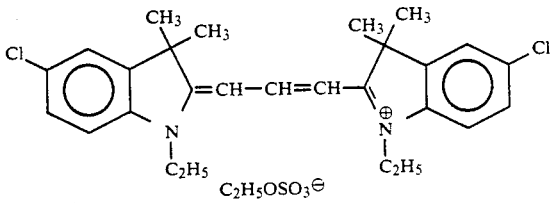

-continued
EX-13
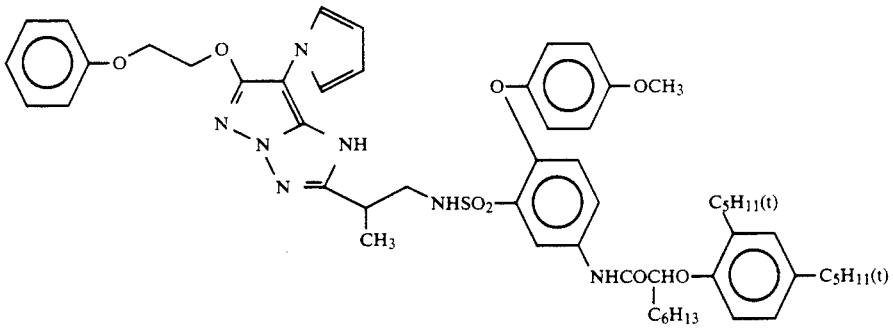
(preferable cyan coupler of this invention, C-3)
EX-14
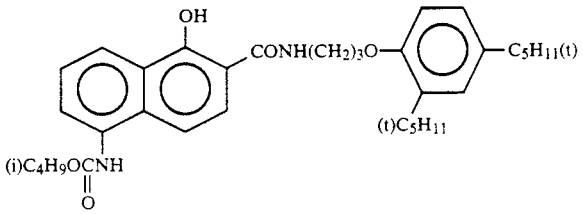
EX-15
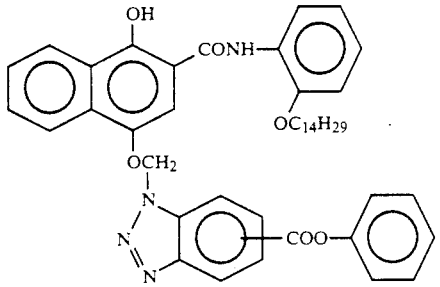
EX-16
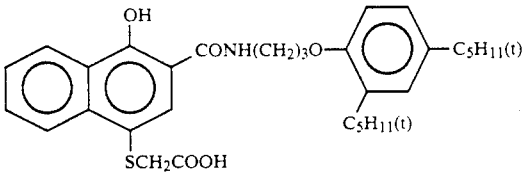
EX-17
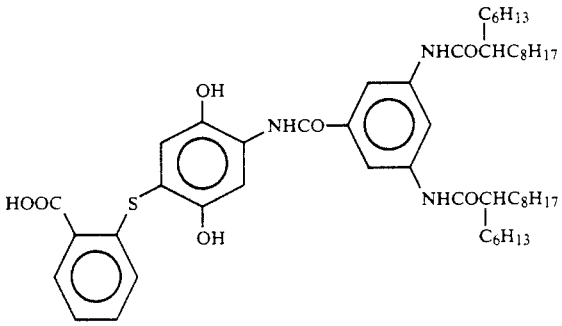
(Compound 1 of JP-A-60-218645)

-continued
EX-18
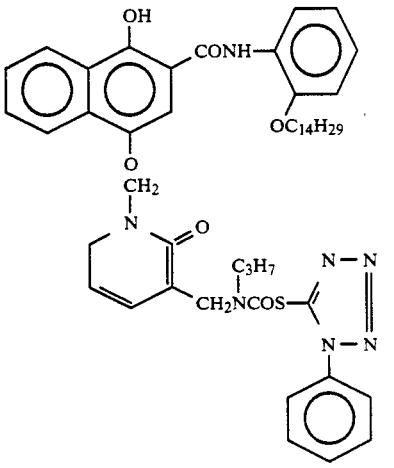
(Compound 6 or JP-A-63-37346)
EX-19
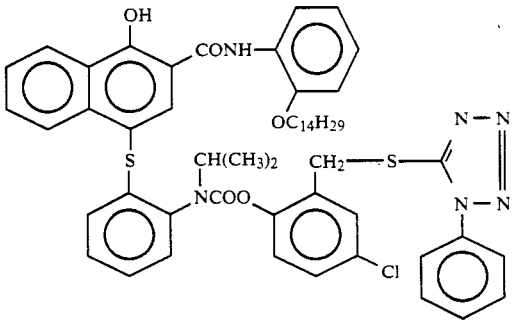
(Compound 3 of JP-A-1-280755)
EX-20
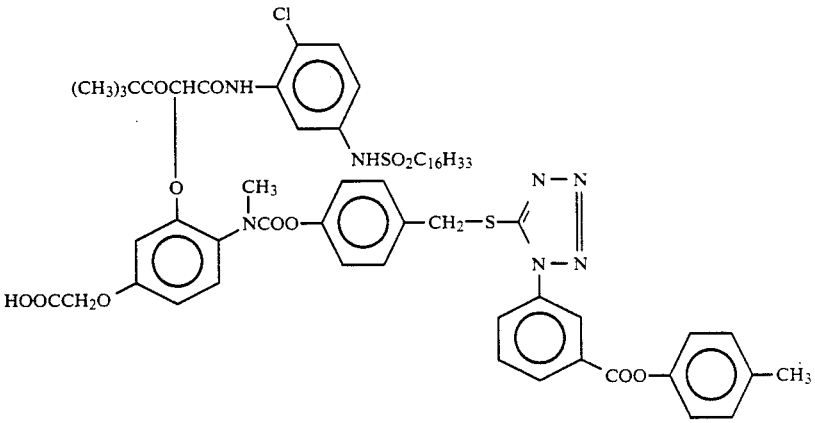
(Compound T-1 of JP-A-2-230139)

-continued
EX-21
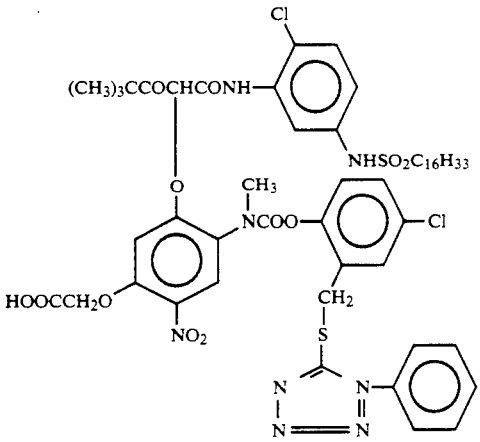
U-1
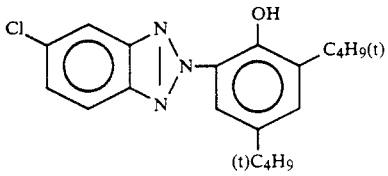
U-2
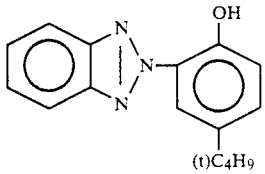
U-3
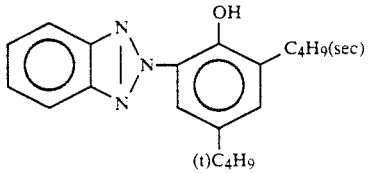
U-4
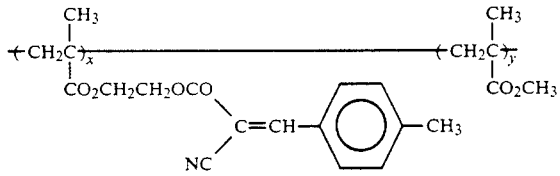
x:y = 70:30 (wt %)
U-5
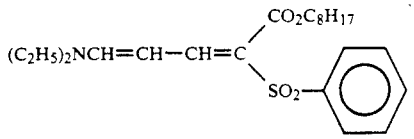
Tricresylphosphate HBS-1
Di-n-butylphthalate HBS-2
HBS-3
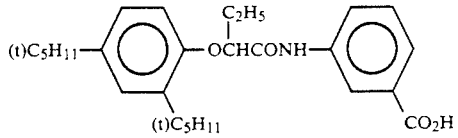

-continued
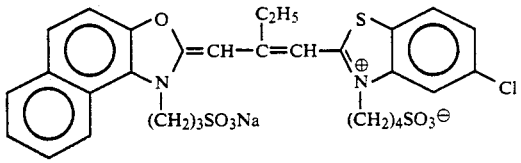
Sensitizing dye I
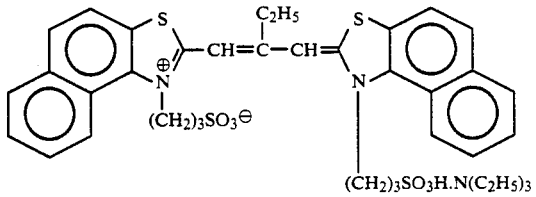
Sensitizing dye II
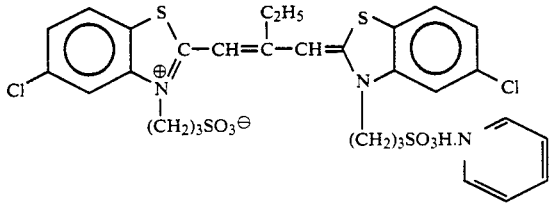
Sensitizing dye III
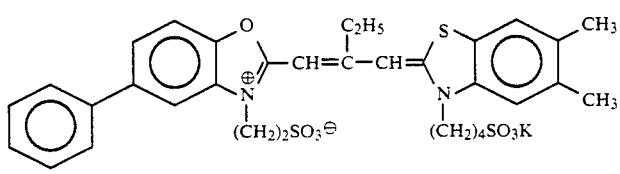
Sensitizing dye IV
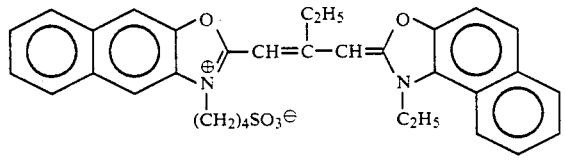
Sensitizing dye V
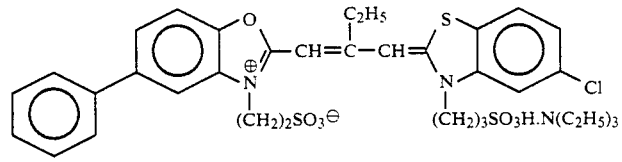
Sensitizing dye VI
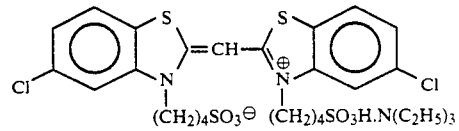
Sensitizing dye VII
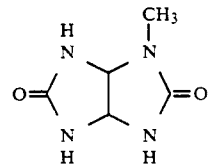
S-1
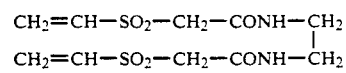
H-1

-continued
B-1
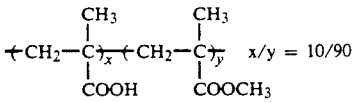
B-2
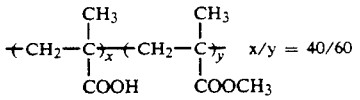
B-3
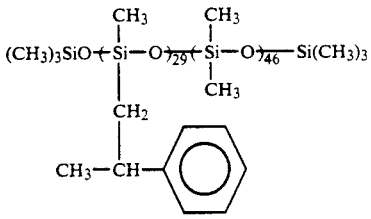
B-4
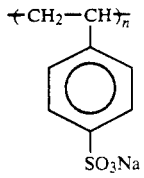
B-5
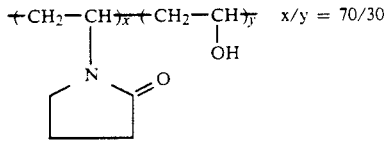
W-1
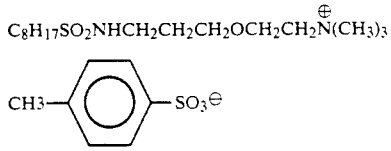
W-2
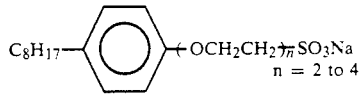
W-3
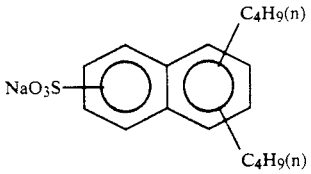
F-1
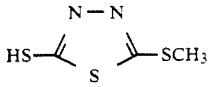
F-2
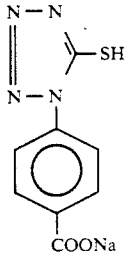

-continued
F-3
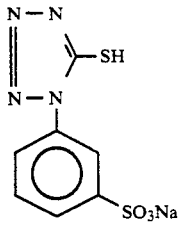
F-4
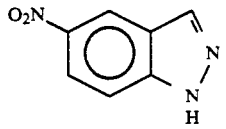
F-5
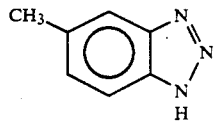
F-6
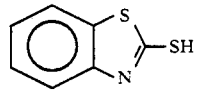
F-7
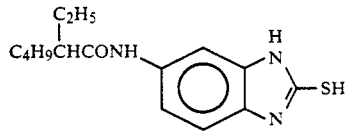
F-8
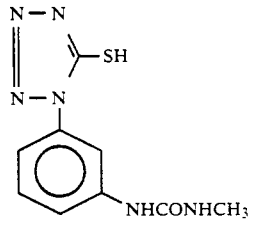
F-9
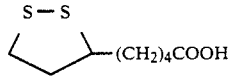
F-10
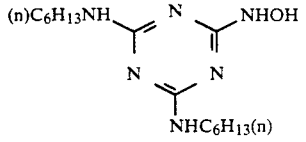
F-11
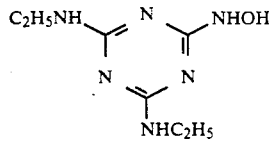
F-12
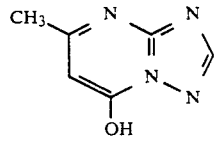

-continued

F-13

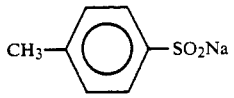

TABLE 3

| | Average AgI Content (%) | Average Grain Size (μm) | Variation Coefficient (%) According to Grain Size (%) | Diameter-to-Thickness Ratio | Silver Amount Ratio (AgI Content %) |
|---|---|---|---|---|---|
| Emulsion A | 4.0 | 0.30 | 13 | 4.5 | Core/Shell = 1/3(13/1), Double structure grain |
| Emulsion B | 8.9 | 0.60 | 15 | 5.5 | Core/Shell = 3/7(25/2), Double structure grain |
| Emulsion C | 6.0 | 0.65 | 17 | 6.5 | Core/Shell = 2/1(8/2), Double structure grain |
| Emulsion D | 8.0 | 0.90 | 19 | 7.5 | Core/Shell = 1/1(16/0), Double structure grain |
| Emulsion E | 10 | 0.85 | 18 | 7.5 | Core/Shell = 1/2(24/3), Double structure grain |
| Emulsion F | 4.0 | 0.20 | 15 | 7.5 | Core/Shell = 1/3(13/1), Double structure grain |
| Emulsion G | 14.0 | 0.65 | 14 | 6.0 | Core/Shell = 1/2(42/0), Double structure grain |
| Emulsion H | 10.0 | 1.00 | 16 | 5.5 | Core/Shell = 2/1(15/0), Double structure grain |
| Emulsion I | 1 | 0.07 | 15 | 1.0 | Uniform grain |

EXAMPLE 5

Samples 1 to 23 were put to the same experiments as conducted in Example 1, except that use as made of a color developing solution in which 4-[N-ethyl-N-β-hydroxyethylamino]-2-methylaniline sulfate was replaced by 4-[N-ethyl-N-6-hydroxybutylamino]-2-methylaniline-p-toluene sulfonate used in the same mole amount, and that the color development time was 3 minutes instead of 3 minutes 15 seconds. The results of these experiments proved that Samples 11 to 19 falling in the scope of the invention excelled Comparative Samples 1 to 10 and 20 to 23 in color reproduction and sharpness at any exposed region.

Further, Samples 1 to 23 of a first set were subjected to white exposure for sensitometry, and were then color developed in the same way as in Example 1. Also, Samples 1 to 23 of a second set were subjected white exposure for sensitometry, and were subsequently developed in the same way as in Example 4. Then, the sensitivity of each sample of the second set, relative to that of the corresponding sample of the first set, was determined, said relative sensitivity being a logarithm of a reciprocal to the exposure amount which provide cyan density (fog +0.2). The results were as is shown in Table 4.

TABLE 4

| Sample | Sensitivity of Sample of Example 4, Relative to that of Sample of Example 1 |
|---|---|
| 1 (Comparative) | 0.02 |
| 2 (Comparative) | 0.04 |
| 3 (Comparative) | 0.05 |
| 4 (Comparative) | 0.05 |
| 5 (Comparative) | 0.05 |
| 6 (Comparative) | 0.04 |
| 7 (Comparative) | 0.04 |
| 8 (Comparative) | 0.04 |
| 9 (Comparative) | 0.04 |
| 10 (Comparative) | 0.03 |
| 11 (Invention) | 0.05 |
| 12 (Invention) | 0.07 |
| 13 (Invention) | 0.08 |
| 14 (Invention) | 0.08 |
| 15 (Invention) | 0.08 |

TABLE 4-continued

| Sample | Sensitivity of Sample of Example 4, Relative to that of Sample of Example 1 |
|---|---|
| 16 (Invention) | 0.07 |
| 17 (Invention) | 0.08 |
| 18 (Invention) | 0.07 |
| 19 (Invention) | 0.07 |
| 20 (Comparative) | 0.03 |
| 21 (Comparative) | 0.04 |
| 22 (Comparative) | 0.03 |
| 23 (Comparative) | 0.03 |

As is evident from Table 4, Samples 11 to 19 exhibited high sensitivity, despite the relatively short color development time.

As has been described above, the present invention can provide a light-sensitive material which has high light-sensitivity and high contrast and excels in color reproduction at all light-exposed regions, yellow-image sharpness, magenta-image sharpness, and cyan-image sharpness, and the sensitivity of which little deteriorates during storage.

Additional advantages and modifications will readily occur to those skilled in the art. Therefore, the invention in its broader aspects is not limited to the specific details, or illustrated examples shown and described herein. Accordingly, various modifications may be made without departing from the spirit or scope of the general inventive concept as defined by the appended claims and their equivalents.

What is claimed is:

1. A silver halide color photographic light-sensitive material comprising at least one light-sensitive, silver halide emulsion layer on a support, said material containing at least one compound represented by the following formula (I), and a yellow-colored cyan coupler:

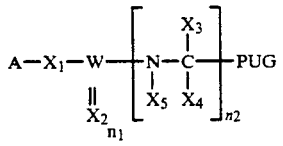

where A is a coupler residue or a redox group; $X_1$ is oxygen or sulfur; $X_2$ is oxygen, sulfur or $=NX_6$ group; W is carbon or sulfur; $X_3$, $X_4$, $X_5$ and $X_6$ are each hydrogen or an organic group, and any two of $X_3$, $X_4$ and $X_5$ can be divalent groups which form a ring; PUG is a photographically useful group bonded to the carbon atom by a hetero atom in PUG which is cleavable from the carbon atom; $n_1$ is 1 if W is carbon, and either 1 or 2 if W is sulfur; if $n_1$ is 2, two $X_2$ groups can either be the same or different; and $n_2$ is either 1 or 2, and if $n_2$ is 2, two $X_3$ groups, two $X_4$ groups, and two $X_5$ groups are either the same or different.

2. The material according to claim 1, wherein said yellow-colored cyan coupler is a cyan coupler capable of releasing, when coupled with a oxidized form of aromatic primary amine developing agent, a water-soluble compound residue which contains a group selected from the group consisting of 6-hydroxy-2-pyridon-5-ylazo group, 5-pyrazolon-4-ylazo group, 5-aminopyrazol-4-ylazo group, 2-acylaminophenylazo group, and 2-sulfonamidephenylazo group.

3. The material according to claim 1, further containing a naphthol-based cyan coupler which has an amino group at 5-position.

4. The material according to claim 2, further containing a naphthol-based cyan coupler which has an amino group at 5-position.

5. The material according to claim 1, further containing a phenol-based cyan coupler which has a phenyl ureido group at 2-position and a carbonamide group at 5-position.

6. The material according to claim 2, further containing a phenol-based cyan coupler which has a phenyl ureido group at 2-position and a carbonamide group at 5-position.

7. The material according to claim 3, further containing a phenol-based cyan coupler which has a phenyl ureido group at 2-position and a carbonamide group at 5-position.

8. The material according to claim 4, further containing a phenol-based cyan coupler which has a phenyl ureido group at 2-position and a carbonamide group at 5-position.

9. The material according to claim 1, wherein $-X_1-W(=X_2)n_1-$ in the formula (I) is $-OC(=O)-$, $-OS(=O)-$, or $-OC(=S)-$.

10. The material according to claim 9, wherein $-X_1-W(=X_2)n_1-$ is $-OC(=O)-$.

11. The material according to claim 1, wherein $n_2$ in formula (I) is 1.

12. The material according to claim 1, wherein a divalent residual group produced by removing A and PUG from formula (I) has an atomic weight of 240 or less.

13. The material according to claim 12, wherein said atomic weight is 200 or less.

14. The material according to claim 13, wherein said atomic weight is 180 or less.

15. The material according to claim 1, wherein PUG in the formula (I) is a development inhibitor.

16. The material according to claim 1, wherein said yellow-colored cyan coupler is represented by the following formula (CI):

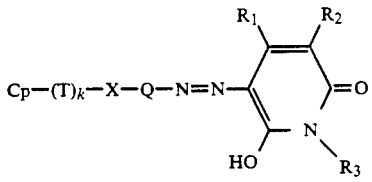

Formula (CI)

wherein Cp is a cyan coupler residue; T is a timing group bonded to the coupling position of Cp; k is 0 or 1; X is a divalent linking group containing N, O or S through which it is bonded to $(T)_k$, and bonding to Q; Q is an arylene group or divalent heterocyclic group; $R_1$ and $R_2$ are independently hydrogen, carboxyl, sulfo, cyano, an alkyl group, a cycloalkyl group, an aryl group, a heterocyclic group, carbamoyl, sulfamoyl, carboamide, sulfonamide, or an alkylsulfonyl group; $R_3$ is hydrogen, an alkyl group, a cycloalkyl group, an aryl group or a heterocyclic group; wherein at least one of T, X, Q, $R_1$, $R_2$, and $R_3$ is a water-soluble group.

17. The material according to claim 1, wherein said yellow-colored cyan coupler is represented by the following formula (CII):

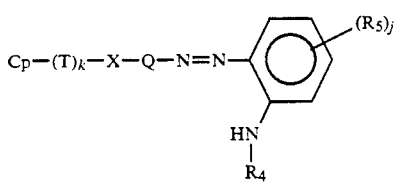

Formula (CII)

wherein Cp is a cyan coupler residue; T is a timing group bonded to the coupling position of Cp; k is 0 or 1; X is a divalent linking group containing N, O or S through which it is bonded to $(T)_k$, and bonding to Q; Q is an arylene group or divalent heterocyclic group; $R_4$ is an acryl group or sulfonyl; $R_5$ is a substitutable group; j is 0 or an integer of 1 to 4; wherein W j is 2, 3 or 4, the plural $R_4$ group may be the same or different; and wherein at least one of T, X, Q, $R_4$ and $R_5$ is a water-soluble group.

18. The material according to claim 1, wherein said yellow-colored cyan coupler is represented by the following formula (CIII):

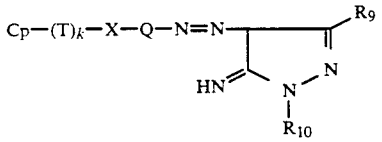

Formula (CIII)

wherein Cp is a cyan coupler residue; T is a timing group bonded to the coupling position of Cp; k is 0 or 1; X is a divalent linking group containing N, O or S through which it is bonded to $(T)_k$, and bonding to Q; Q is an arylene group or divalent heterocyclic group; $R_9$ is hydrogen, carboxyl, sulfo, cyano, an alkyl group, a cycloalkyl group, an aryl group, an alkoxy group, a cycloalkyloxy group, an aryloxy group, a heterocyclic group, carbamoyl, sulfamoyl, carbonamide, sulfonamide or an alkylsulfonyl; $R_{10}$ is hydrogen, an alkyl group, a cycloalkyl group, an aryl group or a heterocyclic group; wherein at least one of T, X, Q, $R_9$ and $R_{10}$ is a water-soluble group.

19. The material according to claim 1, wherein said yellow-colored cyan coupler is represented by the following formula (CIV):

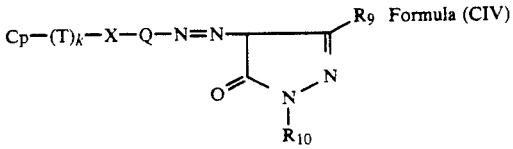

Formula (CIV)

wherein Cp is a cyan coupler residue; T is a timing group bonded to the coupling position of Cp; k is 0 or 1; K is a divalent linking group containing N, O or S through which it is bonded to $(T)_k$, and bonding to Q; Q is an arylene group or divalent heterocyclic group; $R_9$ is hydrogen, carboxyl, sulfo, cyano, an alkyl group, a cycloalkyl group, an aryl group, an alkoxy group, a cycloalkyloxy group, an aryloxy group, a heterocyclic group, carbamoyl, sulfamoyl, carbonamide, sulfonamide or an alkylsulfonyl; $R_{10}$ is hydrogen, an alkyl group, a cycloalkyl group, an aryl group or a heterocyclic group; wherein at least one of T, X, Q, $R_9$ and $R_{10}$ is a water-soluble group.

20. A method of processing a silver halide color photographic light-sensitive material of claim 1, said method comprising the steps of: subjecting the material to imagewise light-exposure, and treating the light-exposed material with a color-developing solution containing 4-amino-3-methyl-N-ethyl-N-(3-hydroxybutyl) aniline, 4-amino-3-methyl-N-ethyl-N-(4-hydroxybutyl) aniline, 4-amino-3-methyl-N-propyl-N-(2-hydroxyethyl) aniline, or 4-amino-3-methyl-N-propyl-N-(3-hydroxypropyl) aniline.

* * * * *